US008337953B2

(12) United States Patent
Nakazawa et al.

(10) Patent No.: US 8,337,953 B2
(45) Date of Patent: Dec. 25, 2012

(54) INKJET RECORDING METHOD AND APPARATUS

(75) Inventors: Yusuke Nakazawa, Kanagawa-ken (JP); Toshiyuki Makuta, Kanagawa-ken (JP); Yasuhiko Kachi, Kanagawa-ken (JP); Misato Sasada, Kanagawa-ken (JP); Terukazu Yanagi, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 735 days.

(21) Appl. No.: 12/470,742

(22) Filed: May 22, 2009

(65) Prior Publication Data

US 2009/0311426 A1 Dec. 17, 2009

(30) Foreign Application Priority Data

May 23, 2008 (JP) ..... 2008-135621

(51) Int. Cl.
*B05D 1/36* (2006.01)

(52) U.S. Cl. ..... 427/261; 427/385.5; 427/407.1; 347/104

(58) Field of Classification Search ..... 427/256, 427/258, 261, 265, 288, 301, 411, 385.5, 427/407.1; 347/104; 271/275–277; 118/500
See application file for complete search history.

(56) References Cited

U.S. PATENT DOCUMENTS

| | | | | |
|---|---|---|---|---|
| 4,538,160 | A | 8/1985 | Uchiyama | |
| 5,816,155 | A | 10/1998 | Stephan | |
| 6,257,716 | B1 | 7/2001 | Yanagawa et al. | |
| 6,341,854 | B1 | 1/2002 | Takemoto | |
| 6,378,425 | B1 | 4/2002 | Stephan | |
| 6,402,317 | B2 | 6/2002 | Yanagawa et al. | |
| 6,595,615 | B2 * | 7/2003 | Ylitalo | 347/19 |
| 6,612,569 | B2 | 9/2003 | Schaum | |
| 7,524,005 | B2 | 4/2009 | Inoue | |
| 7,722,180 | B2 | 5/2010 | Mashima | |
| 7,726,802 | B2 * | 6/2010 | Morimoto | 347/100 |
| 2002/0084581 | A1 | 7/2002 | Schaum | |
| 2003/0067529 | A1 | 4/2003 | May et al. | |
| 2006/0009544 | A1 | 1/2006 | Miyagawa et al. | |
| 2006/0109295 | A1 | 5/2006 | Kusunoki | |
| 2006/0238592 | A1 | 10/2006 | Kadomatsu et al. | |
| 2007/0008394 | A1 | 1/2007 | Mashima | |

(Continued)

FOREIGN PATENT DOCUMENTS

| | | | |
|---|---|---|---|
| EP | 0893271 | A1 | 1/1999 |

(Continued)

*Primary Examiner* — Frederick Parker
*Assistant Examiner* — Alex A Rolland
(74) *Attorney, Agent, or Firm* — Birch, Stewart, Kolasch & Birch, LLP

(57) ABSTRACT

The inkjet recording method includes: a treatment liquid depositing step of applying treatment liquid onto a recording medium on a treatment liquid drum; an image forming step of ejecting ink from a line inkjet head to deposit the ink onto the recording medium on which the treatment liquid has been deposited on a circumferential surface of an image formation drum, the ink containing at least a resin dispersant (A), a pigment (B) that is dispersed by the resin dispersant (A), self-dispersible polymer micro-particles (C) and an aqueous liquid medium (D), the ink having one of a solid component that is aggregated upon making contact with the treatment liquid and a solid component that is precipitated upon making contact with the treatment liquid; and a drying step of drying a solvent in the ink having been deposited on the recording medium on a drying drum.

11 Claims, 15 Drawing Sheets

U.S. PATENT DOCUMENTS

| | | | | |
|---|---|---|---|---|
| 2008/0055385 | A1 | 3/2008 | Houjou | |
| 2008/0098910 | A1 | 5/2008 | Koto et al. | |
| 2009/0053409 | A1 | 2/2009 | Yamamoto et al. | |
| 2009/0079784 | A1* | 3/2009 | Chiwata et al. | 347/21 |
| 2009/0128611 | A1 | 5/2009 | Kariya et al. | |
| 2009/0231377 | A1 | 9/2009 | Kachi | |
| 2009/0231407 | A1 | 9/2009 | Kachi | |
| 2009/0244237 | A1 | 10/2009 | Kachi | |
| 2009/0291215 | A1 | 11/2009 | Makuta et al. | |
| 2009/0311426 | A1 | 12/2009 | Nakazawa et al. | |

FOREIGN PATENT DOCUMENTS

| | | | |
|---|---|---|---|
| GB | 535197 | | 4/1941 |
| JP | 3-169644 | A | 7/1991 |
| JP | 4-18462 | A | 1/1992 |
| JP | 8-244206 | A | 9/1996 |
| JP | 10-138526 | A | 5/1998 |
| JP | 11-188858 | A | 7/1999 |
| JP | 2000-37942 | A | 2/2000 |
| JP | 2000-168047 | A | 6/2000 |
| JP | 2002-292956 | A | 10/2002 |
| JP | 2004-10633 | A | 1/2004 |
| JP | 2004-90596 | A | 3/2004 |
| JP | 2005-138336 | A | 6/2005 |
| JP | 2006-37088 | A | 2/2006 |
| JP | 2006-264068 | A | 10/2006 |
| JP | 2007-15130 | A | 1/2007 |
| JP | 2007-160879 | A | 6/2007 |
| JP | 2007-161753 | A | 6/2007 |
| JP | 2007160664 | | 6/2007 |
| JP | 2007-175922 | A | 7/2007 |
| JP | 2007-216456 | A | 8/2007 |
| JP | 2007-217508 | A | 8/2007 |
| JP | 2007-261206 | A | 10/2007 |
| JP | 2008-087354 | A | 4/2008 |

* cited by examiner

FIG.15

| EXPERIMENT | INK COMPOSITION | TREATMENT LIQUID | DRYING | LANDING INTERFERENCE | CURL | IMAGE CONTRACTION | TEXT REPRODUCIBILITY | IMAGE STRENGTH |
|---|---|---|---|---|---|---|---|---|
| 1-1 | C-1, M-1, Y-1, Bk-1 (PIGMENT/Lx=1/2) | YES | STRONG | GOOD | EXCELLENT | GOOD | GOOD | GOOD |
| 1-2 | | | MEDIUM | GOOD | EXCELLENT | GOOD | GOOD | GOOD |
| 1-3 | | | WEAK | GOOD | GOOD | GOOD | GOOD | FAIR |
| 1-4 | | NO | STRONG | POOR | POOR | GOOD | POOR | FAIR |
| 1-5 | C-2, M-2, Y-2, Bk-2 (PIGMENT/Lx=1/2) | YES | MEDIUM | GOOD | EXCELLENT | GOOD | GOOD | GOOD |
| 1-6 | | | WEAK | GOOD | EXCELLENT | GOOD | GOOD | FAIR |
| 1-7 | | NO | STRONG | POOR | POOR | GOOD | POOR | FAIR |
| 1-8 | C-3, M-3, Y-3, Bk-3 (PIGMENT/Lx=1/1) | YES | STRONG | GOOD | EXCELLENT | GOOD | GOOD | GOOD |
| 1-9 | | | MEDIUM | GOOD | GOOD | GOOD | GOOD | GOOD |
| 1-10 | | | WEAK | GOOD | FAIR | GOOD | GOOD | FAIR |
| 1-11 | | NO | STRONG | POOR | POOR | GOOD | POOR | FAIR |
| 1-12 | C-4, M-4, Y-4, Bk-4 (PIGMENT/Lx=1/0.5) | YES | STRONG | FAIR | GOOD | GOOD | FAIR | FAIR |
| 1-13 | | NO | | POOR | POOR | GOOD | POOR | FAIR |
| 1-14 | C-5, M-5, Y-5, Bk-5 (PIGMENT/Lx=1/0) | YES | STRONG | POOR | POOR | GOOD | POOR | POOR |

FIG.16

| EXPERIMENT | INK COMPOSITION | PAPER | DRYING | LANDING INTERFERENCE | CURL | IMAGE CONTRACTION | TEXT REPRODUCIBILITY | IMAGE STRENGTH |
|---|---|---|---|---|---|---|---|---|
| 2-1 | C-1, M-1, Y-1, Bk-1 (PIGMENT/Lx=1/2) | URITE 84.9 g/m2 | MEDIUM | GOOD | EXCELLENT | GOOD | GOOD | GOOD |
| 2-2 | | | WEAK | GOOD | FAIR | GOOD | GOOD | FAIR |
| 2-3 | | NEW AGE 104.7 g/m2 | STRONG | GOOD | EXCELLENT | GOOD | GOOD | GOOD |
| 2-4 | | | MEDIUM | GOOD | GOOD | FAIR | GOOD | GOOD |
| 2-5 | C-2, M-2, Y-2, Bk-2 (PIGMENT/Lx=1/2) | URITE 84.9 g/m2 | MEDIUM | GOOD | EXCELLENT | GOOD | GOOD | GOOD |
| 2-6 | | | WEAK | GOOD | GOOD | GOOD | GOOD | FAIR |
| 2-7 | | NEW AGE 104.7 g/m2 | STRONG | GOOD | EXCELLENT | GOOD | GOOD | GOOD |
| 2-8 | | | MEDIUM | GOOD | EXCELLENT | GOOD | GOOD | GOOD |
| 2-9 | C-3, M-3, Y-3, Bk-3 (PIGMENT/Lx=1/1) | | STRONG | GOOD | EXCELLENT | GOOD | GOOD | GOOD |
| 2-10 | | | MEDIUM | GOOD | GOOD | GOOD | GOOD | GOOD |
| 2-11 | C-4, M-4, Y-4, Bk-4 (PIGMENT/Lx=1/0.5) | | STRONG | FAIR | GOOD | GOOD | FAIR | FAIR |
| 2-12 | | | MEDIUM | FAIR | FAIR | GOOD | FAIR | FAIR |

FIG.17

| EXPERIMENT | TREATMENT LIQUID | DRYING | LANDING INTERFERENCE | CURL | IMAGE CONTRACTION | TEXT REPRODUCIBILITY | IMAGE STRENGTH |
|---|---|---|---|---|---|---|---|
| 3-1 | TREATMENT LIQUID 1 | MEDIUM | GOOD | GOOD | GOOD | GOOD | GOOD |
| 3-2 | TREATMENT LIQUID 2 | MEDIUM | GOOD | GOOD | GOOD | GOOD | FAIR |
| 3-3 | TREATMENT LIQUID 3 | MEDIUM | GOOD | GOOD | GOOD | GOOD | GOOD |
| 3-4 | TREATMENT LIQUID 4 | MEDIUM | GOOD | FAIR | GOOD | FAIR | FAIR |
| 3-5 | | STRONG | GOOD | FAIR | GOOD | FAIR | GOOD |

INKJET RECORDING METHOD AND APPARATUS

BACKGROUND OF THE INVENTION

1. Field of the Invention

The present invention relates to an inkjet recording method and an inkjet recording apparatus, and more particularly to an inkjet recording method and an inkjet recording apparatus based on a direct printing method which forms an image by directly depositing aqueous ink onto a recording medium.

2. Description of the Related Art

An inkjet recording apparatus is able to record images of good quality by means of a simple composition, and therefore such apparatuses are widely used as domestic printers for individual use and office printers for commercial use. In the case of office printers for commercial use, in particular, there are increasing demands for higher processing speed and higher image quality.

In improving the image quality achieved by an inkjet recording apparatus, generally, it is necessary that there should be little interference between ink droplets ejected from the nozzles of the ink head (hereinafter referred to as "landing interference"), little contraction of the image (hereinafter referred to as "image contraction") and good reproducibility of text characters (hereinafter referred to as "text reproducibility"), and so on.

Moreover, in the inkjet recording apparatus, it is also necessary to suppress curl, and the like, and to improve the image strength. In other words, if water is used as a solvent in the ink, then the water permeates into the recording medium, deformation of the recording medium, such as curling or cockling, is liable to occur, and therefore suppressing of curl, and the like, is required. Furthermore, if general paper such as offset printing paper is used as the recording medium, then the image becomes more liable to disturbance when the paper is rubbed and therefore "image strength" is required.

Various methods have been proposed in response to requirements of these kinds. For example, Japanese Patent Application Publication No. 2004-010633 discloses an image forming method in which a powder layer is deposited on an intermediate transfer body, this powder layer causes the ink to swell, rise in viscosity and separate by reaction with the ink, and is then transferred to the recording medium. According to this method, it is possible to form an image that produces little bleeding on the recording medium.

However, Japanese Patent Application Publication No. 2004-010633 uses an indirect printing method, which first forms an image (ink aggregate body) on the intermediate transfer body and then transfers this image to a recording medium, and therefore has a problem in that a greater number of steps are involved compared to a direct printing method, which forms an image directly onto a recording medium, and a problem in that the apparatus becomes correspondingly more complicated. Consequently, a method which is compatible with a direct printing method is required, and a method using special inks has been proposed as one example of such a method. For example, Japanese Patent Application Publication No. 11-188858 discloses an image forming method using an ink set including an aqueous ink containing pigment, water-soluble solvent and water, and a liquid composition that causes the aqueous ink to aggregate, wherein by making one of the aqueous ink and the liquid composition alkaline and the other acidic, it is possible to achieve excellent recording in terms of optical density, bleeding and color bleeding.

Japanese Patent Application Publication No. 2000-037942 discloses technology for improving optical density, bleeding, color mixing and drying duration, by controlling the aggregating properties of pigment on a recording medium through making one of a liquid composition (treatment liquid) and ink acidic and making the other alkaline.

Japanese Patent Application Publication No. 2007-161753 discloses an image forming method using an ink set including a colorless ink and colored ink, in which the total weight of water-soluble organic solvent contained in the ink is not smaller than 50 wt % and not larger than 90 wt % of the total weight of the ink, and furthermore 30 wt % of the high-boiling-point solvent has an SP value not less than 16.5 and not more than 24.6. According to this method, it is possible to reduce print-through and curl, as well as improving wear ability and ejection stability.

Japanese Patent Application Publication No. 2007-175922 discloses an image forming method using an ink set which includes a pigment, a water-soluble organic solvent and water, the water-soluble organic solvent having an SP value of not lower than 16.5 and lower than 24.6 accounting for 30 wt % or more of the total weight of ink. According to this method, it is possible to prevent curling and cockling when printing in a single pass.

However, even if the inks in the related art are used, it is not possible to sufficiently satisfy all of the conditions of improving image quality, suppressing curl and improving image strength. For example, if the inks in the related art are deposited on a recording medium in an inkjet recording apparatus using a direct printing method, then there are problems in that curl is liable to occur if the deposition volume per unit time is raised, and image strength declines if a normal paper is used as the recording medium.

In view of these circumstances, there is demand for an image forming method using a direct printing system of forming images by applying a aqueous ink directly onto a recording medium by means of an inkjet recording apparatus, which satisfies the conditions of producing little landing interference or image contraction, having good text reproducibility and making curl not liable to occur. In particular, in an office printer, general papers such as art paper or copy paper, or the like are commonly used as recording media, in addition to special papers such as coated papers, and therefore it is necessary to satisfy all of the conditions described above, regardless of the type of recording medium.

SUMMARY OF THE INVENTION

The present invention has been contrived in view of the circumstances described above, an object thereof being to provide an inkjet recording method and an inkjet recording apparatus whereby all of the conditions of improving image quality, suppressing curl and improving image strength are satisfied in a direct printing system which forms an image directly on a recording medium.

In order to attain the aforementioned object, the present invention is directed to an inkjet recording method, comprising: a treatment liquid depositing step of applying treatment liquid onto a recording medium while holding the recording medium on a circumferential surface of a treatment liquid drum and conveying the recording medium by rotating the treatment liquid drum, and drying at least a portion of a solvent in the treatment liquid; an image forming step of ejecting ink from a line type inkjet head to deposit the ink onto the recording medium on which the treatment liquid has been deposited, while holding the recording medium on a circumferential surface of an image formation drum and conveying the recording medium by rotating the image formation drum, the ink containing at least a resin dispersant (A), a pigment (B) that is dispersed by the resin dispersant (A), self-dispersible polymer micro-particles (C) and an aqueous liquid medium (D), the ink having one of a solid component that is aggregated upon making contact with the treatment liquid and a solid component that is precipitated upon making contact with the treatment liquid; and a drying step of drying a solvent in the ink having been deposited on the recording medium while holding the recording medium on a circumferential surface of a drying drum and conveying the recording medium by rotating the drying drum.

According to this aspect of the present invention, since the image forming step and the drying step are carried out on separate drums, then there is no mutual interference between the processing of the image forming step and the processing of the drying step. Consequently, the heat created in the drying step does not have adverse affects on the image forming drum, and therefore it is possible to carry out drying at high speed by raising the amount of heat used in the drying step. If high-speed drying is carried out in the drying step, then it is possible to suppress the occurrence of curl, and furthermore, it is possible to prevent image non-uniformities caused by flowing movement of the coloring material and to avoid ink bleeding and color mixing caused by the deposition of a plurality of inks.

Moreover, since combined use is made of resin dispersant for dispersing the pigment and self-dispersible polymer micro-particles, then the ink ejection stability and the wearability are good, dispersion stability is improved, and an image of high quality can be formed on the recording medium.

Furthermore, since the treatment liquid is applied to the recording medium and causes the ink to aggregate or precipitate by making contact with the treatment liquid, then it is possible to obtain the beneficial effects described above, regardless of the type of recording medium.

Preferably, in the drying step, a residual amount of water introduced by the ink on the recording medium is made less than 5 $g/m^2$.

According to this aspect of the present invention, by carrying out high-speed drying, it is possible to suppress the occurrence of curling effectively, while also improving image quality. Desirably, the residual amount of water is less than 5 $g/m^2$, and more desirably, 2 to 3 $g/m^2$.

Preferably, a ratio of the self-dispersible polymer micro-particles (C) to the pigment (B) is at least 1.0.

By using the ink having this composition, it is possible to improve the landing interference and the text reproducibility, as well as improving the image strength.

Preferably, the method further comprises a fixing step of fixing the ink having been dried in the drying step onto the recording medium by applying heat and pressure to the recording medium, while holding the recording medium on a circumferential surface of a fixing drum and conveying the recording medium by rotating the fixing drum.

According to this aspect of the present invention, since the fixing step is carried out on the fixing drum which is independent of the other steps, then it is possible to set the temperature of the fixing step freely, and it is possible to carry out processing under suitable fixing conditions in accordance with the type of ink and the type of recording medium, and so on.

Preferably, the method further comprises, at least one of between the treatment liquid deposition step and the image forming step and between the image forming step and the drying step, an intermediate conveyance step of receiving and transferring the recording medium, while holding a leading end of the recording medium on a circumferential surface of an intermediate conveyance drum and conveying the recording medium by rotating the intermediate conveyance drum in such a manner that a recording surface of the recording medium does not make contact with the circumferential surface of the intermediate conveyance drum while guiding a non-recording surface of the recording medium by means of a conveyance guide disposed following the circumferential surface of the intermediate conveyance drum.

According to this aspect of the present invention, since the recording surface of the recording medium is conveyed in a non-contact fashion, then it is possible to avoid image defects caused by contact with the recording surface. By this means, it is possible to achieve even better image quality. Moreover, by guiding the non-recording surface of the recording medium by means of the conveyance guide, it is possible to apply a back tension to the recording medium (a tension in the opposite direction to the direction of conveyance), and therefore floating up of the recording medium, and the like, is prevented and good image quality can be achieved.

Preferably, in the image forming step, the line type inkjet head has a head width of not shorter than 50 cm, and nozzles arranged at a nozzle density of not lower than 1000 dpi in a sub-scanning direction.

The present invention is particularly valuable in a high-definition single-pass inkjet image forming method which uses the inkjet head of this kind.

Preferably, the resin dispersant (A) in the aqueous ink has a hydrophobic structural unit (a) and a hydrophilic structural unit (b); the hydrophobic structural unit (a) includes at least 40 wt % of a hydrophobic structural unit (a1) having an aromatic ring which is not directly bonded to atoms forming a main chain of the resin (A), and at least 15 wt % of a hydrophobic structural unit (a2) derived from an alkyl ester of one of acrylic acid and methacrylic acid having 1 to 4 carbon atoms; and the hydrophilic structural unit (b) includes a structural unit (b1) derived from at least one of acrylic acid and methacrylic acid, and a ratio of the hydrophilic structural unit (b) is not higher than 15 wt %.

According to this aspect of the present invention, a desirable mode of the resin dispersant (A) in the aqueous ink is specified, and by using the aqueous ink of this kind, it is possible to achieve higher image quality.

The composition of the hydrophilic structural unit (b) and the hydrophobic structural unit (a) depends on the degrees of hydrophilic and hydrophobic properties of them, and desirably the hydrophobic structural unit (a) is contained at a rate exceeding 80 wt %, and more desirably, 85 wt % or more, with respect to the total weight of the resin (A). In other words, the content of the hydrophilic structural unit (b) must be equal to or lower than 15 wt %, and if the content of the hydrophilic structural unit (b) is greater than 15 wt %, then the component that does not contribute to the dispersion of pigment but simply dissolves in the aqueous liquid medium (D) becomes greater, the properties, such as dispersion of the pigment (B), become worse, and this causes the ejection properties of the inkjet recording ink to deteriorate.

Preferably, an aromatic ring which is not directly bonded to atoms forming a main chain of the resin dispersant (A) in the aqueous ink is present in a ratio of not lower than 15 wt % and not higher than 27 wt % in the resin dispersant (A).

According to this aspect of the present invention, a desirable mode of the resin dispersant (A) in the aqueous ink is specified, whereby the dispersion stability, ejection stability, cleaning properties and wear resistance of the pigment in the aqueous ink can be improved.

Preferably, the self-dispersible polymer micro-particles (C) in the aqueous ink contain a structural unit derived from an aromatic group-containing (meth)acrylate monomer, a content ratio thereof being 10 wt % to 95 wt %.

According to this aspect of the present invention, a desirable mode of the self-dispersible polymer micro-particles in the aqueous ink is specified, and by using the aqueous ink of this kind, it is possible to achieve higher image quality.

Preferably, the self-dispersible polymer micro-particles (C) in the aqueous ink contain a first polymer having a carboxyl group and an acid number of 25 to 100.

According to this aspect of the present invention, a desirable specific mode of the self-dispersible polymer micro-particles in the aqueous ink is specified, and by using the aqueous ink of this kind, it is possible to achieve higher image quality.

Preferably, the first polymer is prepared in an organic solvent and as a polymer dispersion with water as a continuous phase, by neutralizing at least a portion of the carboxyl group in the first polymer.

According to this aspect of the present invention, a desirable mode of the first polymer which constitutes the self-dispersible polymer micro-particles is specified, and by using the aqueous ink of this kind, it is possible to achieve higher image quality.

In order to attain the aforementioned object, the present invention is also directed to an inkjet recording apparatus, comprising: a treatment liquid drum which holds a recording medium on a circumferential surface thereof and conveys the recording medium by rotating; a treatment liquid application unit which is disposed opposite the circumferential surface of the treatment liquid drum and applies treatment liquid onto the recording medium that is held and conveyed by the treatment liquid drum; a treatment liquid drying unit which is disposed opposite the circumferential surface of the treatment liquid drum and dries at least a portion of a solvent in the treatment liquid applied by the treatment liquid application unit; an image formation drum which holds, on a circumferential surface thereof, the recording medium on which the treatment liquid has been deposited and dried, and conveys the recording medium by rotating; a line type inkjet head which is disposed opposite the circumferential surface of the image formation drum and ejects ink to deposit the ink onto the recording medium that is held and conveyed by the image formation drum, the ink containing at least a resin dispersant (A), a pigment (B) that is dispersed by the resin dispersant (A), self-dispersible polymer micro-particles (C) and an aqueous liquid medium (D), the ink having one of a solid component that is aggregated upon making contact with the treatment liquid and a solid component that is precipitated upon making contact with the treatment liquid; a drying drum which holds, on a circumferential surface thereof, the recording medium on which the ink has been deposited, and conveys the recording medium by rotating; and a drying unit which is disposed opposite the circumferential surface of the drying drum and dries a solvent in the ink having been deposited on the recording medium that is held and conveyed by the drying drum.

Furthermore, in addition to the above-described preferable aspects, in the present invention, it is desirable also to adopt the following aspects in respect of the inkjet recording apparatus and the ink, with a view to improving image quality and suppressing curl.

<Inkjet Recording Apparatus>

It is preferable that the conveyance guide arranged in the intermediate conveyance unit of the inkjet recording apparatus includes a negative pressure application device which applies a negative pressure to the non-recording surface of the recording medium. According to this aspect, it is possible to promote the permeation into the recording surface of the recording medium of the solvent in the aqueous ink (including high-boiling-point solvent having a boiling point of 100° C. or higher).

Moreover, by providing the negative pressure application device, when conveying the recording medium in tight contact on the circumference of the drum, the rotational movement of the recording medium is guided while applying a force to the recording medium in the opposite direction to the direction of rotation and therefore it is possible to prevent the occurrence of wrinkling or floating up of the recording medium on the circumference of the drum.

It is preferable that a negative pressure control device is provided to control the negative pressure applied by the negative pressure application device. According to this aspect, by controlling the negative pressure when conveying the recording medium in tight contact on the circumference of the drum, it is possible to guide the rotational movement of the recording medium while applying the negative pressure to the non-recording surface more reliably by means of the negative pressure application device. Furthermore, it is possible to control the negative pressure applied and to promote the permeation of the solvent of the aqueous ink into the recording surface of the recording medium, more efficiently.

It is preferable that the negative pressure control device controls the negative pressure in accordance with the type of recording medium. According to this aspect, it is possible to respond to a diversity of recording media.

It is preferable that the negative pressure control device controls the negative pressure in accordance with at least one of the thickness of the recording medium and the porosity of the recording medium. By adopting this aspect, it is possible to respond to a diversity of recording media.

It is preferable that the intermediate transfer body in the intermediate conveyance unit includes a positive pressure application device which applies a positive pressure to the recording surface of the recording medium. According to this aspect, when the recording medium is conveyed in tight contact on the circumference of the drum (which is at least one of the drums of the image formation unit, the drying unit and the fixing unit, the same applies below), then the rotational movement of the recording medium is guided while applying the positive pressure to the recording surface by means of the positive pressure application device. Accordingly, it is possible to prevent the occurrence of wrinkling and floating up of the recording medium on the circumference of the drum, and therefore the quality of the image formed on the recording surface of the recording medium is improved. Furthermore, by applying the positive pressure, it is possible to promote the permeation into the recording surface of the recording medium of the solvent of the aqueous ink.

It is preferable that a positive pressure control device is provided to control the positive pressure applied by the positive pressure application device. By adopting this aspect, it is possible to move the recording medium in rotation along the conveyance guide by means of the positive pressure, in a more reliable fashion. Furthermore, it is possible to control the positive pressure applied and to promote the permeation of the solvent of the aqueous ink into the recording surface of the recording medium, more efficiently.

It is preferable that the positive pressure control device controls the positive pressure in accordance with the type of recording medium. By adopting this aspect, it is possible to respond to a diversity of recording media. Furthermore, the positive pressure control device desirably controls the positive pressure in accordance with at least one of the thickness of the recording medium and the porosity of the recording medium. By adopting this aspect, it is possible to respond to a diversity of recording media.

It is preferable that the positive pressure application device includes a positive pressure restricting device which restricts the positive pressure applied to the recording surface of the recording medium. By adopting this aspect, it is possible to move the recording medium in rotation along the conveyance guide by means of the positive pressure, in a more reliable fashion. Moreover, it is also possible to promote the permeation of the solvent of the aqueous ink into the recording surface of the recording medium, more reliably.

It is preferable that the positive pressure application device includes an air blowing aperture which blows an air flow onto the recording surface of the recording medium. According to this aspect, it is possible to promote the permeation of the solvent of the aqueous ink into the recording surface of the recording medium by blowing an air flow from the air blowing aperture.

It is preferable that the positive pressure control device controls at least one of the temperature and the flow rate of the air flow blown from the air blowing aperture in accordance with the amount of solvent that has been deposited on the recording surface of the recording medium. According to this aspect, it is possible to promote the permeation of the solvent into the recording medium by reducing the viscosity of the solvent.

It is preferable that an attracting device is arranged which causes the recording medium to make tight contact with the circumferential surface of the drum. According to this aspect, it is possible to prevent the occurrence of wrinkling and floating of the recording medium on the circumferential surface of the drum, in a more reliable fashion.

It is preferable that the attracting device includes a suction device which holds the recording medium onto the circumferential surface of the drum by suction. According to this aspect, the recording medium is held to make tight contact with the circumferential surface of the drum by suction, and hence it is possible to prevent the occurrence of wrinkling and floating of the recording medium in a more reliable fashion.

<Ink>

It is preferable that the acid value of the resin dispersant (A) is not lower than 30 mg KOH/g and not higher than 100 mg KOH/g. By this means, it is possible to improve the pigment dispersibility and storage stability of the aqueous ink.

It is preferable that the hydrophobic structural unit (a1) having the aromatic ring that is not directly bonded to the atoms forming the main chain of the resin dispersant (A) is a structural unit derived from at least one of benzyl methacrylate, phenoxyethyl acrylate and phenoxyethyl methacrylate.

It is preferable that the hydrophobic structural unit (a1) having the aromatic ring that is not directly bonded to the atoms forming the main chain of the resin dispersant (A) is a structural unit derived from phenoxyethyl acrylate or phenoxyethyl methacrylate.

It is preferable that the self-dispersible polymer microparticles (C) are a copolymer including a structural unit derived from a monomer containing an aromatic ring.

It is preferable that the pigment (B) is manufactured by a phase inversion method so as to be covered with the resin dispersant (A).

It is preferable that the weight ratio of the pigment (B) and the resin dispersant (A) is 100:25 to 100:140.

It is preferable that the weight-average molecular weight of the resin dispersant (A) is 30000 to 150000. By setting the molecular weight to the range stated above, the steric repulsion effect of the dispersant tends to be good, which is desirable from the viewpoint of the tendency to prevent adhesion to the pigment by means of a steric effect.

It is preferable that the ink includes at least one type of water-soluble organic solvent.

It is preferable that the ink includes a surfactant.

It is preferable that the (meth)acrylate monomer containing the aromatic group in the ink is phenoxyethyl acrylate.

It is preferable that the acid value of the first polymer which constitutes the self-dispersible polymer micro-particles in the ink is smaller than the acid value of the resin dispersant (A).

According to the inkjet recording method and the inkjet recording apparatus of the present invention, it is possible to improve image quality, suppress curl and improve image strength in the direct printing system which forms the image directly on the recording medium

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 15 is a table showing the experimental conditions and results in Experiment A;

FIG. 16 is a table showing the experimental conditions and results in Experiment B; and FIG. 17 is a table showing the experimental conditions and results in Experiment C.

DETAILED DESCRIPTION OF THE PREFERRED EMBODIMENTS

According to embodiments of the present invention, it is possible to form an image on any recording medium by using an inkjet recording apparatus and aqueous inks as described below.

General Composition of Inkjet Recording Apparatus

Firstly, the overall composition of an inkjet recording apparatus according to an embodiment of the present invention will be described.

Figure 1:
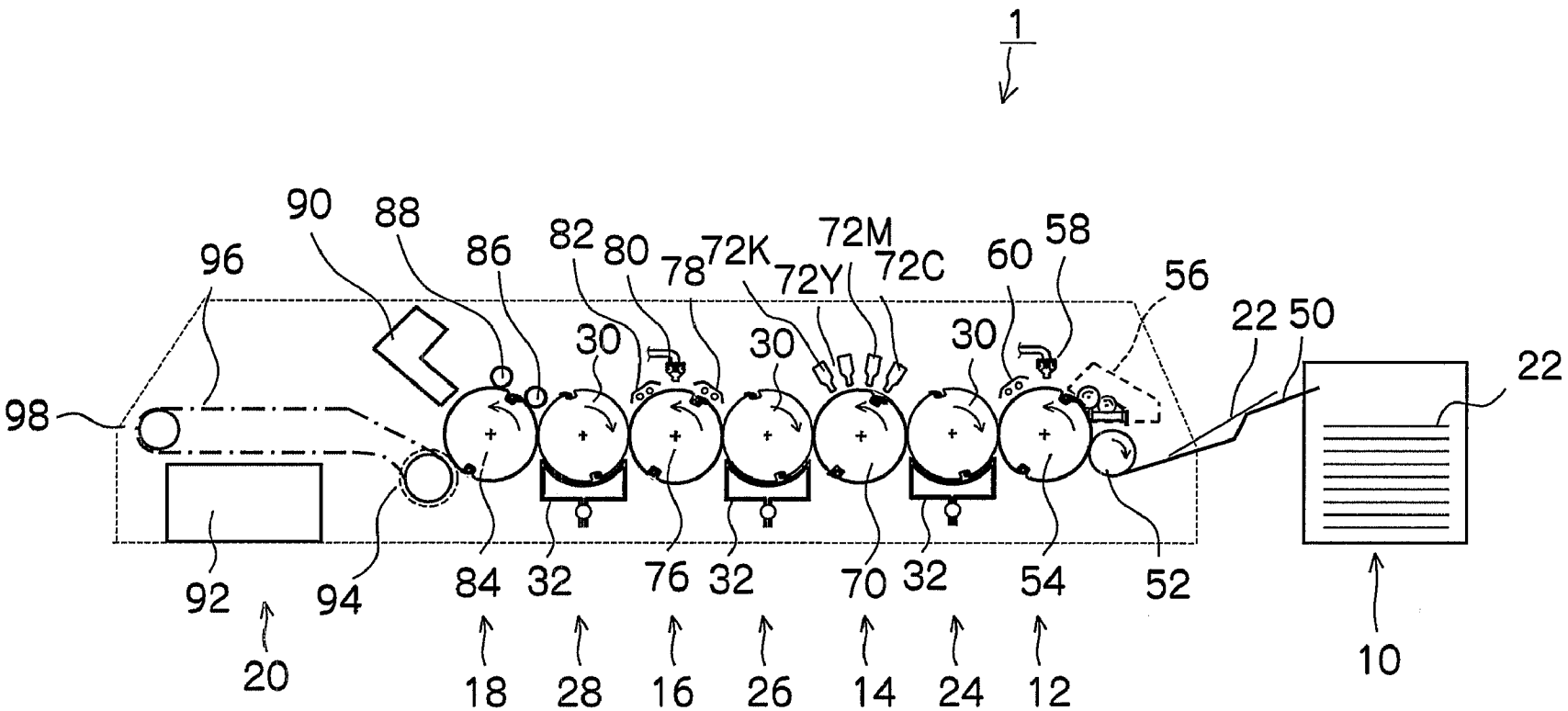
FIG. 1 is a schematic structural diagram illustrating an inkjet printing apparatus according to an embodiment of the present invention.

FIG. 1 is a structural diagram illustrating the entire configuration of an inkjet recording apparatus 1 of the present embodiment. The inkjet recording apparatus 1 shown in the drawing forms an image on a recording surface of a recording medium 22. The inkjet recording apparatus 1 includes a paper feed unit 10, a treatment liquid application unit 12, an image formation unit 14, a drying unit 16, a fixing unit 18, and a discharge unit 20 as the main components. A recording medium 22 (paper sheets) is stacked in the paper feed unit 10, and the recording medium 22 is fed from the paper feed unit 10 to the treatment liquid application unit 12. A treatment liquid is applied to the recording surface in the treatment liquid application unit 12, and then a color ink is applied to the recording surface in the image formation unit 14. The image is fixed with the fixing unit 18 on the recording medium 22 onto which the ink has been applied, and then the recording medium is discharged with the discharge unit 20.

In the inkjet recording apparatus 1, intermediate conveyance units 24, 26, 28 are provided between the units, and the recording medium 22 is transferred by these intermediate conveyance units 24, 26, 28. Thus, a first intermediate conveyance unit 24 is provided between the treatment liquid application unit 12 and image formation unit 14, and the recording medium 22 is transferred from the treatment liquid application unit 12 to the image formation unit 14 by the first intermediate conveyance unit 24. Likewise, the second intermediate conveyance unit 26 is provided between the image formation unit 14 and the drying unit 16, and the recording medium 22 is transferred from the image formation unit 14 to the drying unit 16 by the second intermediate conveyance unit 26. Further, a third intermediate conveyance unit 28 is provided between the drying unit 16 and the fixing unit 18, and the recording medium 22 is transferred from the drying unit 16 to the fixing unit 18 by the third intermediate conveyance unit 28.

Each unit (paper feed unit 10, treatment liquid application unit 12, image formation unit 14, drying unit 16, fixing unit 18, discharge unit 20, and first to third intermediate conveyance units 24, 26, 28) of the inkjet recording apparatus 1 will be described below in greater details.

<Paper Feed Unit>

The paper feed unit 10 is a mechanism that feeds the recording medium 22 to the image formation unit 14. A paper feed tray 50 is provided in the paper feed unit 10, and the recording medium 22 is fed, sheet by sheet, from the paper feed tray 50 to the treatment liquid application unit 12.

<Treatment Liquid Application Unit>

The treatment liquid application unit 12 is a mechanism that applies a treatment liquid to the recording surface of the recording medium 22. The treatment liquid includes a coloring material aggregating agent that causes the aggregation or precipitation of a coloring material (pigment) included in the ink applied in the image formation unit 14, and the separation of the coloring material and a solvent in the ink is enhanced when the treatment liquid is brought into contact with the ink.

It is preferred that a non-curling solvent be added to the treatment liquid. Specific examples of non-curling agents include alcohols (for example, isopropanol, butanol, isobutanol, sec-butanol, t-butanol, pentanol, hexanol, cyclohexanol, and benzyl alcohol), polyhydric alcohols (for example, ethylene glycol, diethylene glycol, triethylene glycol, polyethylene glycol, propylene glycol, dipropylene glycol, polypropylene glycol, butylene glycol, hexane diol, pentane diol, hexane triol, and thiodiglycol), glycol derivatives (for example, ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, ethylene glycol diacetate, ethylene glycol monomethyl ether acetate, triethylene glycol monomethyl ether, triethylene glycol monoethyl ether, and ethylene glycol monophenyl ether), amines (for example ethanolamine, diethanolamine, triethanolamine, N-methyldiethanolamine, N-ethyldiethanolamine, morpholine, N-ethylmorpholine, ethylenediamine, diethylenetriamine, triethylenetetramine, polyethyleneimine, and tetramethylpropylenediamine), and other polar solvents (for example, formamide, N,N-dimethylformamide, N,N-dimethylacetamide, dimethylsulfoxide, sulfolan, 2-pyrrolidone, N-methyl-2-pyrrolidone, N-vinyl-2-pyrrolidone, 2-oxazolidone, 1,3-dimethyl-2-imidazolidinone, acetonitrile, and acetone).

The above-described organic solvents may be used individually or in combinations of two or more thereof. It is preferred that these organic solvents be included in the treatment liquid at a content ratio of 1 wt % to 50 wt %.

As shown in FIG. 1, the treatment liquid application unit 12 includes a transfer drum 52, a treatment liquid drum 54, a treatment liquid application device 56, a warm-air blow-out nozzle 58, and an IR (infrared) heater 60. The transfer drum 52 is disposed between the paper feed tray 50 of the paper feed unit 10 and the treatment liquid drum 54. The rotation of the transfer drum is driven and controlled by a below-described motor driver 142 (see FIG. 13). The recording medium 22 fed from the paper feed unit 10 is received by the transfer drum 52 and transferred to the treatment liquid drum 54. The below-described intermediate conveyance unit may be also provided instead of the transfer drum 52.

The treatment liquid drum 54 is a drum that holds and rotationally conveys the recording medium 22. The rotation of the treatment liquid drum is driven and controlled by the below-described motor driver 142 (see FIG. 13). Further, the treatment liquid drum 54 is provided on the outer peripheral surface thereof with a hook-shaped holding device (device identical to a below-described holding device 73 shown in FIG. 4). The leading end of the recording medium 22 is held by the holding device. In a state in which the leading end of the recording medium 22 is held by the holding device, the treatment liquid drum 54 is rotated to convey rotationally the recording medium. In this case, the recording medium 22 is conveyed so that the recording surface thereof faces outside. The treatment liquid drum 54 may be provided with suction holes on the outer peripheral surface thereof and connected to a suction device that performs suction from the suction holes. As a result, the recording medium 22 can be tightly held on the circumferential surface of the treatment liquid drum 54.

The treatment liquid application device 56, the warm-air blow-out nozzle 58, and the IR heater 60 are provided on the outside of the treatment liquid drum 54 opposite the circumferential surface thereof. The treatment liquid application device 56, warm-air blow-out nozzle 58, and IR heater 60 are installed in the order of description from the upstream side in the rotation direction (counterclockwise direction in FIG. 1) of the treatment liquid drum 54. First, the treatment liquid is applied on the recording surface of the recording medium 22 by the treatment liquid application device 56.

Figure 2:
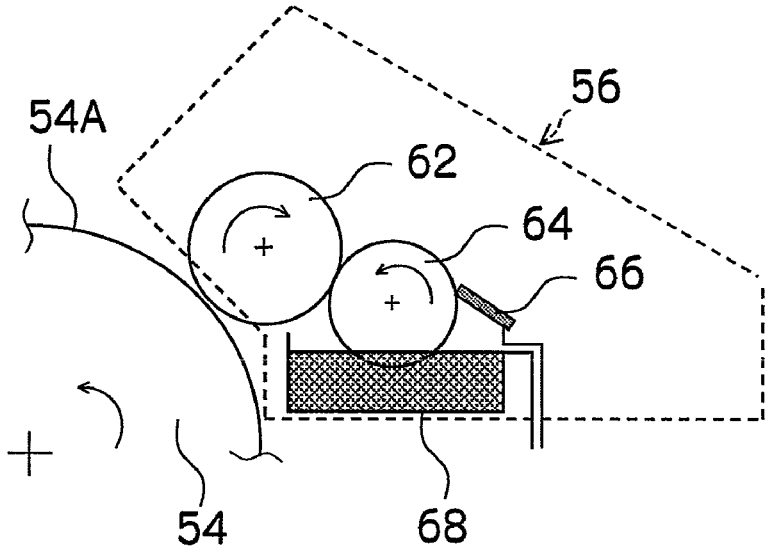
FIG. 2 is a structural diagram illustrating the treatment liquid application device of the treatment liquid application unit.

FIG. 2 is a configuration diagram of the treatment liquid application device 56. As shown in FIG. 2, the treatment liquid application device 56 is composed of a rubber roller 62, an anilox roller 64, a squeegee 66, and a treatment liquid container 68. The treatment liquid is stored in the treatment liquid container 68, and part of the anilox roller 64 is immersed in the treatment liquid. The squeegee 66 and rubber roller 62 are pressed against the anilox roller 64. The rubber roller 62 is brought into contact with the recording medium 22 that is held and rotationally conveyed by the treatment liquid drum 54, and the rubber roller is rotationally driven with a constant predetermined speed in the direction opposite (clockwise direction in the drawing) the rotation direction of the treatment liquid drum 54.

With the treatment liquid application device 56 of the above-described configuration, the treatment liquid is applied by the rubber roller 62 on the recording medium 22, while being metered by the anilox roller 64 and squeegee 66. In this case, it is preferred that the film thickness of the treatment liquid be sufficiently smaller than the diameter of ink droplets that are ejected from inkjet heads 72C, 72M, 72Y, 72K (see FIG. 1) of the image formation unit 14. For example, when the ink droplet volume is 2 picoliters (pl), the average diameter of the droplet is 15.6 μm. In this case, when the film thickness of the treatment liquid is large, the ink dot will be suspended in the treatment liquid, without coming into contact with the surface of the recording medium 22. Accordingly, when the ink droplet volume is 2 pl, it is preferred that the film thickness of the treatment liquid be not more than 3 μm in order to obtain a landing dot diameter not less than 30 μm.

Figure 3:
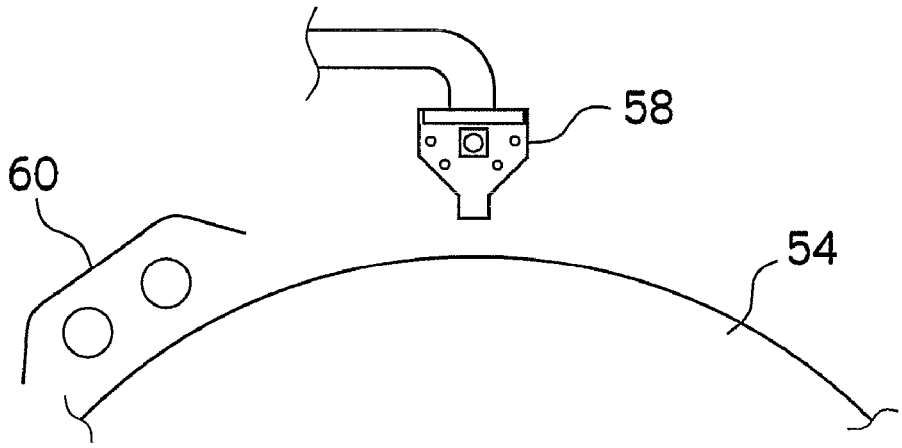
FIG. 3 is a structural diagram illustrating the drying device of the treatment liquid application unit.

The recording medium 22 that has been coated with the treatment liquid in the treatment liquid application device 56 is conveyed to the location of the warm-air blow-out nozzle 58 and IR heater 60 shown in FIG. 3. The warm-air blow-out nozzle 58 is configured to blow hot air at a high temperature (for example, 70° C.) at a constant blowing rate (for example, 9 $m^3$/min) toward the recording medium 22, and the IR heater 60 is controlled to a high temperature (for example, 180° C.). Water included in the solvent of the treatment liquid is evaporated by heating with these warm-air blow-out nozzle 58 and IR heater 60, and a thin layer of the treatment liquid is formed on the recording surface. Where the treatment liquid is formed into such a thin layer, the dots of ink deposited in the image formation unit 14 come into contact with the recording surface of the recording medium 22 and a necessary dot diameter is obtained. Moreover, the ink reacts with the components of the treatment liquid formed into the thin layer, coloring material aggregation occurs, and an action fixing the ink to the recording surface of the recording medium 22 is easily obtained. The treatment liquid drum 54 may be controlled to a predetermined temperature (for example, 50° C.).

<Image Formation Unit>

Figure 4:
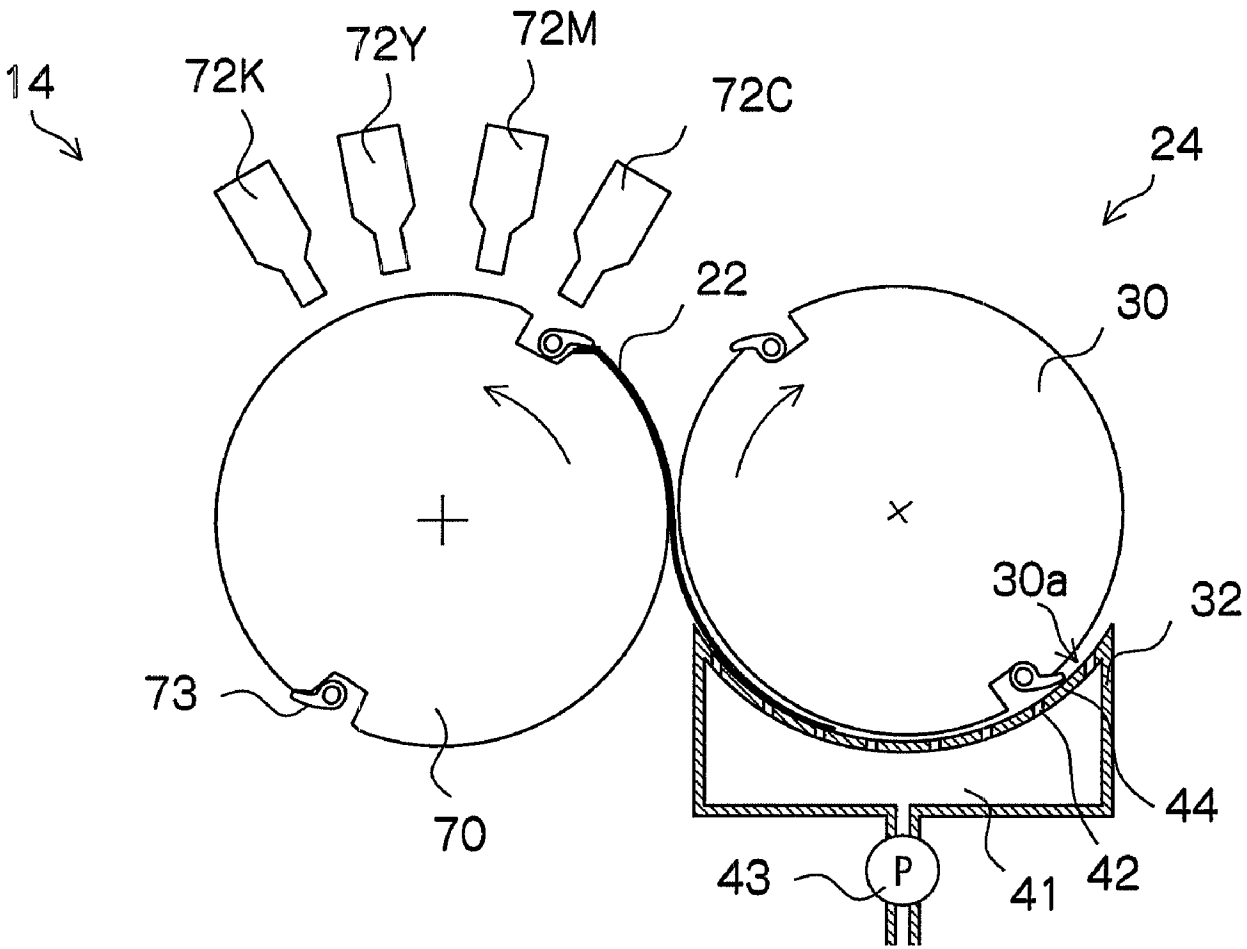
FIG. 4 is a structural diagram illustrating the image formation unit.
Figure 5:
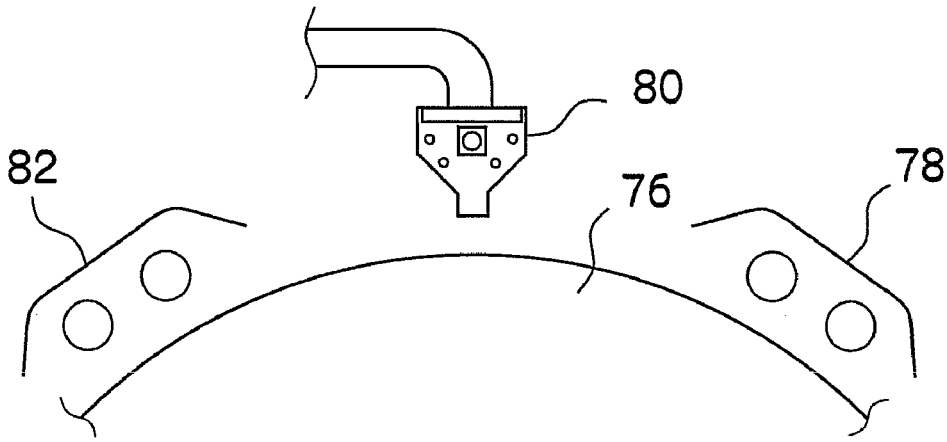
FIG. 5 is a structural diagram illustrating the drying unit.

As shown in FIG. 4, the image formation unit 14 is composed of an image formation drum 70 and inkjet heads 72C, 72M, 72Y, 72K that are proximally disposed in a position facing the outer peripheral surface of the image formation drum 70. The inkjet heads 72C, 72M, 72Y, 72K correspond to inks of four colors: cyan (C), magenta (M), yellow (Y), and black (K) and are disposed in the order of description from the upstream side in the rotation direction (counterclockwise direction in FIG. 4) of the image formation drum 70.

The image formation drum 70 is a drum that holds the recording medium 22 on the outer peripheral surface thereof and rotationally conveys the recording medium. The rotation of the image formation drum is driven and controlled by the below-described motor driver 142 (see FIG. 13). Further, the image formation drum 70 is provided on the outer peripheral surface thereof with a hook-shaped holding device 73, and the leading end of the recording medium 22 is held by the holding device 73. In a state in which the leading end of the recording medium 22 is held by the holding device 73, the image formation drum 70 is rotated to convey rotationally the recording medium. In this case, the recording medium 22 is conveyed so that the recording surface thereof faces outside. Inks are applied to the recording surface by the inkjet heads 72C, 72M, 72Y, 72K.

The inkjet heads 72C, 72M, 72Y, 72K are recording heads (inkjet heads) of an inkjet system of a full line type that have a length corresponding to the maximum width of the image formation region in the recording medium 22. A nozzle row is formed on the ink ejection surface of the inkjet head. The nozzle row has a plurality of nozzles arranged therein for discharging ink over the entire width of the image recording region. Each inkjet head 72C, 72M, 72Y, 72K is fixedly disposed so as to extend in the direction perpendicular to the conveyance direction (rotation direction of the image formation drum 70) of the recording medium 22.

Droplets of corresponding colored inks are ejected from the inkjet heads 72C, 72M, 72Y, 72K having the above-described configuration toward the recording surface of the recording medium 22 held on the outer peripheral surface of the image formation drum 70. As a result, the ink comes into contact with the treatment liquid that has been heretofore applied on the recording surface by the treatment liquid application unit 12, the coloring material (pigment) dispersed in the ink is aggregated, and a coloring material aggregate is formed. Therefore, the coloring material flow on the recording medium 22 is prevented and an image is formed on the recording surface of the recording medium 22. In this case, because the image formation drum 70 of the image formation unit 14 is structurally separated from the treatment liquid drum 54 of the treatment liquid application unit 12, the treatment liquid does not adhere to the inkjet heads 72C, 72M, 72Y, 72K, and the number of factors preventing the ejection of ink can be reduced.

The following reaction can be considered as the reaction of ink and treatment liquid. For example, by using a mechanism of breaking the pigment dispersion and causing aggregation by introducing an acid into the treatment liquid and decreasing pH, it is possible to avoid oozing of the coloring agent, color mixing among inks of different colors, and deposition interference caused by merging of ink droplets during landing.

The ejection timing of the inkjet heads 72C, 72M, 72Y, 72K is synchronized by an encoder 91 (see FIG. 13) that is disposed in the image formation drum 70 and detects the rotation speed. As a result, landing positions can be determined with high accuracy. Further, it is also possible to learn in advance the speed fluctuations caused, e.g., by oscillations of the image formation drum 70 and correct the ejection timing obtained with the encoder 91, exclude the effect of oscillations of the image formation drum 70, accuracy of the rotation shafts, and speed of the outer peripheral surface of the image formation drum 70, and reduce the unevenness of deposition.

Further, maintenance operations such as cleaning of the nozzle surface of the inkjet heads 72C, 72M, 72Y, 72K and ejection of thickened ink may be performed after the head units have been withdrawn from the image formation drum 70.

In the present example, a CMYK standard color (four color) configuration is described, but combinations of ink colors and numbers of colors are not limited to that of the present embodiment, and if necessary, light inks, dark inks, and special color inks may be added. For example, a configuration is possible in which an ink head is added that ejects a light ink such as light cyan and light magenta. The arrangement order of color heads is also not limited. The inkjet heads 72C, 72M, 72Y, 72K will be described below in greater detail.

<Drying Unit>

The drying unit 16 dries water included in the solvent separated by the coloring material aggregation action. As shown in FIG. 1, the drying unit includes a drying drum 76 and a first IR heater 78, a warm-air blow-out nozzle 80, and a second IR heater 82 disposed in positions facing the outer peripheral surface of the drying drum 76. The first IR heater 78 is provided upstream of the warm-air blow-out nozzle 80 in the rotation direction (counterclockwise direction in FIG. 1) of the drying drum 76, and the second IR heater 82 is provided downstream of the warm-air blow-out nozzle 80.

The drying drum 76 is a drum that holds the recording medium 22 on the outer peripheral surface thereof and rotationally conveys the recording medium. The rotation of the drying drum is driven and controlled by the below-described motor driver 142 (see FIG. 13). Further, the drying drum 76 is provided on the outer peripheral surface thereof with hook-shaped holding device (device identical to a below-described holding device 73 shown in FIG. 4). The leading end of the recording medium 22 is held by the holding device. In a state in which the leading end of the recording medium 22 is held by the holding device, the drying drum 76 is rotated to convey rotationally the recording medium. In this case, the recording medium 22 is conveyed so that the recording surface thereof faces outside. The drying treatment is carried out by the first IR heater 78, warm-air blow-out nozzle 80, and second IR heater 82 with respect to the recording surface of the recording medium.

The warm-air blow-out nozzle 80 is configured to blow hot air at a high temperature (for example, 50° C. to 70° C.) at a constant blowing rate (for example, 12 $m^3$/min) toward the recording medium 22, and the first IR heater 78 and second IR heater 82 are controlled to respective high temperature (for example, 180° C.). Water included in the ink solvent on the recording surface of the recording medium 22 held by the drying drum 76 is evaporated by heating with these first IR heater 78, warm-air blow-out nozzle 80, and second IR heater 82 and drying treatment is performed. In this case, because the drying drum 76 of the drying unit 16 is structurally separated from the image formation drum 70 of the image formation unit 14, the number of ink non-ejection events caused by drying of the head meniscus portion by thermal drying can be reduced in the inkjet heads 72C, 72M, 72Y, 72K. Further, there is a degree of freedom in setting the temperature of the drying unit 16, and the optimum drying temperature can be set.

The evaporated moisture may be released to the outside of the apparatus with a release device (not shown in the drawings). Further, the recovered air may be cooled with a cooler (radiator) or the like and recovered as a liquid.

The outer peripheral surface of the aforementioned drying drum 76 may be controlled to a predetermined temperature (for example, not higher than 60° C.).

The drying drum 76 may be provided with suction holes on the outer peripheral surface thereof and connected to a suction device which performs suction from the suction holes. As a result, the recording medium 22 can be tightly held on the circumferential surface of the drying drum 76.

<Fixing Unit>

Figure 6:
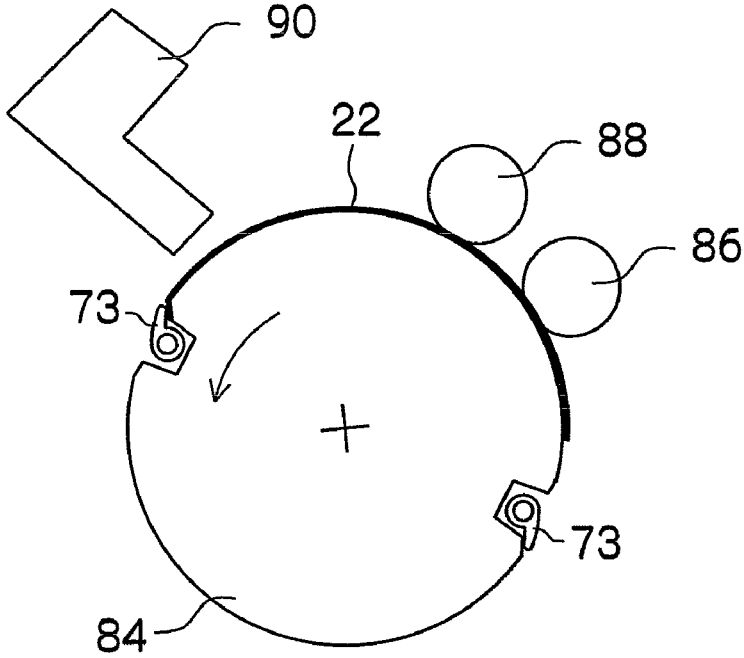
FIG. 6 is a structural diagram illustrating the fixing unit.

As shown in FIG. 6, the fixing unit 18 includes a fixing drum 84, a first fixing roller 86, a second fixing roller 88, and an inline sensor 90. The first fixing roller 86, second fixing roller 88, and inline sensor 90 are arranged in positions opposite the circumferential surface of the fixing drum 84 in the order of description from the upstream side in the rotation direction (counterclockwise direction in FIG. 6) of the fixing drum 84.

The fixing drum 84 holds the recording medium 22 on the outer peripheral surface thereof, rotates, and conveys the recording medium. The rotation of the fixing drum is driven and controlled by a motor driver 142 (see FIG. 13) described below. The fixing drum 84 has a hook-shaped holding device (device identical to the holding device 73 shown in FIG. 4), and the leading end of the recording medium 22 can be held by this holding device. The recording medium 22 is rotated and conveyed by rotating the fixing drum 84 in a state in which the leading end of the recording medium is held by the holding device. In this case, the recording medium 22 is conveyed so that the recording surface thereof faces outside, and the fixing treatment by the first fixing roller 86 and second fixing roller 88 and the inspection by the inline sensor 90 are performed with respect to the recording surface.

The first fixing roller 86 and second fixing roller 88 are roller members serving to fix the image formed on the recording medium 22 and they are configured to apply a pressure and heat the recording medium 22. Thus, the first fixing roller 86 and second fixing roller 88 are arranged so as to be pressed against the fixing drum 84, and a nip roller is configured between them and the fixing drum 84. As a result, the recording medium 22 is squeezed between the first fixing roller 86 and the fixing drum 84 and between the second fixing roller 88 and the fixing drum 84, nipped under a predetermined nip pressure (for example, 1 MPa), and subjected to fixing treatment. An elastic layer may be formed on the surface of one from the first fixing roller 86, second fixing roller 88, and fixing drum 84 to obtain a configuration providing a uniform nip width with respect to the recording medium 22.

Further, the first fixing roller 86 and second fixing roller 88 are configured by heating rollers in which a halogen lamp is incorporated in a metal pipe, for example from aluminum, having good thermal conductivity and the rollers are controlled to a predetermined temperature (for example 60° C. to 80° C.). Where the recording medium 22 is heated with the heating roller, thermal energy not lower than a Tg temperature (glass transition temperature) of a latex included in the ink is applied and latex particles are melted. As a result, fixing is performed by penetration into the concavities-convexities of the recording medium 22, the concavities-convexities of the image surface are leveled out, and gloss is obtained.

In the above-described embodiment, heating and pressure application are used in combination, but only one of them may be performed. Further, depending on the thickness of image layer and Tg characteristic of latex particles, the first fixing roller 86 and second fixing roller 88 may have a configuration provided with a plurality of steps. Furthermore, the surface of the fixing drum 84 may be controlled to a predetermined temperature (for example 60° C.).

On the other hand, the inline sensor 90 is a measuring device which measures the check pattern, moisture amount, surface temperature, gloss, and the like of the image fixed to the recording medium 22. A CCD sensor or the like can be used for the inline sensor 90.

With the fixing unit 18 of the above-described configuration, the latex particles located within a thin image layer formed in the drying unit 16 are melted by pressure application and heating by the first fixing roller 86 and second fixing roller 88. Therefore, the latex particles can be reliably fixed to the recording medium 22. In addition, with the fixing unit 18, the fixing drum 84 is structurally separated from other drums.

Therefore, the temperature of the fixing unit 18 can be freely set separately from the image formation unit 14 and drying unit 16.

Further, the above-described fixing drum 84 may be provided with suction holes on the outer peripheral surface thereof and connected to a suction device which performs suction from the suction holes. As a result, the recording medium 22 can be tightly held on the circumferential surface of the fixing drum 84.

<Discharge Unit>

As shown in FIG. 1, the discharge unit 20 is provided after the fixing unit 18. The discharge unit 20 includes a discharge tray 92, and a transfer drum 94, a conveying belt 96, and a tension roller 98 are provided between the discharge tray 92 and the fixing drum 84 of the fixing unit 18 so as to face the discharge tray and the fixing drum. The recording medium 22 is fed by the transfer drum 94 onto the conveying belt 96 and discharged into the discharge tray 92.

<Intermediate Conveyance Unit>

The structure of the first intermediate conveyance unit 24 will be described below. A second intermediate conveyance unit 26 and a third intermediate conveyance unit 28 are configured identically to the first intermediate conveyance unit 24 and the explanation thereof will be omitted.

Figure 7A:
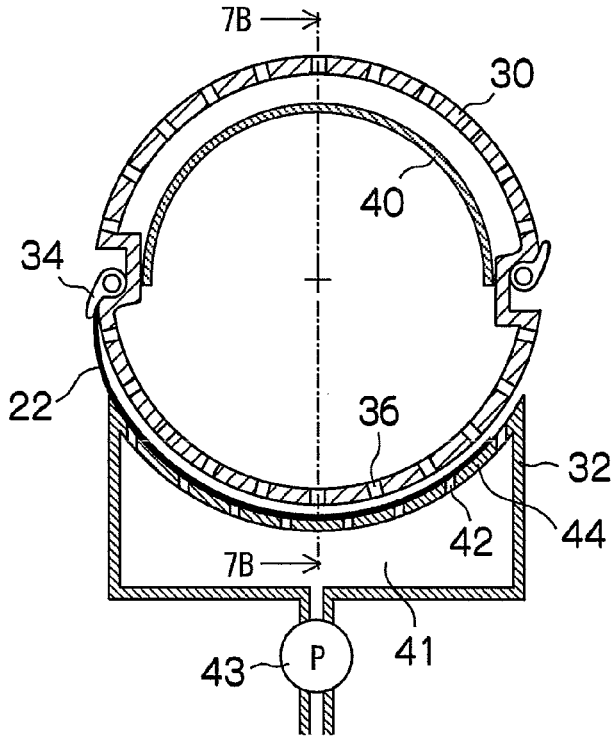
FIG. 7A is a cross-sectional view illustrating the configuration of a first intermediate conveyance unit.
Figure 7B:
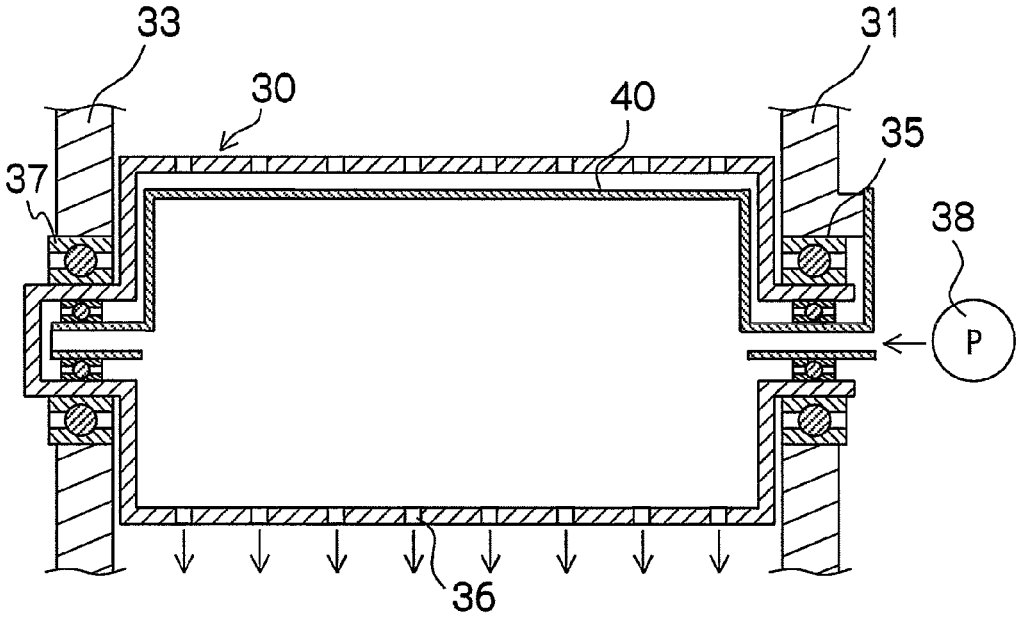
FIG. 7B is a cross-sectional view along line 7B-7B in FIG. 7A.

FIG. 7A is a cross-sectional view of the first intermediate conveyance unit 24. FIG. 7B is a cross-sectional view along line 7B-7B in FIG. 7A.

As shown in the drawings, the first intermediate conveyance unit 24 mainly includes an intermediate conveyance body 30 and a conveyance guide 32. The intermediate conveyance body 30 is a drum for receiving the recording medium 22 from a drum of a previous stage, rotationally conveying the recording medium, and transferring it to a drum of the subsequent stage. As shown in FIG. 7B, the intermediate conveyance body is rotationally mounted on frames 31, 33 via bearings 35, 37. The intermediate conveyance body 30 is rotated by a motor (not shown in the drawings), and the rotation thereof is driven and controlled by the below-described intermediate conveyance body rotation drive unit 141 (see FIG. 14).

Hook-shaped holding devices 34 (devices identical to the holding device 73 shown in FIG. 4) are provided with a 90° spacing on the outer peripheral surface of the intermediate conveyance body 30. The holding device 34 rotates, while describing a circular path, and the leading end of the recording medium 22 is held by the action of the holding device 34. Therefore, the recording medium 22 can be rotationally conveyed by rotating the intermediate conveyance body 30 in a state in which the leading end of the recording medium 22 is held by the holding device 34. In this case, the recording medium 22 is rotationally conveyed so that the recording surface thereof faces inward, whereas the non-recording surface faces outward. In the present embodiment, the intermediate conveyance body 30 is provided with two holding devices 34, but the number of the holding devices 34 is not limited to two.

A plurality of blower ports 36 are formed on the surface of the intermediate conveyance body 30. The inside of the intermediate conveyance body 30 is connected to a blower 38, and air is blown by the blower 38 onto the intermediate conveyance body 30. The air is preferably warm air. For example, warm air at 70° C. is blown at a blow rate of 1 $m^3$/min. As a result, warm air is blown from the blower ports 36 located on the surface of the intermediate conveyance body 30, the recording medium 22 is supported in a floating state, and a drying treatment of the recording surface is performed. As a result, the recording surface of the recording medium 22 is prevented from coming into contact with the intermediate conveyance body 30 and adhesion of the treatment liquid to the intermediate conveyance body 30 can be avoided.

A blow control guide 40 is provided inside the intermediate conveyance body 30 and acts so that the air is blown out only from the blower ports 36 on the side where the recording medium 22 is conveyed. Thus, in the present embodiment, because the recording medium 22 is conveyed by the lower half of the intermediate conveyance body 30 shown in FIG. 7A, the blower ports 36 of the upper half of the intermediate conveyance body 30 are sealed by the blow control guide 40. As a result, the recording medium 22 can be more reliably supported in a floating state by the air flow blown from the blower ports 36.

As shown in FIG. 7A, the conveying guide 32 has a circular-arc guide surface 44, and this guide surface 44 is disposed along the circumferential surface of the lower half of the intermediate conveyance body 30. Therefore, the recording medium 22 that is supported in a floating state by the intermediate conveyance body 30 is conveyed, while the surface (referred to hereinbelow as "non-recording surface") opposite to the recording surface is in contact with the guide surface 44. As a result, a tension (referred to hereinbelow as "back tension") in the direction opposite to the conveyance direction can be applied to the recording medium 22, and the occurrence of floating wrinkles in the recording medium 22 that is being conveyed can be prevented.

A plurality of suction holes 42 are provided equidistantly in the guide surface 44 of the conveying guide 32. The suction holes 42 communicate with an internal space (referred to hereinbelow as "chamber 41") of the conveying guide 32. This chamber 41 is connected to a pump 43. Therefore, by driving the pump 43, it is possible to create a negative pressure inside the chamber 41 and suck the air from the suction holes 42. As a result, the non-recording surface of the recording medium 22 that is supported in a floating state by the intermediate conveyance body 30 can be brought into intimate contact with the guide surface 44 and the back tension can be reliably applied to the recording medium 22. Further, by controlling the pump 43 with a below-described negative pressure control unit 147 and adjusting the air suction amount, it is possible to adjust the back tension. The negative pressure control unit 147 may control the suction force of the pump 43 correspondingly to specifications (for example, thickness, porosity, type, etc.) of the recording medium 22.

With the first intermediate conveyance unit 24 of the above-described configuration, when the recording medium 22 is conveyed by the intermediate conveyance body 30, the conveyance can be performed in a contactless state of the recording surface. Therefore, image defects caused by the contact of the recording surface can be avoided. Further, with the first intermediate conveyance unit 24, because the conveyance can be performed while the non-recording surface is in intimate contact with the conveying guide 32, a back tension can be applied to the recording medium 22 and the occurrence of defects such as floating wrinkles in the recording medium 22 can be prevented. In addition, with the first intermediate conveyance unit 24, because warm air is blown from the intermediate conveyance body 30, the recording surface can be dried, while the recording medium 22 is being conveyed.

The recording medium 22 conveyed by the first intermediate conveyance unit 24 is transferred to a drum of the subsequent stage (that is, the image formation drum 70). In this case, the transfer of the recording medium 22 is performed by synchronizing the holding device 34 of the intermediate conveyance unit 24 and the holding device 73 of the image formation unit 14. The transferred recording medium 22 is held by the image formation drum 70 and rotationally conveyed. In this case, the recording medium 22 immediately after the transfer is conveyed in a state in which the rear end side thereof is brought into intimate contact with the conveying guide 32. Therefore, the occurrence of defects such as floating wrinkles during the transfer can be prevented.

A back tension application device different from that of the above-described embodiment may be also provided. For example, the guide surface 44 may be subjected to surface treatment to increase the surface roughness thereof, or the guide surface 44 may be formed from a member with a high friction coefficient such as a rubber.

Figure 8:
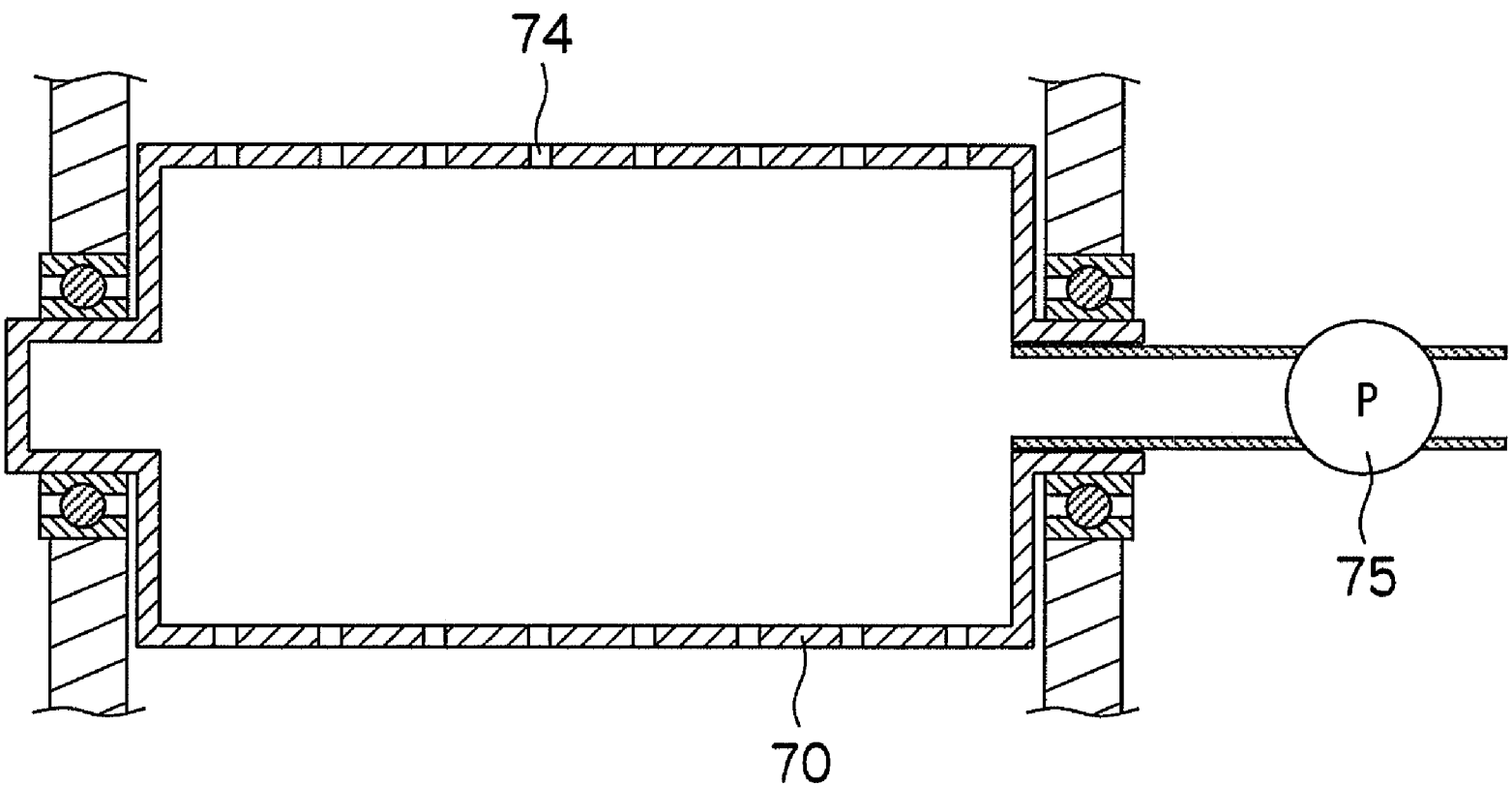
FIG. 8 is cross-sectional view illustrating the configuration of the image formation drum.

Suction of the recording medium 22 to the surface of the subsequent-stage drum also may be used as another back tension application device. For example, the image formation drum 70 shown in FIG. 8 has suction holes 74 formed in the outer peripheral surface thereof and is connected to a pump 75 to enable the suction of the recording medium 22 on the outer peripheral surface thereof. Therefore, when the recording medium 22 is transferred to the image formation drum 70, the conveyance can be performed in a state in which the distal end side of the recording medium 22 is suction attached to the image formation drum 70, whereas the rear end side of the recording medium 22 is suction attached to the conveying guide 32 of the first intermediate conveyance unit 24, thereby making it possible to apply a back tension to the recording medium 22. The distal end of the recording medium 22 may be also brought into intimate contact with the image formation drum 70 by electrostatic attraction.

<Structure of Ink Heads>

The structure of ink heads will be described below. Because inkjet heads 72C, 72M, 72Y, 72K have a common structure, an ink head representing them will be denoted below with a reference symbol 100.

Figure 9A:
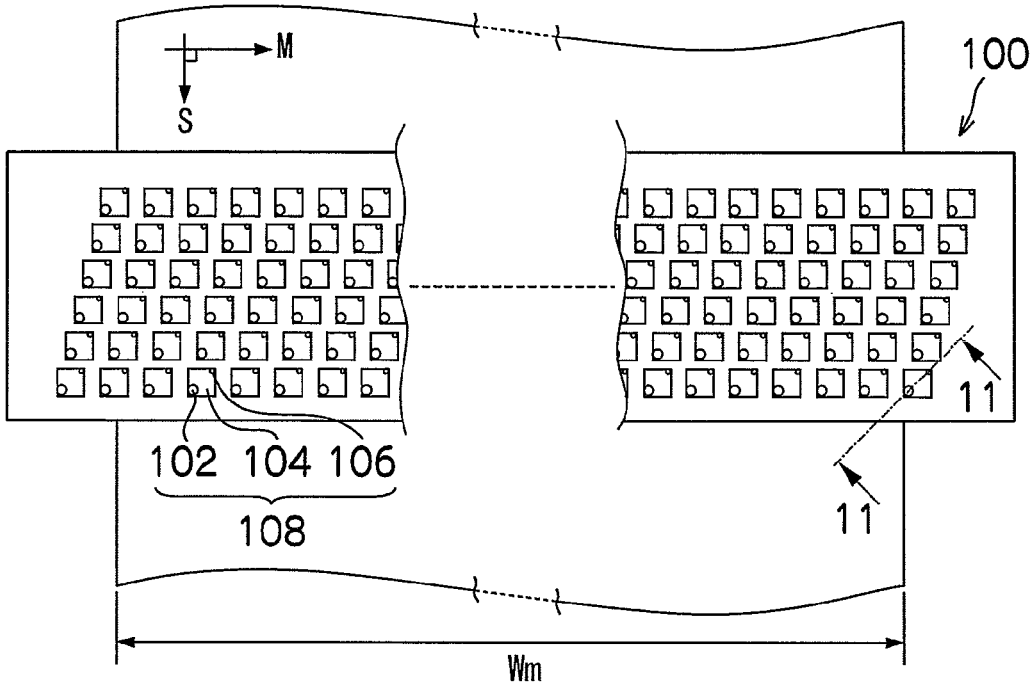
FIG. 9A is a plan perspective view of principal components illustrating the internal structure of a head.
Figure 9B:
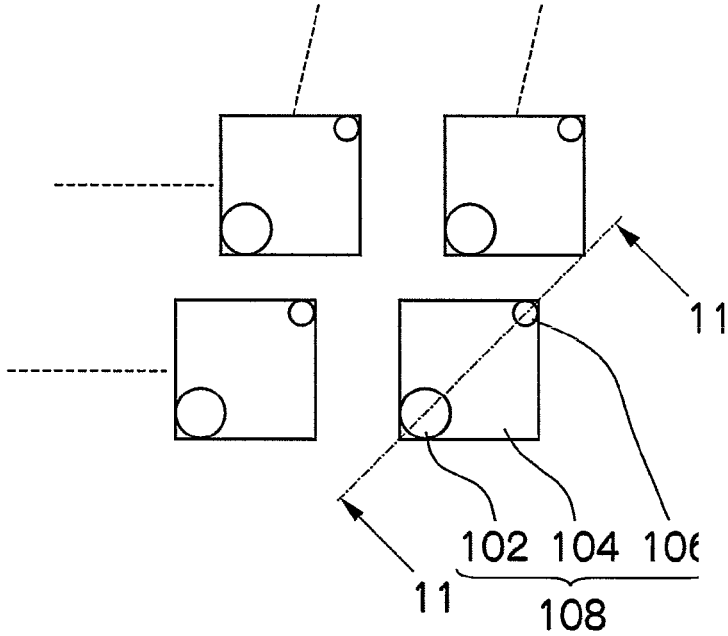
FIG. 9B is an enlarged view of part thereof.

FIG. 9A is a planar perspective view illustrating a structure of the ink head 100. FIG. 9B is an enlarged view of part thereof. A nozzle pitch density in the ink head 100 has to be increased in order to increase the pitch density of dots printed on the recording medium 22. As shown in FIGS. 9A and 9B, the ink head 100 of the present example has a structure in which a plurality of ink chamber units (liquid droplet ejection elements serving as recording element units) 108, each including a nozzle 102 serving as an ink ejection port and a pressure chamber 104 corresponding to the nozzle 102, are arranged in a zigzag manner as a matrix (two-dimensional configuration). As a result, it is possible to increase substantially the density of nozzle spacing (projected nozzle pitch) that is projected to ensure alignment along the longitudinal direction of the head (direction perpendicular to the conveyance direction of the recording medium 22).

Figure 10:
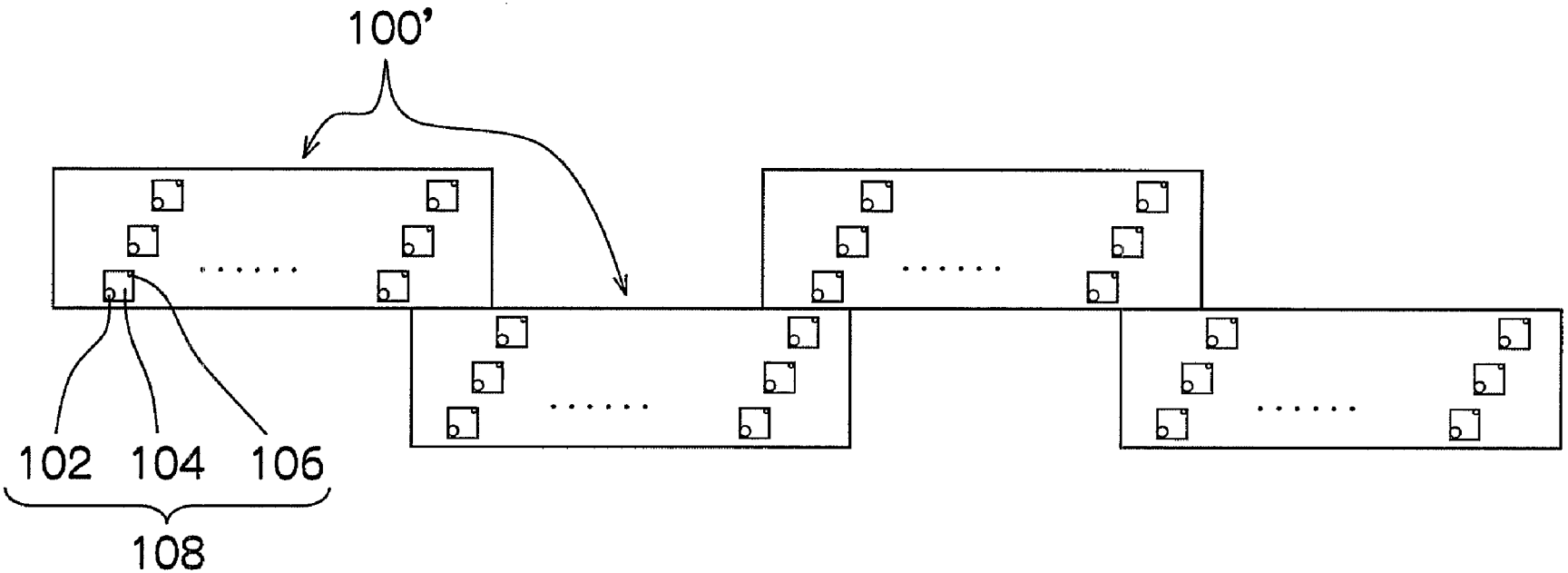
FIG. 10 is a plan view illustrating another configuration example of the head.

A mode of configuring at least one nozzle column along a length corresponding to the entire width of the image formation region of the recording medium 22 in the direction (arrow M in FIGS. 9A and 9B) that is almost perpendicular to the conveyance direction (arrow S in FIGS. 9A and 9B) of the recording medium 22 is not limited to the example shown in the drawing. For example, instead of the configuration shown in FIG. 9A, a line head that as a whole has a nozzle row of a length corresponding to the entire width of the image formation region of the recording medium 22 may be configured by arranging in a zigzag manner short head modules 100' in which a plurality of nozzles 102 are arranged two-dimensionally and enlarging the length by joining the modules together as shown in FIG. 10.

The pressure chamber 104 provided correspondingly to each nozzle 102 has an almost square shape in the plan view thereof (see FIGS. 9A and 9B), an outflow port to the nozzle 102 is provided in one of the two corners on a diagonal of the pressure chamber, and an inflow port (supply port) 106 of the supplied ink is provided in the other corner on the diagonal. The shape of the pressure chamber 104 is not limited to that of the present example, and a variety of planar shapes, for example, a polygon such as a rectangle (rhomb, rectangle, etc.), a pentagon, and an octagon, a circle, and an ellipse can be employed.

Figure 11:
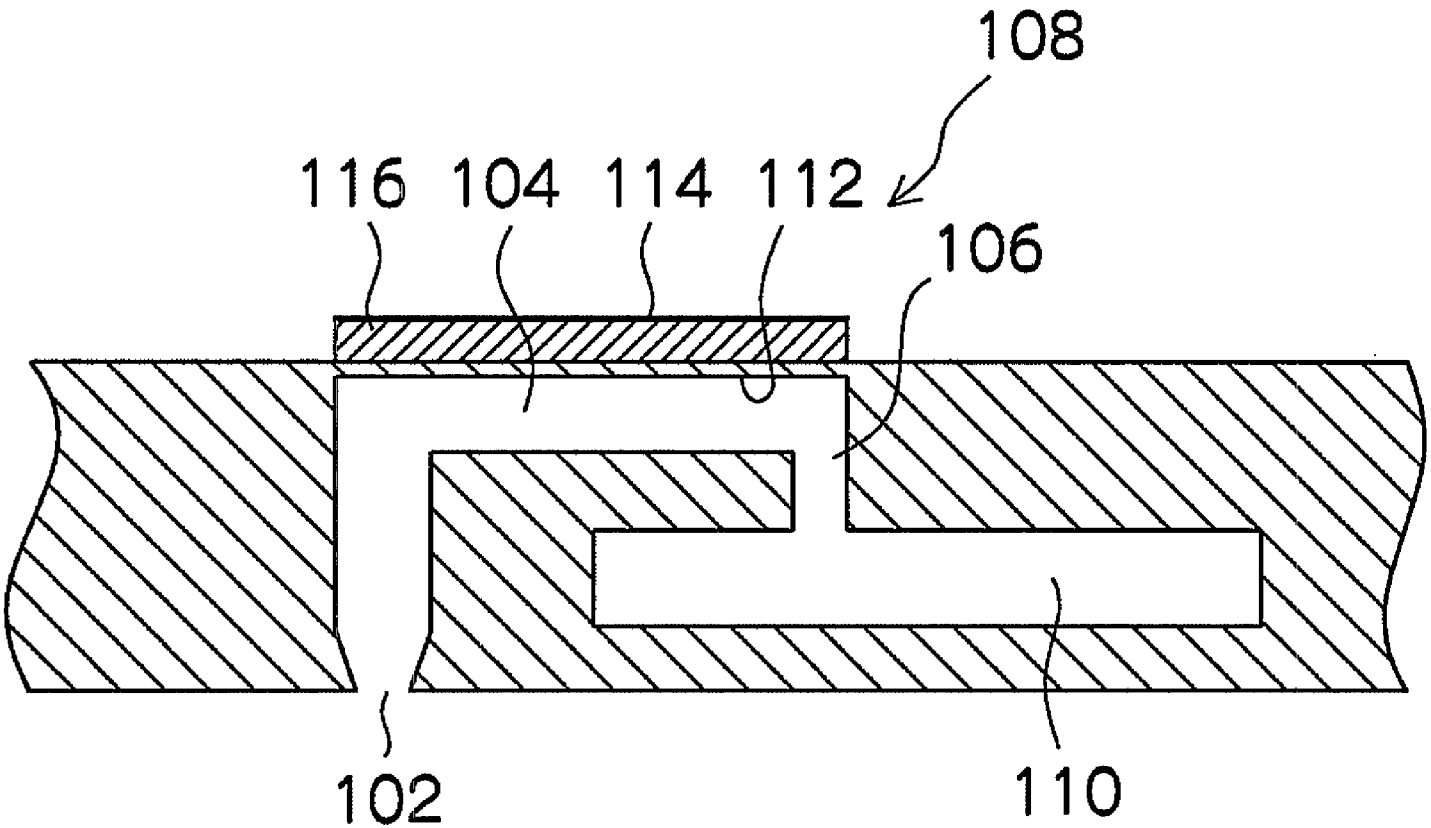
FIG. 11 is a cross-sectional view along line 11-11 in FIGS. 9A and 9B.

FIG. 11 is a cross-sectional view (cross-sectional view along line 11-11 in FIGS. 9A and 9B) illustrating a three-dimensional configuration of a droplet ejection element (ink chamber unit corresponding to one nozzle 102) of one channel that serves as a recording element unit in the ink head 100.

As shown in FIG. 11, each pressure chamber 104 communicates with a common flow channel 110 via the supply port 106. The common flow channel 110 communicates with an ink tank (not shown in the drawing) that serves as an ink supply source, and the ink supplied from the ink tank is supplied into each pressure chamber 104 via the common flow channel 110.

An actuator 116 having an individual electrode 114 is joined to a pressure application plate (oscillation plate also used as a common electrode) 112 that configures part of the surface (top surface in FIG. 11) of the pressure chamber 104. Where a drive voltage is applied between the individual electrode 114 and the common electrode, the actuator 116 is deformed, the volume of the pressure chamfer 104 changes, and the ink is ejected from the nozzle 102 by the variation in pressure that follows the variation in volume. A piezoelectric element using a piezoelectric material such as lead titanate zirconate or barium titanate can be advantageously used in the actuator 116. When the displacement of the actuator 116 returns to the original state after the ink has been ejected, the pressure chamber 104 is refilled with new ink from the common flow channel 110 via the supply port 106.

An ink droplet can be ejected from the nozzle 102 by controlling the drive of the actuator 116 correspondingly to each nozzle 102 according to dot data generated by a digital half toning processing from the input image. By controlling the ink ejection timing of each nozzle 102 according to the conveyance speed on the recording medium 22, while conveying the recording medium with a constant speed in the sub-scanning direction, it is possible to record the described image on the recording medium 22.

Figure 12:
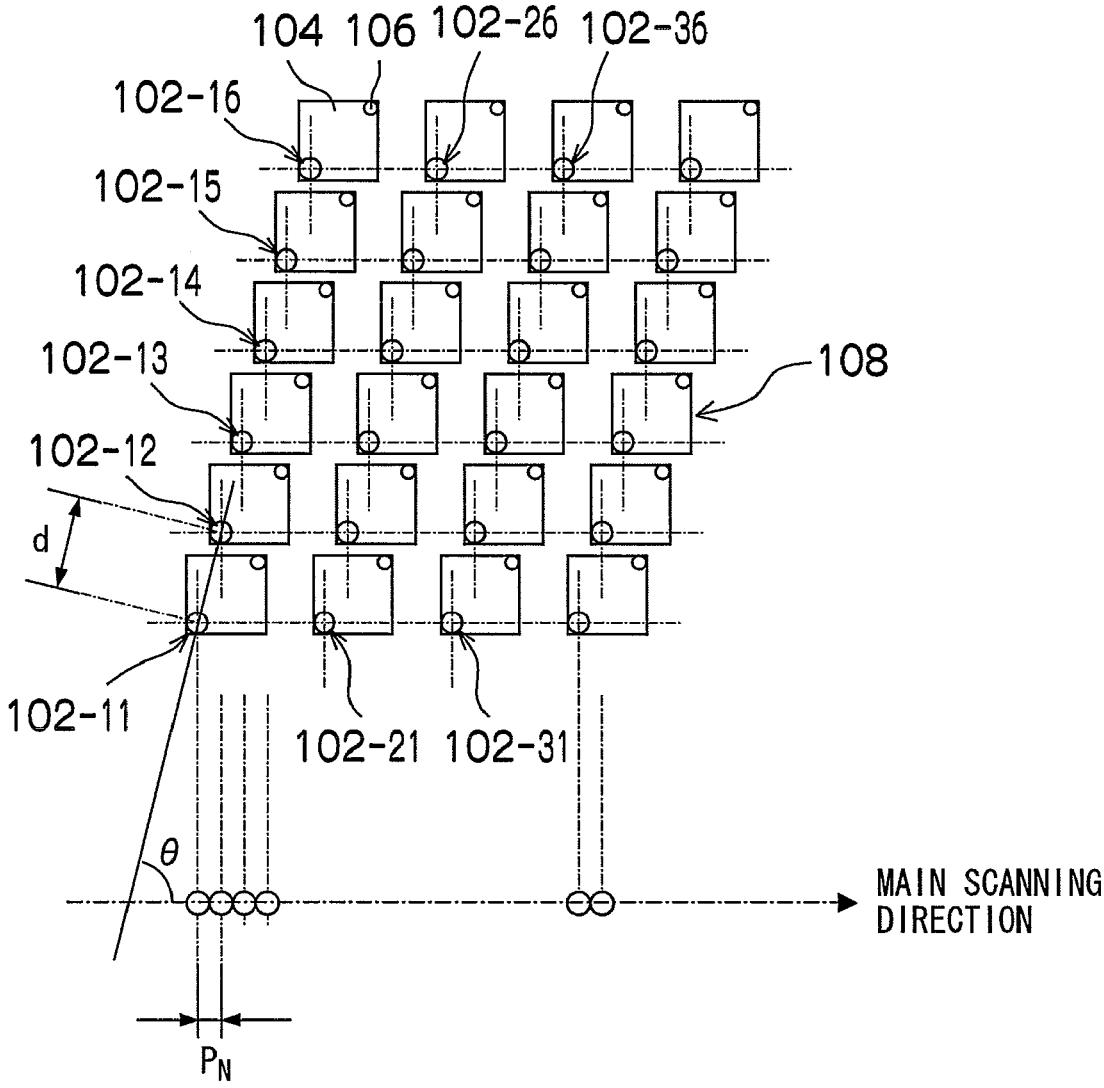
FIG. 12 is a plan view illustrating a nozzle arrangement example in the head.

A high-density nozzle head of the present example is realized by arranging a large number of ink chamber units 108 having the above-described configuration in a grid-like manner with a constant arrangement pattern along a row direction coinciding with the main scanning direction and an oblique column direction that is inclined at a certain angle θ, rather than perpendicular, to the main scanning direction, as shown in FIG. 12.

Thus, with a structure in which a plurality of ink chamber units 108 are arranged with a constant pitch, d, along a direction inclined at a certain angle θ to the main scanning direction, a pitch, P, of nozzles projected (front projection) to be aligned in the main scanning direction will be $d \times \cos\theta$, and with respect to the main scanning direction, the configuration can be handled as equivalent to that in which the nozzles 102 are arranged linearly with a constant pitch P. With such a configuration, it is possible to realize a substantial increase in density of nozzle columns that are projected so as to be aligned in the main scanning direction.

When the nozzles are driven with a full line head that has a nozzle column of a length corresponding to the entire printable width, the drive can be performed by: (1) simultaneously driving all the nozzles, (2) successively driving the nozzles from one side to the other, and (3) diving the nozzles into blocks and successively driving in each block from one side to the other. A nozzle drive such that one line (a line produced by dots of one column or a line composed of dots of a plurality of columns) is printed in the direction perpendicular to the conveyance direction of the recording medium 22 is defined as main scanning.

In particular, when the nozzles 102 arranged in a matrix such as shown in FIG. 12 are driven, the main scanning of the above-described type (3) is preferred. Thus, nozzles 102-11, 102-12, 102-13, 102-14, 102-15, and 102-16 are taken as one block (also, nozzles 102-21, . . . , 102-26 are taken as one block, nozzles 102-31, . . . , 102-36 are taken as one block) and the nozzles 102-11, 102-12, . . . , 102-16 are successively driven in accordance with the conveyance speed of the recording medium 22, thereby printing one line in the direction perpendicular to the conveyance diction of the recording medium 22.

On the other hand, a process in which printing of one line (a line produced by dots of one column or a line composed of dots of a plurality of columns) formed in the aforementioned main scanning area is repeated by moving the above-described full line head and the recording medium 22 relative to each other is defined as sub-scanning.

Accordingly, the direction indicated by one line (or a longitudinal direction of a band-like region) recorded in the above-described main scanning is called a main scanning direction, whereas the direction in which the aforementioned sub-scanning is performed called a sub-scanning direction. Thus, in the present embodiment, the conveyance direction of the recording medium 22 will be called a sub-scanning direction, and the direction perpendicular thereto will be called a main scanning direction. The arrangement structure of the nozzles in the implementation of the present invention is not limited to that shown by way of an example in the drawings.

Further, in the present embodiment, a system is employed in which ink droplets are ejected by the deformation of an actuator 116 such as peizoelement (piezoelectric element), but a system for ejecting the ink in the implementation of the present invention is not particularly limited, and a variety of systems can be employed instead of the piezo jet system. An example of another suitable system is a thermal jet system in which the ink is heated by a heat-generating body such as a heater, gas bubbles are generated, and the ink droplets are ejected by the pressure of gas bubbles.

<Explanation of Control System>

Figure 13:
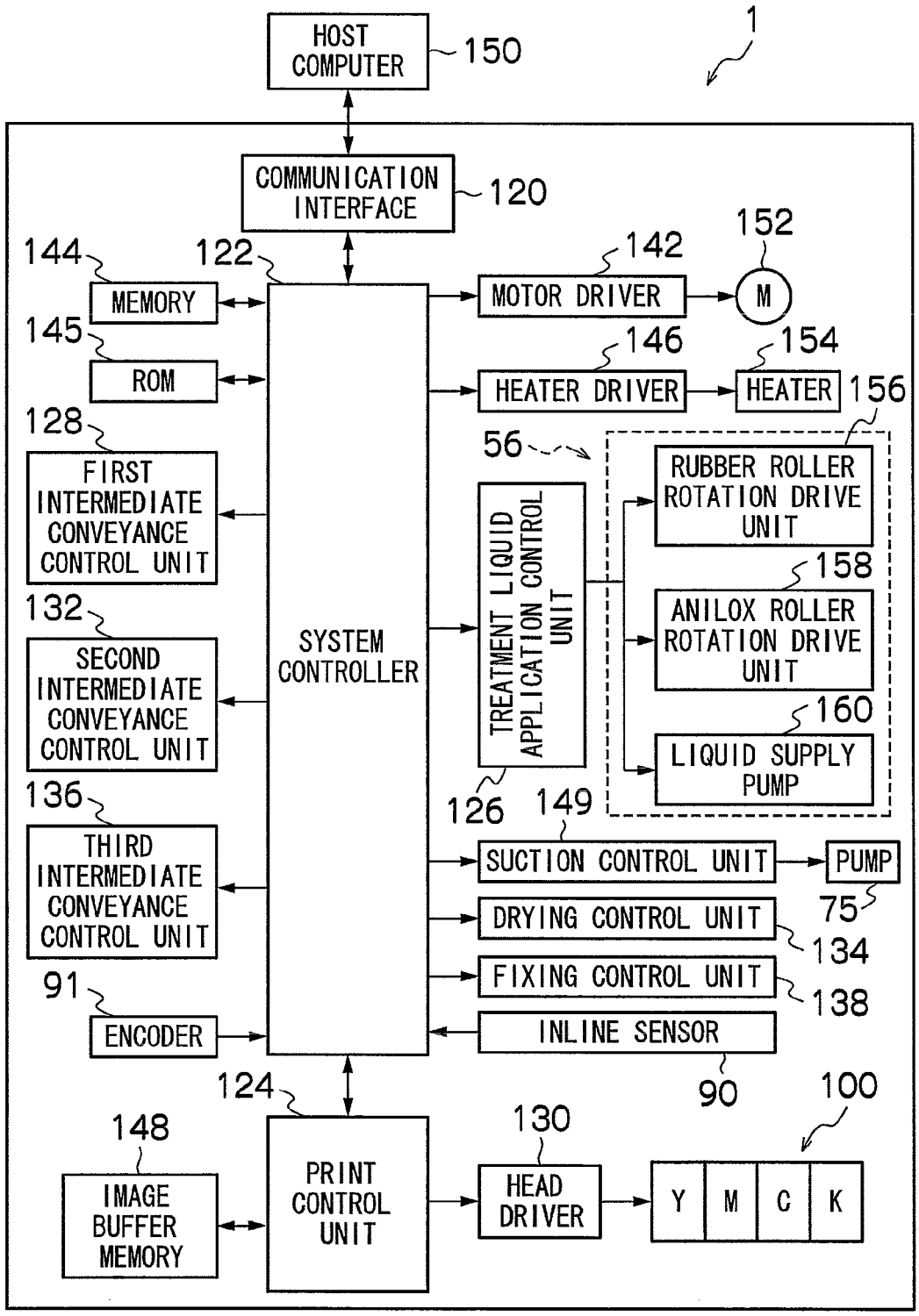
FIG. 13 is a principal block diagram illustrating the system configuration of the inkjet recording apparatus.

FIG. 13 is a block diagram of the main portion of a system configuration of the inkjet recording apparatus 1. The inkjet recording apparatus 1 include a communication interface 120, a system controller 122, a printing control unit 124, a treatment liquid application control unit 126, a first intermediate conveyance control unit 128, a head driver 130, a second intermediate conveyance control unit 132, a drying control unit 134, a third intermediate conveyance control unit 136, a fixing control unit 138, an inline sensor 90, an encoder 91, a motor driver 142, a memory 144, a heater driver 146, an image buffer memory 148, and a suction control unit 149.

The communication interface 120 is an interface unit that receives image data sent from a host computer 150. A serial interface such as USB (Universal Serial Bus), IEEE 1394, Ethernet, and a wireless network, or a parallel interface such as Centronix can be applied as the communication interface 120. A buffer memory (not shown in the drawing) may be installed in the part of the interface to increase the communication speed. The image data sent from the host computer 150 are introduced into the inkjet recording apparatus 1 via the communication interface 120 and temporarily stored in the memory 144.

The system controller 122 includes a central processing unit (CPU) and a peripheral circuitry thereof, functions as a control device that controls the entire inkjet recording apparatus 1 according to a predetermined program, and also functions as an operational unit that performs various computations. Thus, the system controller 122 controls various units such as the treatment liquid application control unit 126, first intermediate conveyance control unit 128, head driver 130, second intermediate conveyance control unit 132, drying control unit 134, third intermediate conveyance control unit 136, a fixing control unit 138, motor driver 142, memory 144, heater driver 146, and suction control unit 149, performs communication control with the host computer 150, performs read/write control of the memory 144, and also generates control signals for controlling the motor 152 and heater 154 of the conveyance system.

The memory 144 is a storage device that temporarily stores the images inputted via the communication interface 120 and reads/writes the data via the system controller 122. The memory 144 is not limited to a memory composed of semiconductor elements and may use a magnetic medium such as a hard disk.

Programs that are executed by the CPU of the system controller 122 and various data necessary for performing the control are stored in the ROM 145. The ROM 145 may be a read-only storage device or may be a writable storage device such as EEPROM. The memory 144 can be also used as a region for temporary storing image data, a program expansion region, and a computational operation region of the CPU.

The motor driver 142 drives the motor 152 according to the indications from the system controller 122. In FIG. 13, a representative example of the motors disposed for all the units in the apparatus is denoted by the reference numeral 152. For example, the motor 152 shown in FIG. 13 includes motors for driving the rotation of the transfer drum 52, treatment liquid drum 54, image formation drum 70, drying drum 76, fixing drum 84, and transfer drum 94 shown in FIG. 1, a drive motor for the pump 75 designed for negative-pressure suction from the suction holes 74 of the image formation drum 70, and motors of reciprocating mechanisms of the head units of inkjet heads 72C, 72M, 72Y, and 72K.

The heater driver 146 drives the heater 154 according to the indications from the system controller 122. In FIG. 13, a representative example of a plurality of heaters provided in the inkjet recording apparatus 1 is denoted by the reference numeral 154. For example, the heaters 154 shown in FIG. 13 include a preheater (not shown in the drawing) for heating the recording medium 22 in advance to an appropriate temperature in the paper feed unit 10.

The printing control unit 124 has a signal processing function for performing a variety of processing and correction operations for generating signals for print control from the image data within the memory 144 according to control of the system controller 122, and supplies the generated printing data (dot data) to the head driver 130. The required signal processing is implemented in the printing control unit 124, and the ejection amount and ejection timing of ink droplets in the ink head 100 are controlled via the head driver 130 based on the image data. As a result, the desired dot size and dot arrangement are realized.

The printing control unit 124 is provided with an image buffer memory 148, and data such as image data or parameters are temporarily stored in the image buffer memory 148 during image data processing in the printing control unit 124.

In FIG. 13 a configuration is shown in which the image buffer memory 148 is installed for the printing control unit 124, but it can be also used in combination with the memory 144. Furthermore, a mode in which the printing control unit 124 and the system controller 122 are integrated and configured by one processor is also possible.

The flow of processing from image input to printing output is described schematically below. The data of the image that is to be printed are inputted from the outside via the communication interface 120 and stored in the memory 144. At this stage, the RGB image data are stored, for example, in the memory 144.

In the inkjet recording apparatus 1, in order to form an image with a gradation that seems pseudo-continuous to human eye, it is necessary to perform a conversion to a dot pattern such that reproduces the gradation (shading of image) of the inputted digital image as truly as possible by changing the deposition density or size of fine dots formed by the ink (coloring material). For this purpose, data of the original image (RGB) that have been stored in the memory 144 are sent to the printing control unit 124 via the system controller 122 and converted in the printing control unit 124 into dot data for each ink color by a half-toning processing using a threshold matrix or an error diffusion method.

Thus, the printing control unit 124 performs a processing of converting the inputted RGB image data into dot data of four colors K, C, M, Y The dot data thus generated in the printing control unit 124 are accumulated in the image buffer memory 148.

The head driver 130 outputs a drive signal for driving the actuator 116 corresponding to each nozzle 102 of the ink head 100 based on the printing data (that is, dot data stored in the image buffer memory 148) provided from the printing control unit 124. A feedback control system serving to maintain constant driving conditions of the heads may be included in the head driver 130.

The drive signal outputted from the head driver 130 is applied to the ink head 100, whereby ink is ejected from the corresponding nozzle 102. An image is formed on the recording medium 22 by controlling the ejection of ink from the ink head 100, while conveying the recording medium 22 with the predetermined speed.

Further, the system controller 122 controls the treatment liquid application control unit 126, first intermediate conveyance control unit 128, second intermediate conveyance control unit 132, drying control unit 134, third intermediate conveyance control unit 136, fixing control unit 138, and suction control unit 149.

The treatment liquid application control unit 126 control the operation of the treatment liquid application device 56 of the treatment liquid application unit 12 in accordance with the indications from the system controller 122. More specifically, in the treatment liquid application device 56, a rubber roller rotation drive unit 156 that drives the rotation of the rubber roller 62, an anilox roller rotation drive unit 158 that drives the rotation of the anilox roller 64, and a liquid supply pump 160 that supplies the treatment liquid to the treatment liquid container 68 are controlled by the treatment liquid application control unit 126.

The first intermediate conveyance control unit 128 controls the operation of the intermediate conveyance body 30 or conveying guide 32 of the first intermediate conveyance unit 24 in accordance with the indications from the system controller 122. More specifically, the rotation drive of the intermediate conveyance body 30 itself and the rotation of the holding devices 34 or operation of the blower 38 provided in the intermediate conveyance body 30 are controlled in the intermediate conveyance body 30. In the conveying guide 32, the operation of the pump 43 for performing a suction operation from the suction holes 42 is controlled.

Figure 14:
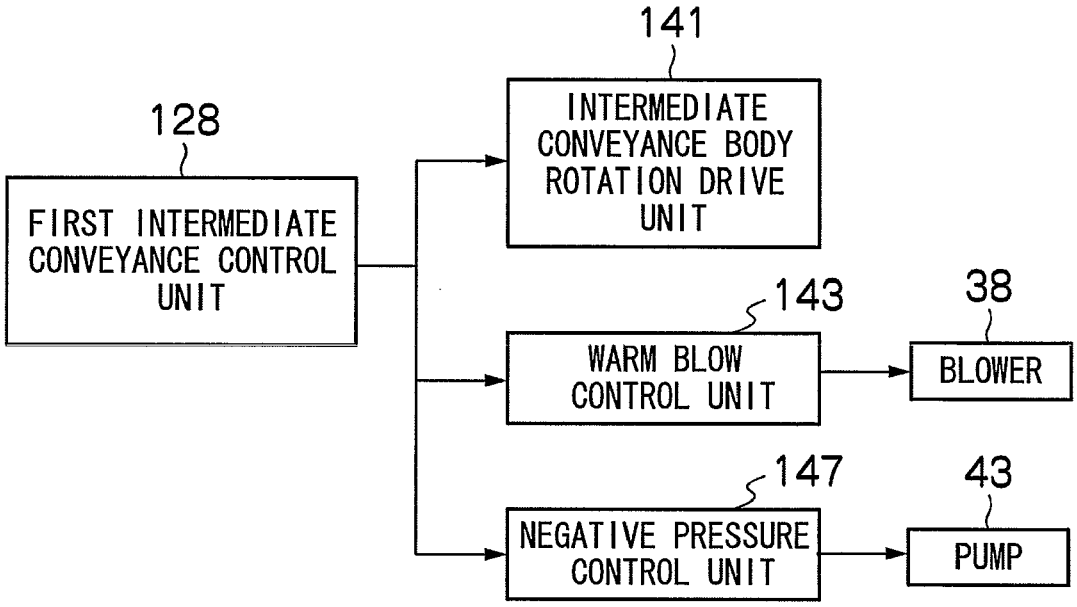
FIG. 14 is a principal block diagram illustrating the system configuration of the first intermediate conveyance control unit.

FIG. 14 is a principal block diagram illustrating a system configuration of the first intermediate conveyance control unit 128. As shown in FIG. 14, the first intermediate conveyance control unit 128 configures an intermediate conveyance body rotation drive unit 141, a blower control unit 143, and a negative pressure control unit 147.

The intermediate conveyance body rotation drive unit 141 controls the rotation drive of the intermediate conveyance body 30 itself.

With the blower control unit 143, the temperature or flow rate of the air from the blower 38 are adjusted and so controlled as to accelerate effectively the drying of moisture contained in the treatment liquid and also the decrease in viscosity or permeation of the high boiling-point solvent. Further, the value of the positive pressure created by the air flow may be controlled by controlling the flow rate of the air from the blower 38 in accordance with the type of the recording medium 22. The value of the positive pressure created by the air flow may be also controlled by controlling the flow rate of the air from the blower 38 in accordance with at least one from the thickness of the recording medium 22 and the porosity of the recording medium 22. In addition, the temperature of the air from the blower 38 may be also controlled in accordance with the type (for example, high-grade paper, coated paper, etc.) of the recording medium 22.

With the negative pressure control unit 147, the pump 43 is controlled and suction is performed from a non-recording surface, which is the surface on the side opposite the recording surface of the recording medium 22, so as to cause the penetration of the solvent contained in the treatment liquid. The negative pressure applied by the pump 43 may be controlled so as to vary it based on at least one from among the thickness of the recording medium 22 and the porosity of the recording medium 22. The value of the negative pressure applied by the pump 43 may be also controlled in accordance with the type of the recording medium 22.

The second intermediate conveyance control unit 132 and third intermediate conveyance control unit 136 have a system configuration identical to that of the first intermediate conveyance control unit 128, and the operation of the intermediate conveyance body 30 or the conveying guide 32 of the second intermediate conveyance unit 26 and third intermediate conveyance unit 28 is controlled corresponding to the indications from the system controller 122.

The drying control unit 134 controls the operation of the first IR heater 78, warm-air blow-out nozzle 80, and second IR heater 82 in the drying unit 16 correspondingly to the system controller 122.

The fixing control unit 138 controls the operation of the first fixing roller 86 and second fixing roller 88 in the fixing unit 18 in accordance with the indications from the system controller 122.

The suction control unit 149 controls the operation of the pump 75 connected to suction holes 74 of the image formation drum 70 of the image formation unit 14.

Detection signals of a check pattern applied to the recording medium 22 or data on the measurement results such as moisture content, surface temperature, and gloss of the recording medium 22 are also inputted from the inline sensor 90 into the system controller 122. The detection signal of a rotation speed of the image formation drum 70 is also inputted from the encoder 91, and the deposition timing of the ink dots 100 is controlled via the head driver 130.

<Specific Effects of Inkjet Recording Apparatus>

The below-described specific effects can be obtained with the inkjet recording apparatus 1 of the above-described configuration.

In the drying unit 16, the ink solvent on the recording medium 22 is dried by the first IR heater 78, warm-air blow-out nozzle 80, and second IR heater 82. Therefore, unevenness of image caused by the flow movement of the coloring material on the recording medium 22, ink bleeding or color mixing occurring when a plurality of inks are applied, and deformation such as curling or cockling of the recording medium are prevented and a high-quality image can be formed on the recording medium 22 at a high speed.

Concerning the relationship between the image formation unit 14 and the drying unit 16, the inkjet heads 72C, 72M, 72Y, 72K and the first IR heater 78, warm-air blow-out nozzle 80, and second IR heater 82 are arranged separately in terms of structure for the image formation drum 70 and drying drum 76. Therefore, the image formation drum 70 itself is not heated, the meniscus of the inkjet heads 72C, 72M, 72Y, 72K is not dried, a non-ejection effect of the inkjet heads 72C, 72M, 72Y, 72K can be prevented, and a high-quality image can be formed at a high speed on the recording medium 22.

Concerning the relationship between the image formation unit 14, drying unit 16, and fixing unit 18, the inkjet heads 72C, 72M, 72Y, 72K, the first IR heater 78, warm-air blow-out nozzle 80, and second IR heater 82, and the first fixing roller 86 and second fixing roller 88 are arranged separately in terms of structure for each drum. As a result, the temperature can be freely set with the first fixing roller 86 and second fixing roller 88.

Because the recording surface of the recording medium 22 does not come into contact with other structural members such as the intermediate conveyance body 30, the damage to image can be avoid, even the large-size recording medium with a recording surface of the recording medium 22 in a semi-wet state can be conveyed with high accuracy, and the position of recording medium can be ensured with high accuracy. Moreover, where the pump 43 or blower 38 are controlled and the pressure applied to the recording medium 22 is controlled in accordance with the type of the recording medium 22 by the blower control unit 143 and negative pressure control unit 147, the issue of versatility of the recording medium 22 can be addressed.

Where the pressure applied to the recording medium 22 is controlled in accordance with at least one from among the thickness and porosity of the recording medium 22 by the blower control unit 143 or negative pressure control unit 147, the issue of versatility of the recording medium 22 can be addressed.

Where, an air is blown from the blower ports 36 of the intermediate conveyance body 30 onto the recording surface of the recording medium 22, the penetration of the high boiling-point solvent of the ink that has been deposited on the recording surface of the recording medium 22 into the recording medium 22 can be further enhanced.

By controlling the direction of air blow by using the blow control guide 40 in the intermediate conveyance body 30 so that the air flow is blown from the blower ports 36 facing the recording surface of the recording medium 22, the penetration of the high boiling-point solvent of the ink that has been deposited on the recording surface of the recording medium 22 into the recording medium 22 is enhanced more reliably.

Table 1 shows evaluation results on a viscosity characteristic of a high boiling-point solvent vs. a liquid temperature for the liquid including the high boiling-point solvent. Table 1 shows the evaluation results obtained when the content of the high boiling-point solvent was set to 5 levels and the liquid temperature was set to 3 levels. The viscosity unit is mPa·s (cP).

TABLE 1

| | | CONTENT OF HIGH BOILING-POINT SOLVENT (wt %) | | | | |
|---|---|---|---|---|---|---|
| | | 100 | 90 | 67 | 50 | 33 |
| TEMPERATURE OF LIQUID (° C.) | 25 | 507 | 264 | 33.9 | 10.85 | 4.146 |
| | 40 | 246 | 101.8 | 16.14 | 5.196 | 2.58 |
| | 60 | 82.44 | 33.72 | 7.308 | 3.204 | 1.56 |

As shown in Table 1, the viscosity of a high boiling-point solvent tends to decrease with the increase in liquid temperature. Therefore, the penetration of the solvent of the aqueous ink into the recording medium 22 can be enhanced by blowing warm air to increase the aqueous ink temperature and decrease the viscosity of the high boiling-point solvent of the aqueous ink.

When the conveying guide 32 in the intermediate conveyance body 30 transfers the recording medium 22 to the image formation drum 70, the drying drum 76, or the fixing drum 84, a force (back tension) acts in the direction opposite to the rotation direction of the recording medium 22. As a result, the occurrence of wrinkles or floating when the recording medium 22 is conveyed to the drying drum 76 or the fixing drum 84 can be reduced. Thus, because tension is applied to the recording medium 22 and drying is enhanced on the drying drum 76, the effect of reducing curling and cockling is obtained, and because a tension is applied on the fixing drum 84 and the recording medium 22 is conveyed to the fixing unit 18, while reducing the floating of the recording medium 22, the effect of preventing the occurrence of wrinkles of the recording medium 22 in the fixing unit 18 is obtained.

A device that attracts the non-recording surface of the recording medium 22 by suction can be considered for applying a back tension to the recording medium 22. A device that blows air on the recording surface of the recording medium 22 also can be considered for applying a back tension to the recording medium 22. By partially restricting the flow of air blown onto the recording surface of the recording medium 22, for example, if the direction of air flow is restricted so that the air flow is blown from blower ports 36 in the direction facing the recording surface of the recording medium 22 by the blow control guide 40, a back tension can be effectively caused to act upon the recording medium 22. Other suitable methods include increasing the surface roughness of the guide surface 44 of the conveying guide 32 or attaching rubber or the like and increasing the friction force.

Further, where the image formation drum 70, or drying drum 76, or fixing drum 84 is provided with a device that brings the recording medium 22 into tight contact with the peripheral surface of the drum, the occurrence of wrinkles of floating can be reliably prevented when the recording medium 22 is conveyed to the image formation drum 70. A suction device or an electrostatic attraction device can be considered for bringing the recording medium 22 into tight contact with the peripheral surface of the drum.

Further, in the first intermediate conveyance unit 24, the recording medium 22 is rotated and moved, while the leading end of the recording medium 22 is held by the holding devices 34 of the intermediate conveyance body 30. In this case, the recording medium 22 is conveyed while the non-recording surface thereof is supported by the supporting sections 44, by performing at least any one from blowing an air flow from the blower ports 36 of the intermediate conveyance body 30 and creating suction from the suction holes 42 of the conveying guide 32. Therefore, the recording medium 22 is conveyed in a state in which the recording surface does not come into contact with the intermediate conveyance body 30. Therefore, the image formed by an aqueous ink applied on the recording surface of the recording medium in the image formation unit 14 remains intact.

By partially restricting the flow of air blown onto the recording surface of the recording medium 22, for example, if the direction of air flow is restricted so that the air flow is blown from the blower ports 36 in the direction facing the recording surface of the recording medium 22 by the blow control guide 40, a back tension can be effectively caused to act upon the recording medium 22.

Where either one from suction from the suction holes 42 of the conveying guide 32 and blowing an air flow from the blower ports 36 of the intermediate conveyance body 30 is performed in the first intermediate conveyance unit 24 and second intermediate conveyance unit 26, the high boiling-point solvent contained in the aqueous ink applied in the image formation unit 14 penetrates into the recording medium. Therefore, when the image is fixed using the first fixing roller 86 and the second fixing roller 88 in the fixing unit 18 of the subsequent process, because the high boiling-point solvent is not present on the surface of the recording medium 22, the adhesion of the aggregated coloring material and recording medium can be ensured, fixing ability of the image is increased, quality of the image is increased, and also the coloring material offset to the first fixing roller 86 and the second fixing roller 88 is improved.

When the non-recording surface of the recording medium 22 is attracted by suction, the negative pressure applied from the suction holes 42 by the pump 43 may be variably controlled based on at least one from among the thickness of the recording medium 22 and the porosity of the recording medium 22 with the negative pressure control unit 147 (see FIG. 14) of the control system. More specifically, where the thickness of the recording medium 22 is large, the negative pressure applied from the suction holes 42 by the pump 43 is increased to enhance the penetration of solvent into the recording medium 22. Further, where the porosity of the recording medium 22 is small, the negative pressure applied from the suction holes 42 by the pump 43 is increased to enhance the penetration of solvent into the recording medium 22.

Further, when warm air is blown on the recording surface of the recording medium 22 from the blower ports 36 of the intermediate conveyance body 30, in the first intermediate conveyance unit 24 and the second intermediate conveyance unit 26, the viscosity of the high boiling-point solvent contained in the ink is decreased, the penetration of the solvent into the recording medium 22 is enhanced, and the drying of the residual moisture contained in the ink is enhanced.

The temperature and amount of air blown from the blower 38 may be adjusted and controlled by the blower control unit 143 of the control system (see FIG. 14) so as to enhance efficiently the decrease in viscosity of the high boiling-point solvent and the drying of the residual moisture contained in the ink.

The inkjet recording apparatus and the inkjet recording method in accordance with the present invention are described hereinabove in details, but the present invention is not limited to the above-described examples and it goes without saying that various modification and changes may be made without departing from the scope of the present invention.

Recording Medium

In the embodiments of the present invention, images can be precisely formed on recording media irrespective of kinds of the recording media. In particular, the below-described types of recording media can be advantageously used.

The preferred examples of the recording media include gloss or mat paper such as board paper, cast coated paper, art paper, coated paper, fine coated paper, high-grade paper, copy paper, recycled paper, synthetic paper, wood-containing paper, pressure-sensitive paper, and emboss paper. Special inkjet paper can be also used. Further, resin film and metal deposited film can be also used. More specific preferred examples include paper with a weight of 60 $g/m^2$ to 350 $g/m^2$ such as OK Ercard+(manufactured by Oji Paper), SA Kanefuji+ (manufactured by Oji Paper), Satin Kanefuji N (manufactured by Oji Paper), OK Top Coat+ (manufactured by Oji Paper), New Age (manufactured by Oji Paper), Tokuhishi Art Both-sides N (manufactured by Mitsubishi Paper Mills), Tokuhishi Art Single-side N (manufactured by Mitsubishi Paper Mills), New V Mat (manufactured by Mitsubishi Paper Mills), Aurora Coat (manufactured by Nippon Paper Industries), Aurora L (manufactured by Nippon Paper Industries), U-Light (manufactured by Nippon Paper Industries), Recycle Coat T-6 (manufactured by Nippon Paper Industries), Recycle Mat T-6 (manufactured by Nippon Paper Industries), Ivest W (manufactured by Nippon Paper Industries), Invercoat M (manufactured by SPAN CORPORATION), High McKinley Art (manufactured by Gojo Paper Mfg), Kinmari Hi-L (manufactured by Hokuetsu Paper Mills), Signature True (manufactured by Newpage Corporation), Sterling Ultra (manufactured by Newpage Corporation), Anthem (manufactured by Newpage Corporation), Hanno ArtSilk (manufactured by Sappi), Hanno Art Gross (manufactured by Sappi), Consort Royal Semimatt (manufactured by Scheufelen), Consort Royal Gross (manufactured by Scheufelen), Zanders Ikono Silk (manufactured by m-real), Zanders Ikono Gross (manufactured by m-real).

Aqueous Ink

The aqueous ink used in the embodiment of the present invention will be described below in greater detail.

The aqueous ink in accordance with the present invention is configured as a special ink including at least a resin dispersant (A), a pigment (B) that is dispersed by the resin dispersant (A), self-dispersible polymer microparticles (C), and an aqueous liquid medium (D).

<Resin Dispersant (A)>

The resin dispersant (A) is used as a dispersant for the pigment (B) in the aqueous liquid medium (D) and may be any appropriate resin, provided that it can disperse the pigment (B). The preferred structure of the resin dispersant (A) includes a hydrophobic structural unit (a) and a hydrophilic structural unit (b). If necessary, the resin dispersant (A) can also include a structural unit (c) that is different from the hydrophobic structural unit (a) and hydrophilic structural unit (b).

As for the compounding ratio of the hydrophobic structural unit (a) and hydrophilic structural unit (b), it is preferred that the hydrophobic structural unit (a) takes more than 80 wt %, preferably 85 wt % or more of the total weight of the resin dispersant (A). Thus, the compounding ratio of the hydrophilic structural unit (b) has to be not more than 15 wt %. Where the compounding ratio of the hydrophilic structural unit (b) is more than 15 wt %, the amount of component that is independently dissolved in the aqueous liquid medium (D), without participating in the dispersion of the pigment, increases, thereby causing degradation of performance such as dispersivity of the pigment (B) and worsening the ejection ability of ink for inkjet recording.

<Hydrophobic Structural Unit (a)>

The hydrophobic structural unit (a) of the resin dispersant (A) in accordance with the present invention includes at least a hydrophobic structural unit (a1) having an aromatic ring that is not directly coupled to an atom forming the main chain of the resin dispersant (A).

The expression "that is not directly coupled to" as used herein means a structure in which an aromatic ring and an atom forming the main chain structure of the resin are coupled via a linking group. With such a configuration, an adequate distance is maintained between the hydrophilic structural unit in the resin dispersant (A) and the hydrophobic aromatic ring. Therefore, interaction easily occurs between the resin dispersant (A) and pigment (B), strong adsorption is induced, and therefore dispersivity is increased.

<Hydrophobic Structural Unit (a1) Having Aromatic Ring>

From the standpoint of pigment dispersion stability, ejection stability, and cleaning ability, it is preferred that the hydrophobic structural unit (a1) having an aromatic ring that is not directly coupled to an atom forming the main chain of the resin dispersant (A) have a content ratio not less than 40 wt % and less than 75 wt %, more preferably not less than 40 wt % and less than 70 wt %, and even more preferably not less than 40 wt % and less than 60 wt % based on the total weight of the resin dispersant (A).

From the standpoint of improving the pigment dispersion stability, ejection stability, cleaning ability, and abrasion resistance, it is preferred that the aromatic ring that is not directly coupled to an atom forming the main chain of the resin dispersant (A) be contained in the resin dispersant (A) at a ratio not less than 15 wt % and not more than 27 wt %, more preferably not less than 15 wt % and not more than 25 wt %, and even more preferably not less than 15 wt % and not more than 20 wt %.

Within the above-described ranges, the pigment dispersion stability, ejection stability, cleaning ability, and abrasion resistance can be improved.

In accordance with the present invention, the hydrophobic structural unit (a1) having an aromatic ring in the hydrophobic structural unit (a) is preferably introduced in the resin dispersant (A) in the structure represented by a General Formula (1) below.

(1)

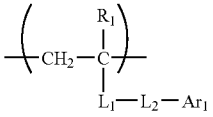

In the General Formula (1), R1 represents a hydrogen atom, a methyl group, or a halogen atom; L1 represents (main chain side) —COO—, —OCO—, —CONR2-, —O—, or substituted or unsubstituted phenylene group; and R2 represents a hydrogen atom and an alkyl group having 1 to 10 carbon atoms. L2 represents a single bond or a divalent linking group having 1 to 30 carbon atom; when it is a divalent linking group, the linking group preferably has 1 to 25 carbon atoms, more preferably 1 to 20 carbon atoms. Examples of suitable substituents include a halogen atom, an alkyl group, an alkoxy group, a hydroxyl group, and a cyano group, but this list is not limiting. Ar1 represents a monovalent group derived from an aromatic ring.

In the General Formula (1) the following combination of structural units is preferred: R1 is a hydrogen atom or a methyl group, L1 is (main chain side) —COO—, and L2 is a divalent linking group having 1 to 25 carbon atoms and including an alkyleneoxy group and/or alkylene group. In the even more preferred combination, R1 is a hydrogen atom or a methyl group, L1 is (main chain side) —COO—, and L2 is (main chain side) —$(CH_2—CH_2—O)_n$— (n represents the average number of structural repeating units; n=1 to 6).

The aromatic ring in the Ar1 contained in the hydrophobic structural unit (a1) is not particularly limited, and examples of suitable aromatic rings include a benzene ring, a condensed aromatic ring having 8 or more carbon atoms, a hetero ring containing condensed aromatic rings, or two or more linked benzene rings.

The condensed aromatic ring having 8 or more carbon atoms as referred to herein is an aromatic compound having 8 or more carbon atoms that is composed of an aromatic ring having at least two or more condensed benzene rings, and/or at least one or more aromatic rings and an alicyclic hydrocarbon condensed to the aromatic ring. Specific examples thereof include naphthalene, anthracene, fluorene, phenanthrene, and acenaphthene.

The hetero ring in which aromatic rings are condensed are compounds in which an aromatic compound having no heteroatoms (preferably a benzene ring) and a cyclic compound having a heteroatom are condensed. The cyclic compound having a heteroatom is preferably a five-membered ring or a six-membered ring. The preferred examples of the heteroatom are a nitrogen atom, an oxygen atom, and a sulfur atom. The cyclic compound having a heteroatom may have a plurality of heteroatoms. In this case, the heteroatoms may be identical or different. Specific examples of the hetero ring in which aromatic rings are condensed include phthalimide, acridone, carbazole, benzoxazole, and benzothiazole.

Specific examples of monomers that can form the hydrophobic structural unit (a1) including a benzene ring, a condensed aromatic ring having 8 or more carbon atoms, a hetero ring in which aromatic rings are condensed, or a monovalent group derived from two or more benzene rings connected to each other are presented below, but the present invention is not limited to the below-described specific examples.

M-1

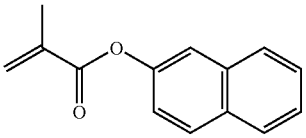

M-2

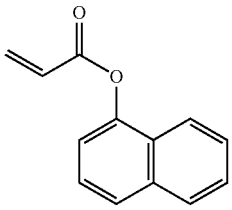

-continued
M-3
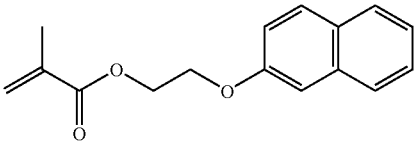
M-4
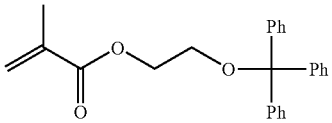
M-5
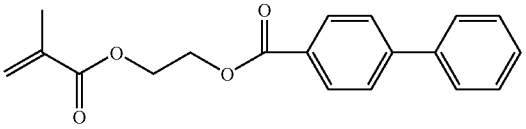
M-6
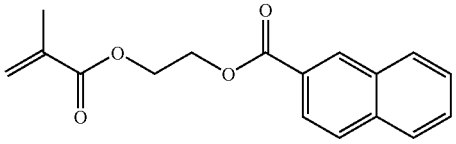
M-7
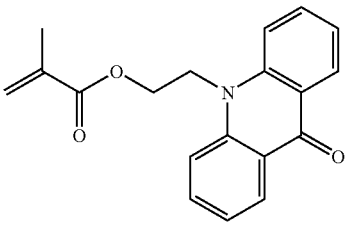
M-8
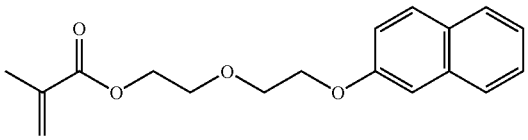
M-9
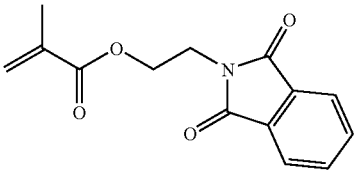
M-10
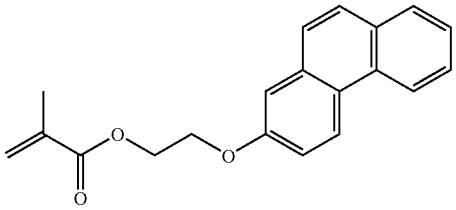
M-11
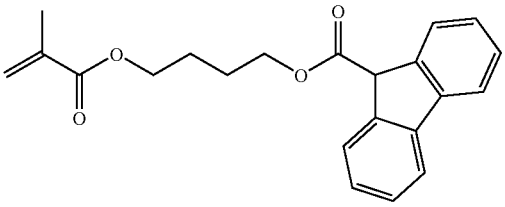
M-12
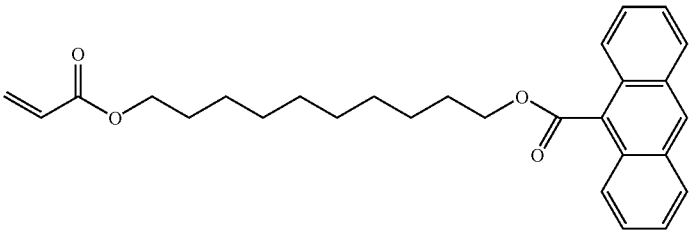
M-13
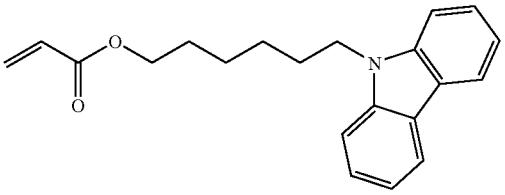
M-14
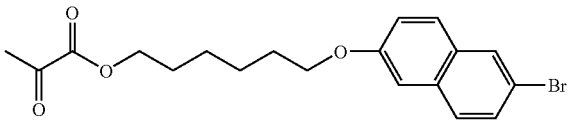
M-15
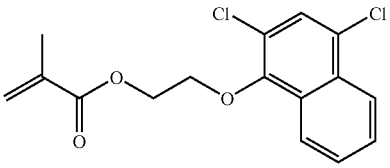
M-16
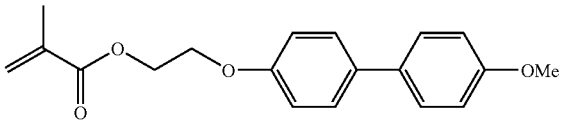

-continued

M-17

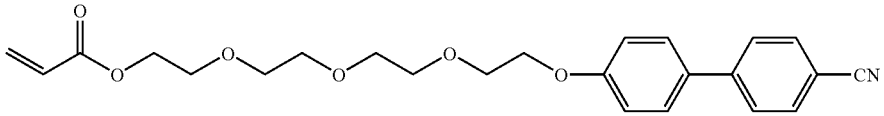

M-18

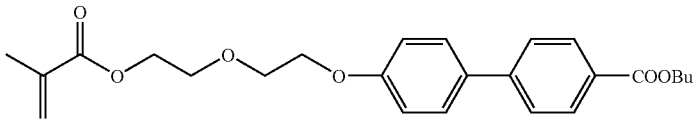

M-19

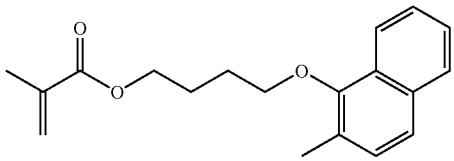

M-20

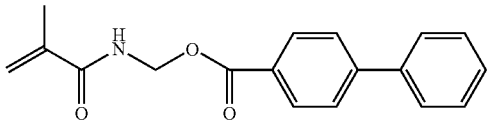

M-21

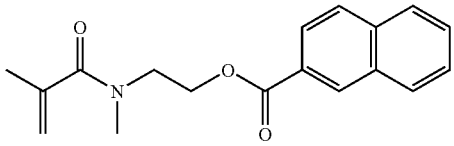

M-22

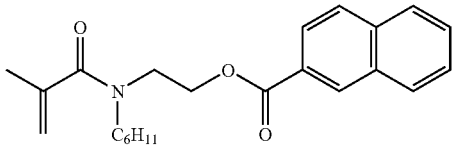

M-23

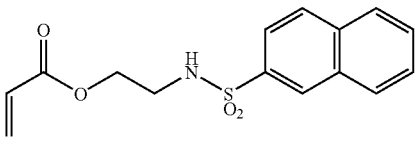

M-24

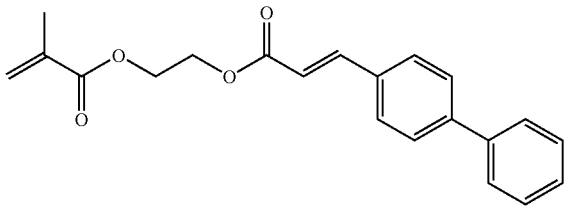

M-25

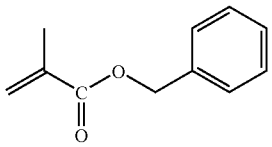

M-26

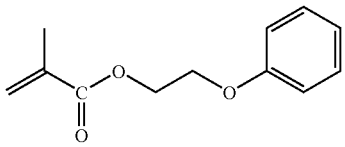

M-27

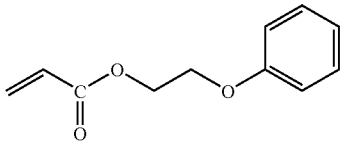

In accordance with the present invention, from the standpoint of dispersion stability, among the hydrophobic structural units (a1) having an aromatic ring that is directly coupled to an atom that forms the main chain of the resin dispersant (A), the preferred structural units are derived from at least any one from among benzyl methacrylate, phenoxyethyl acrylate, and phenoxyethyl methacrylate.

<Hydrophobic Structural Unit (a2) Derived from an Alkyl Ester Having 1 to 4 Carbon Atoms of Acrylic Acid or Methacrylic Acid>

The hydrophobic structural unit (a2) derived from an alkyl ester having 1 to 4 carbon atoms of acrylic acid or methacrylic acid that is contained in the resin dispersant (A) has to be contained in the resin dispersant (A) at a content ratio at least not less than 15 wt %, preferably not less than 20 wt % and not more than 60 wt %, and more preferably not less than 20 wt % and not more than 50 wt %.

Specific examples of the (meth)acrylates include methyl (meth)acrylate, ethyl (meth)acrylate, (iso)propyl (meth)acrylate, and (iso or tertiary) butyl (meth)acrylate.

The number of carbon atoms in the alkyl group is preferably 1 to 4, more preferably 1 to 2.

<Hydrophilic Structural Unit (b)>

The hydrophilic structural unit (b) constituting the resin dispersant (A) in accordance with the present invention will be described below.

The hydrophilic structural unit (b) is contained at a ratio of more than 0 wt % and not more than 15 wt %, preferably not less than 2 wt % and not more than 15 wt %, more preferably not less than 5 wt % and not more than 15 wt %, and even more preferably not less than 8 wt % and not more than 12 wt %.

The resin dispersant (A) includes at least acrylic acid and/or methacrylic acid (b1) as the hydrophilic structural unit (b).

<Hydrophilic Structural Unit (b1)>

The content of the hydrophilic structural unit (b1) has to change depending on the amount of the below-described structural unit (b2) or the amount of the hydrophobic structural unit (a), or both these amounts.

Thus, the resin dispersant (A) in accordance with the present invention may contain the hydrophobic structural unit (a) at a content ratio higher than 80 wt % and the hydrophilic structural unit (b) at a content ratio not more than 15 wt % and is determined by the hydrophobic structural units (a1) and (a2), hydrophilic structural units (b1) and (b2), and structural unit (c).

For example, when the resin dispersant (A) is configured only by the hydrophobic structural units (a1) and (a2), hydrophilic structural unit (b1), and structural unit (b2), the content ratio of the acrylic acid and methacrylic acid (b1) can be found by (100−(wt % of hydrophobic structural units (a1) and (a2))−(wt % of structural unit (b2))). In this case, the sum total of the (b1) and (b2) has to be not more than 15 wt %.

When the resin dispersant (A) is configured by the hydrophobic structural units (a1) and (a2), hydrophilic structural unit (b1), and structural unit (c), the content ratio of the hydrophilic structural unit (b1) can be found by "100−(wt % of hydrophobic structural units (a1) and (a2))−(wt % of structural unit (c))".

The resin dispersant (A) can be also configured only by the hydrophobic structural unit (a1), hydrophobic structural unit (a2), and hydrophilic structural unit (b1).

The hydrophilic structural unit (b1) can be obtained by polymerization of acrylic acid and/or methacrylic acid.

The acrylic acid and methacrylic acid can be used individually or in a mixture.

From the standpoint of pigment dispersibility and stability in storage, the acid value of the resin dispersant (A) in accordance with the present invention is preferably not lower than 30 mg KOH/g and not higher than 100 mg KOH/g, more preferably not lower than 30 mg KOH/g and lower than 85 mg KOH/g, and even more preferably not lower than 50 mg KOH/g and lower than 85 mg KOH/g.

The acid value as referred to herein is defined as a weight (mg) of KOH required to neutralize completely 1 g of the resin dispersant (A) and can be measured by a method described in a JIS standard (JIS K0070, 1992).

<Structural Unit (b2)>

The structural unit (b2) preferably has a nonionic aliphatic group. The structural unit (b2) can be formed by polymerizing a monomer corresponding thereto, and an aliphatic functional group may be introduced into the polymer chain after the polymerization of the polymer.

The monomer forming the structural unit (b2) is not particularly limited provided that it has a functional group that can form the polymer and a nonionic hydrophilic functional group. Well known suitable monomers can be used, but from the standpoint of availability, handleability, and utility, vinyl monomers are preferred.

Examples of vinyl monomers include (meth)acrylates, (meth)acrylamides, and vinyl esters having hydrophilic functional groups having a hydrophilic functional group.

Examples of the hydrophilic functional group include a hydroxyl group, an amino group, an amido group (with unsubstituted nitrogen atom), and the below-described alkylene oxide polymers such as polyethylene oxide and polypropylene oxide.

Among them hydroxyethyl (meth)acrylate, hydroxybutyl (meth)acrylate, (meth)acrylamide, aminoethyl acrylate, aminopropyl acrylate, and (meth)acrylates including alkylene oxide polymers are especially preferred.

The structural unit (b2) preferably includes a hydrophilic structural unit having an alkylene oxide polymer structure.

From the standpoint of hydrophility, it is preferred that the alkylene in the alkylene oxide polymer have 1 to 6 carbon atoms, more preferably 2 to 6 carbon atoms, and even more preferably 2 to 4 carbon atoms.

The degree of polymerization of the alkylene oxide polymer is preferably 1 to 120, more preferably 1 to 60, and even more preferably 1 to 30.

It is also preferred that the structural unit (b2) be a hydrophilic structural unit having a hydroxyl group.

The number of hydroxyl groups in the structural unit (b2) is not particularly limited. From the standpoint of hydrophility of the resin (A) and mutual solubility of the solvent or other monomers during the polymerization, it is preferred that this number be 1 to 4, more preferably 1 to 3, even more preferably 1 to 2.

<Structural Unit (c)>

As described above, the resin dispersant (A) in accordance with the present invention can also include a structural unit (c) having a structure different from that of the hydrophobic structural unit (a1), hydrophobic structural unit (a2), and hydrophilic structural unit (b) (this structural unit will be referred to hereinbelow simply as "structural unit (c)".

The structural unit (c) different from the hydrophobic structural unit (a1), hydrophobic structural unit (a2), and hydrophilic structural unit (b), as referred to herein, is a structural unit (c) having a structure different from that of the (a1), (a2), and (b), and it is preferred that the structural unit (c) be a hydrophobic structural unit.

The structural unit (c) can be a hydrophobic structural unit, but it has to be a structural unit having a structure different from that of the hydrophobic structural unit (a1) and hydrophobic structural unit (a2).

The content ratio of the structural unit (c) is preferably not more than 35 wt %, more preferably not more than 20 wt %, and even more preferably not more than 15 wt % based on the entire weight of the resin dispersant (A).

The structural unit (c) can be formed by polymerizing a monomer corresponding thereto. A hydrophobic functional group may be introduced into the polymer chain after the polymerization.

The monomer suitable in the case where the structural unit (c) is a hydrophobic structural unit is not particularly limited, provided that it has a functional group that can form a polymer and a hydrophobic functional group, and well known suitable monomers can be used.

From the standpoint of availability, handleability, and utility, vinyl monomers ((meth)acrylamides, styrenes, and vinyl esters) are preferred as the monomers that can form the hydrophobic structural unit.

Examples of (meth)acrylamides include N-cyclohexyl (meth)acrylamide, N-(2-methoxyethyl) (meth)acrylamide, N,N,-diallyl (meth)acrylamide, and N-allyl (meth)acrylamide.

Examples of styrenes include styrene, methyl styrene, dimethyl styrene, trimethyl styrene, ethyl styrene, isopropyl styrene, n-butyl styrene, tert-butyl styrene, methoxystyrene, butoxystyrene, acetoxystyrene, chlorostyrene, dichlorostyrene, bromostyrene, chloromethyl styrene, hydroxystyrene protected by a group (for example, t-Boc) that can be deprotected by an acidic substance, methylvinyl benzoate, and α-methyl styrene, and vinyl naphthalene. Among them, styrene and α-methyl styrene are preferred.

Examples of vinyl esters include vinyl acetate, vinyl chloroacetate, vinyl propionate, vinyl butyrate, vinyl methoxyacetate, and vinyl benzoate. Among them, vinyl acetate is preferred.

The aforementioned compounds can be used individually or in mixtures of two or more thereof.

The resin dispersant (A) in accordance with the present invention may be a random copolymer into which the structural units are introduced irregularly, or a block copolymer into which the structural units are introduced regularly. When resin dispersant is a block copolymer, the synthesis may be performed by introducing the structural units in any order and the same structural component may be used two or more times. From the standpoint of utility and productivity, it is preferred that the resin dispersant be a random copolymer.

Further, the molecular weight range of the resin dispersant (A) in accordance with the present invention is preferably 30,000 to 150,000, more preferably 30,000 to 100,000, and even more preferably 30,000 to 80,000 as represented by a weight-average molecular weight (Mw).

Setting the molecular weight within the aforementioned ranges is preferred because the steric repulsion effect of the dispersant tends to be good and the time for adsorption to a pigment tends to be eliminated by the steric effect.

The molecular weight distribution (represented by the ratio of the weight-average molecular weight to the number-average molecular weight) of the resin used in accordance with the present invention is preferably 1 to 6, more preferably 1 to 4.

Setting the molecular weight distribution within the aforementioned ranges is preferred from the standpoint of ink dispersion stability and ejection stability. The number-average molecular weight and weight-average molecular weight are a molecular weight detected with a differential refractometer by using THF as a solvent in a GPC analyzer employing TSKgel, GMHxL, TSKgel, G4000HxL, TSKgel, G2000HxL (all are trade names of products manufactured by Tosoh Co.) and represented by recalculation using polystyrene as a standard substance.

The resin dispersion (A) used in accordance with the present invention can be synthesized by a variety of polymerization methods, for example, by solution polymerization, precipitation polymerization, suspension polymerization, lump polymerization, and emulsion polymerization. The polymerization reaction can be carried out by conventional operations, for example, in a batch mode, a semi-continuous mode, or a continuous mode.

A method using a radical initiator and a method using irradiation with light or radiation are known as polymerization initiation methods. These polymerization methods and polymerization initiation methods are described in Teiji Tsuruda "Kobunshi Gosei Hoho", Kaiteiban (Nikkan Kogyo Shinbunsha Kan, 1971) and Takayuki Otsu, Masaetsu Kinoshita "Kobunshi Gosei-no Jikkenho" Kagaku Dojin, 1972, p. 124 to 154.

A solution polymerization method using radical initiation is especially preferred as the polymerization method. Examples of solvents that can be used in the solution polymerization method include a variety of organic solvents such as ethyl acetate, butyl acetate, acetone, methyl ethyl ketone, methyl isobutyl ketone, cyclohexaneone, tetrahydrofuran, dioxane, N,N-dimethylformamide, N,N-dimethylacetamide, benzene, toluene, acetonitrile, methylene chloride, chloroform, dichloroethane, methanol, ethanol, 1-propanol, 2-propanol, and 1-butanol. These solvents may be used individually or in mixtures of two or more thereof. A mixed solvent additionally containing water may be also used.

The polymerization temperature has to be set according to the molecular weight of the polymer to be synthesized and the type of polymerization initiator. Usually, the polymerization temperature is about 0° C. to 100° C., but it is preferred that the polymerization be conducted within a range of 50° C. to 100° C.

The reaction pressure can be set appropriately. Usually the reaction pressure is 1 kg/cm$^2$ to 100 kg/cm$^2$, and preferably 1 kg/cm$^2$ to 30 kg/cm$^2$. The reaction time is about 5 hours to 30 hours. The resin obtained may be subjected to purification such as reprecipitation.

The preferred specific examples of the resin dispersant (A) in accordance with the present invention are presented below, but the present invention is not limited thereto.

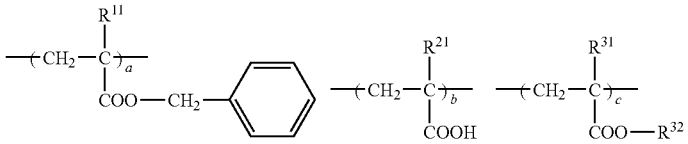

| | $R^{11}$ | $R^{21}$ | $R^{31}$ | $R^{32}$ | a | b | c | Mw |
|---|---|---|---|---|---|---|---|---|
| B-1 | $CH_3$ | $CH_3$ | $CH_3$ | —$CH_3$ | 60 | 10 | 30 | 46000 |
| B-2 | H | H | H | —$CH_3$ | 60 | 10 | 30 | 50000 |
| B-3 | $CH_3$ | $CH_3$ | $CH_3$ | —$CH_2CH_3$ | 61 | 10 | 29 | 43000 |
| B-4 | $CH_3$ | $CH_3$ | $CH_3$ | —$CH_2CH_2CH_2CH_3$ | 61 | 9 | 30 | 51000 |
| B-5 | $CH_3$ | $CH_3$ | $CH_3$ | —$CH_2(CH_3)CH_3$ | 60 | 9 | 31 | 96000 |
| B-6 | H | H | H | —$CH_2(CH_3)(CH_3)CH_3$ | 60 | 10 | 30 | 32000 |
| B-7 | $CH_3$ | $CH_3$ | $CH_3$ | —$CH_2CH(CH_3)CH_3$ | 60 | 5 | 30 | 75000 |

($_{a,b}$ and $_c$ represent respective compositions (wt %))

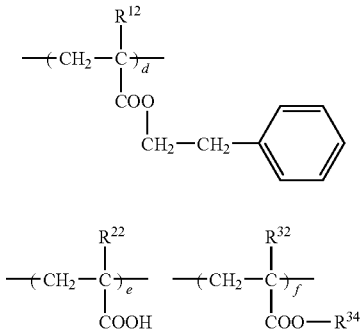

| | $R^{12}$ | $R^{22}$ | $R^{33}$ | $R^{34}$ | d | e | f | Mw |
|---|---|---|---|---|---|---|---|---|
| B-8 | $CH_3$ | $CH_3$ | $CH_3$ | —$CH_3$ | 55 | 12 | 33 | 31000 |
| B-9 | H | H | H | —CH2CH(CH3)CH3 | 70 | 10 | 20 | 34600 |

($_{d,e}$ and $_f$ represent respective compositions (wt %))

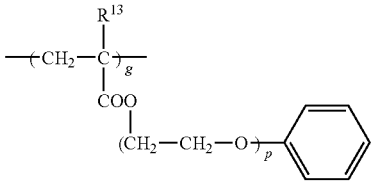
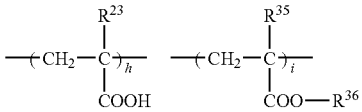
| | $R^{13}$ | p | $R^{23}$ | $R^{35}$ | $R^{36}$ | *g* | *h* | *i* | Mw |
|---|---|---|---|---|---|---|---|---|---|
| B-10 | $CH_3$ | 1 | $CH_3$ | $CH_3$ | —$CH_3$ | 60 | 9 | 31 | 35500 |
| B-11 | H | 1 | H | H | —$CH_2CH_3$ | 69 | 10 | 21 | 41200 |
| B-12 | $CH_3$ | 2 | $CH_3$ | $CH_3$ | —$CH_3$ | 70 | 11 | 19 | 68000 |
| B-13 | $CH_3$ | 4 | $CH_3$ | $CH_3$ | —$CH_2(CH_3)CH_3$ | 70 | 7 | 23 | 72000 |
| B-14 | H | 5 | H | H | —$CH_3$ | 70 | 10 | 20 | 86000 |
| B-15 | H | 5 | H | H | —$CH_2CH(CH_3)CH_3$ | 70 | 2 | 28 | 42000 |
($_{g,h}$ and $_i$ represent respective compositions (wt %))
| | | Mw |
|---|---|---|
| B-16 | 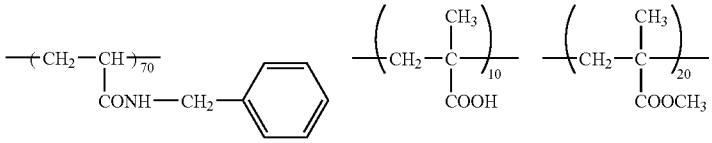 | 34300 |
| B-17 | 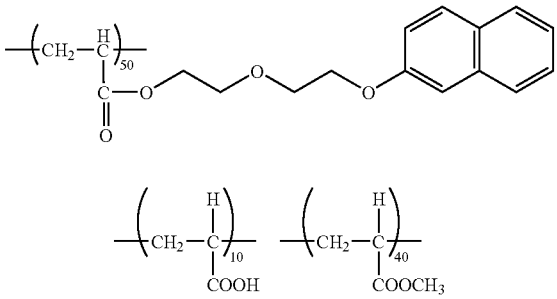 | 72400 |
| B-18 | 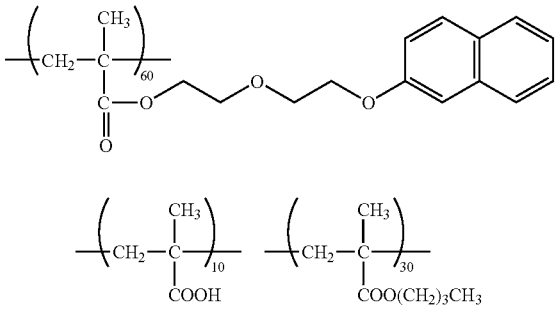 | 33800 |

-continued

| | | Mw |
|---|---|---|
| B-19 | 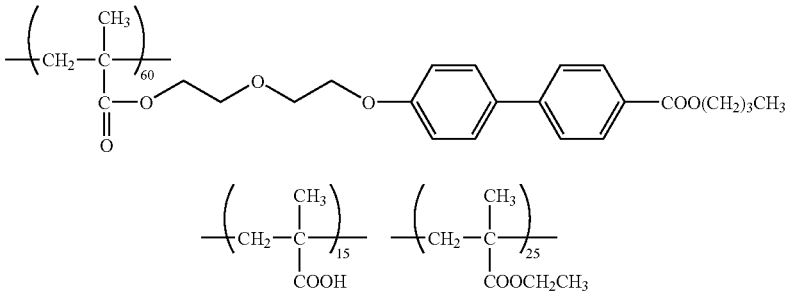 | 39200 |
| B-20 | 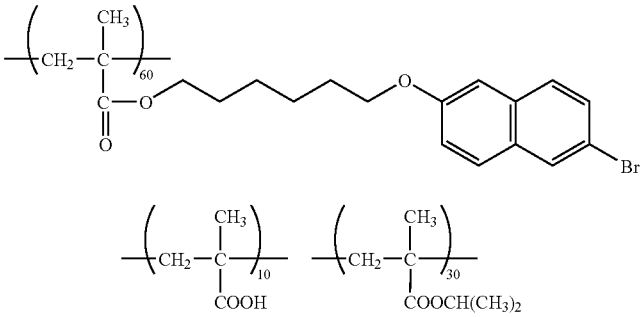 | 55300 |

<Ratio of Pigment (B) and Resin Dispersant (A)>

The weight ratio of the pigment (B) and resin dispersant (A) is preferably 100:25 to 100:140, more preferably 100:25 to 100:50. When the resin dispersant is present at a ratio not lower than 100:25, the dispersion stability and abrasion resistance tend to improve, and where the resin dispersant is present at a ratio of 100:140 or less, the dispersion stability tends to improve.

<Ratio of Pigment (B) and Resin Dispersant (A)>

The weight ratio of the pigment (B) and resin dispersant (A) is preferably 100:25 to 100:140, more preferably 100:25 to 100:50. When the resin dispersant is present at a ratio not lower than 100:25, the dispersion stability and abrasion resistance tend to improve, and where the resin dispersant is present at a ratio of 100:140 or less, the dispersion stability tends to improve.

<Pigment (B)>

In accordance with the present invention, the pigment (B) is a general term for color substances (including white color when the pigment is inorganic) that are practically insoluble in water and organic solvents, as described in Kagaku Daijiten (third edition), published on Apr. 1, 1994, (ed. by Michinori Oki), p. 518, and organic pigments and inorganic pigments can be used in accordance with the present invention.

Further, "the pigment (B) dispersed by the resin dispersant (A)" in the description of the present invention means a pigment that is dispersed and held by the resin dispersant (A) and is preferably used as a pigment that is dispersed and held by the resin dispersant (A) in the aqueous liquid medium (D). An additional dispersant may be optionally contained in the aqueous liquid medium (D).

The pigment (B) dispersed by the resin dispersant (A) in accordance with the present invention is not particularly limited, provided that it is a pigment that is dispersed and held by the resin dispersant (A). From the standpoint of pigment dispersion stability and ejection stability, microcapsulated pigments produced by a phase transition method are more preferred from among the aforementioned pigments.

A microcapsulated pigment represents a preferred example of the pigment (B) employed in accordance with the present invention. The microcapsulated pigment as referred to herein is a pigment coated by the resin dispersant (A).

The resin of the microcapsulated pigment has to use the resin dispersant (A), but it is preferred that a polymer compound having self-dispersibility or solubility in water and also having an anionic (acidic) group be used in a resin other than the resin dispersant (A).

<Manufacture of Microcapsulated Pigment>

A microcapsulated pigment can be prepared by conventional physical and chemical methods using the above-described components such as the resin dispersant (A). For example, a microcapsulated pigment can be prepared by methods disclosed in Japanese Patent Application Publication Nos. 9-151342, 10-140065, 11-209672, 11-172180, 10-025440, and 11-043636. Methods for manufacturing a microcapsulated pigments will be reviewed below.

A phase transition method or acid precipitation method described in Japanese Patent Application Publication Nos. 9-151342 and 10-140065 can be used as methods for manufacturing microcapsulated pigments, and among them the phase transition method is preferred from the standpoint of dispersion stability.

(a) Phase Transition Method

The phase transition method as referred to in the description of the present invention is basically a self-dispersion (phase transition emulsification) method by which a mixed melt of a pigment and a resin having sell-dispersibility or solubility is dispersed in water. The mixed melt may also include the above-described curing agent or polymer compound. The mixed melt as referred to herein is presumed to include a state obtained by mixing without dissolution, a state obtained by mixing with dissolution, and both these states. A more specific manufacturing method of the "phase transition method" may be identical to that disclosed in Japanese Patent Application Publication No. 10-140065.

(b) Acid Precipitation Method

The acid precipitation method as referred to in the description of the present invention is a method for manufacturing a microcapsulated pigment by using a water-containing cake composed of a resin and a pigment and neutralizing all or some of the anionic groups contained in the resin within the water-containing cake by using a basic compound.

More specifically, the acid precipitation method includes the steps of: (1) dispersing a resin and a pigment in an alkaline aqueous medium and, if necessary, performing a heat treatment to gel the resin; (2) hydrophobizing the resin by obtaining neutral or acidic pH and strongly fixing the resin to the pigment; (3) if necessary, performing filtration and water washing to obtain a water-containing cake; (4) neutralizing all or some of the anionic groups contained in the resin in the water-containing cake by using a basic compound and then re-dispersing in an aqueous medium; and (5) if necessary, performing a heat treatment and gelling the resin.

More specific manufacturing methods of the above-described phase transition method and acid precipitation method may be identical to those disclosed in Japanese Patent Application Publication Nos. 9-151342 and 10-140065. Methods for manufacturing coloring agents described in Japanese Patent Application Publication Nos. 11-209672 and 11-172180 can be also used in accordance with the present invention.

The preferred manufacturing method in accordance with the present invention basically includes the following manufacturing steps: (1) mixing a resin having an anionic group or a solution obtained by dissolving the resin in an organic solvent with an aqueous solution of a basic compound to cause neutralization; (2) admixing a pigment to the mixed liquid to form a suspension and then dispersing the pigment with a dispersing apparatus to obtain a pigment dispersion; (3) if necessary, removing the solvent by distillation and obtaining an aqueous dispersion in which the pigment is coated with the resin having an anionic group.

In accordance with the present invention, kneading and dispersion treatment mentioned hereinabove can be performed using, for example, a ball mill, a roll mill, a beads mill, a high-pressure homogenizer, a high-speed stirring dispersing apparatus, and an ultrasound homogenizer.

<Pigment B>

The following pigments can be used in accordance with the present invention. Thus, examples of yellow ink pigments include C. I. Pigment Yellow 1, 2, 3, 4, 5, 6, 7, 10, 11, 12, 13, 14, 14C, 16, 17, 24, 34, 35, 37, 42, 53, 55, 65, 73, 74, 75, 81, 83, 93, 95, 97, 98, 100, 101, 104, 108, 109, 110, 114, 117, 120, 128, 129, 138, 150, 151, 153, 154, 155, 180.

Examples of magenta ink pigments include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 48 (Ca), 48 (Mn), 48:2, 48:3, 48:4, 49, 49:1, 50, 51, 52, 52:2, 53:1, 53, 55, 57 (Ca), 57:1, 60, 60:1, 63:1, 63:2, 64, 64:1, 81, 83, 87, 88, 89, 90, 101 (Bengal), 104, 105, 106, 108 (cadmium red), 112, 114, 122 (quinacridone magenta), 123, 146, 149, 163, 166, 168, 170, 172, 177, 178, 179, 184, 185, 190, 193, 202, 209, 219. Among them, C. I. Pigment Red 122 is especially preferred.

Examples of cyan ink pigments include C. I. Pigment Blue 1, 2, 3, 15, 15:1, 15:2, 15:3, 15:4, 16, 17:1, 22, 25, 56, 60, C. I. Vat Blue 4, 60, 63. Among them, C. I. Pigment Blue 15:3 is especially preferred.

Examples of other color ink pigments include C. I. Pigment Orange 5, 13, 16, 17, 36, 43, 51, C. I. Pigment Green 1, 4, 7, 8, 10, 17, 18, 36, C. I. Pigment Violet 1 (Rhodamine Lake), 3, 5:1, 16, 19 (quinacridone red), 23, 28. Processed pigments such as graft carbon that are obtained by treating the pigment surface with a resin or the like can be also used.

Carbon black is an example of a black pigment. Specific examples of carbon black include No. 2300, No. 900, MCF88, No. 33, No. 40, No. 45, No. 52, MA 7, MA8, MA100, and No. 2200B manufactured by Mitsubishi Chemical, Raven 5750, Raven 5250, Raven 5000, Raven 3500, Raven 1255, and Raven 700 manufactured by Colombia, Regal 400R, Regal 1330R, Regal 1660R, Mogul L, Monarch 700, Monarch 800, Monarch 880, Monarch 900, Monarch 1000, Monarch 1100, Monarch 1300, and Monarch 1400 manufactured by Cabot Corp., and Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, and Special Black 4 manufactured by Degussa Co., Ltd.

The aforementioned pigments may be used individually or in combinations obtained by selecting a plurality of pigments in each of the above-described groups or a plurality of pigments from different groups.

From the standpoint of dispersion stability and concentration of the aqueous ink, the content ratio of the pigment (B) in the aqueous ink in accordance with the present invention is preferably 1 wt % to 10 wt %, more preferably 2 wt % to 8 wt %, and even more preferably 2 wt % to 6 wt %.

<Self-Dispersible Polymer Microparticles>

The aqueous ink used in accordance with the present invention includes self-dispersible polymer microparticles of at least one kind. Self-dispersible polymer microparticles as referred to herein mean microparticles of a water-insoluble polymer containing no free emulsifying agent, this water-insoluble polymer being capable of assuming a dispersion state in an aqueous medium under the effect of functional groups (especially acidic groups or salt thereof) of the resin itself, without the presence of another surfactant.

The dispersion state as referred to herein includes both an emulsion state (emulsion) in which the water-insoluble polymer is dispersed in a liquid state in the aqueous medium and a dispersion state (suspension) in which the water-insoluble polymer is dispersed in a solid state in the aqueous medium.

From the standpoint of ink stability and ink aggregation speed in the case the water-insoluble polymer is contained in a water-soluble ink, it is preferred that the water-insoluble polymer in accordance with the present invention be a water-insoluble polymer that can assume a dispersion state in which the water-insoluble polymer is dispersed in a solid state.

The dispersion state of the self-dispersible polymer microparticles in accordance with the present invention represents a state such that the presence of a dispersion state can be visually confirmed with good stability at least over a week at a temperature of 25° C. in a system obtained by mixing a solution obtained by dissolving 30 g of a water-insoluble polymer in 70 g of an organic solvent (for example, methyl ethyl ketone), a neutralizing agent capable of 100% neutralization of salt-forming groups of the water-insoluble polymer (where the salt-forming group is anionic, the neutralizing agent is sodium hydroxide, and where the salt-forming group is cationic, the neutralizing agent is acetic acid), and 200 g water, stirring (apparatus: stirring apparatus equipped with a stirring impeller, revolution speed 200 rpm, 30 min 25° C.), and then removing the organic solvent from the mixed liquid.

The water-insoluble polymer as referred to herein is a resin that dissolves in an amount of 10 g or less when dried for 2 hours at 105° C. and then dissolved in 100 g of water at 25° C.

The amount dissolved is preferably not more than 5 g, more preferably not more than 1 g. The amount dissolved refers to a state upon 100% neutralization with sodium hydroxide or acetic acid, correspondingly to the type of the salt-forming group of the water-insoluble polymer.

The aqueous medium may be composed of water or, if necessary, may also include a hydrophilic organic solvent. In accordance with the present invention, a composition including water and a hydrophilic organic solvent at a content ratio not more than 0.2 wt % with respect to the water is preferred, and a composition including only water is more preferred.

A main chain skeleton of the water-insoluble polymer is not particularly limited and a vinyl polymer or a condensation polymer (an epoxy resin, a polyester, a polyurethane, a polyamide, cellulose, a polyether, a polyurea, a polyimide, a polycarbonate, etc.) can be used. Among them, a vinyl polymer is preferred.

The preferred examples of vinyl polymers and monomers constituting vinyl polymers are described in Japanese Patent Application Publication Nos. 2001-181549 and 2002-088294. A vinyl polymer having a dissociative group introduced into the end of the polymer chain by radical polymerization of a vinyl monomer using a chain transfer agent, a polymerization initiator, or an iniferter having a dissociative group (or a substituent that can derive a dissociative group) or by ion polymerization using a compound having a dissociative group (or a substituent that can derive a dissociative group) for either an initiator or a stopping agent can be also used.

The preferred examples of condensation polymers and monomers constituting the condensation polymers are described in Japanese Patent Application Publication No. 20001-247787.

From the standpoint of self-dispersibility, it is preferred that the self-dispersible polymer microparticles in accordance with the present invention include a water-insoluble polymer including a hydrophilic structural unit and a structural unit derived from a monomer having an aromatic group.

The hydrophilic structural unit is not particularly limited provided that it is derived from a monomer including a hydrophilic group, and this structural unit may be derived from one monomer having a hydrophilic group or two or more monomers having a hydrophilic group. The hydrophilic group is not particularly limited and may be a dissociative group or a nonionic hydrophilic group.

From the standpoint of enhancing the self dispersion and also from the standpoint of stability of emulsion or dispersion state that has been formed, it is preferred that the hydrophilic group in accordance with the present invention be a dissociative group, more preferably an anionic dissociative group. Examples of dissociative groups include a carboxyl group, a phosphate group, and a sulfonate group. Among them, from the standpoint of fixing ability when the ink composition is configured, a carboxyl group is preferred.

From the standpoint of self-dispersibility and aggregation ability, it is preferred that the monomer having a hydrophilic group in accordance with the present invention be a monomer having a dissociative group, more preferably a monomer having a dissociative group that has a dissociative group and an ethylenic unsaturated body.

Examples of suitable monomers having a dissociative group include an unsaturated carboxylic acid monomer, an unsaturated sulfonic acid monomer, and an unsaturated phosphoric acid monomer.

Specific examples of the unsaturated carboxylic acid monomer include acrylic acid, methacrylic acid, crotonic acid, itaconic acid, maleic acid, fumaric acid, citraconic acid, and 2-methacryloyloxymethylsuccinic acid. Specific examples of the unsaturated sulfonic acid monomer include styrenesulfonic acid, 2-acrylamido-2-methylpropanesulfonic acid, 3-sulfopropyl (meth)acrylate, and bis-(3-sulfopropyl)-itaconic acid esters. Specific examples of the unsaturated phosphoric acid monomer include vinylphosphonic acid, vinyl phosphate, bis(methacryloxyethyl) phosphate, diphenyl-2-acryloyloxyethyl phosphate, diphenyl-2-methacryloyloxyethyl phosphate, dibutyl-2-acryloyloxyethyl phosphate.

Among the monomers including a dissociative group, from the standpoint of dispersion stability and ejection stability, unsaturated carboxylic acid monomers are preferred and acrylic acid and methacrylic acid are especially preferred.

From the standpoint of self-dispersibility and aggregation speed during contact with a reaction liquid, it is preferred that the self-dispersible polymer microparticles in accordance with the present invention include a first polymer having a carboxyl group and an acid value (mg KOH/g) of 25 to 100. Furthermore, from the standpoint of self-dispersibility and aggregation speed during contact with a reaction liquid, it is preferred that the acid value be 25 to 80, more preferably 30 to 65. Where the acid value is not lower than 25, good stability of self-dispersibility is obtained. Where the acid value is not higher than 100, aggregation ability is improved.

The monomer including an aromatic groups is not particularly limited, provided it is a compound having an aromatic group and a polymerizable group. The aromatic group may be a group derived from an aromatic hydrocarbon or a group derived from an aromatic hetero ring. In accordance with the present invention, from the standpoint of particle shape stability in the aqueous medium, it is preferred that the aromatic group be derived from an aromatic hydrocarbon.

The polymerizable group may be a condensation polymerizable group or an addition polymerizable group. In accordance with the present invention, from the standpoint of particle shape stability in the aqueous medium, it is preferred that the polymerizable group be an addition polymerizable group, more preferably a group including an ethylenic unsaturated bond.

The monomer including an aromatic group in accordance with the present invention is preferably a monomer having an aromatic group derived from an aromatic hydrocarbon and an ethylenic unsaturated body, more preferably a (meth)acrylate monomer including an aromatic group. In accordance with the present invention, the monomer including an aromatic group of one kind may be used or a combination of monomers of two or more kinds may be used.

Examples of the monomer including an aromatic group include phenoxyethyl (meth)acrylate, benzyl (meth)acrylate, phenyl (meth)acrylate, and styrene monomers. Among them, from the standpoint of hydrophilic-hydrophobic balance of the polymer chain and ink fixing ability, it is preferred that the monomer including an aromatic group be of at least of one kind selected from phenoxyethyl (meth)acrylate, benzyl (meth)acrylate, and phenyl (meth)acrylate. Among them, phenoxyethyl (meth)acrylate is preferred, and phenoxyethyl acrylate is even more preferred.

"(Meth)acrylate" means acrylate or methacrylate.

The self-dispersible polymer microparticles in accordance with the present invention include a structural unit derived from a (meth)acrylate monomer including an aromatic group, and the content ratio thereof is preferably 10 wt % to 95 wt %. Where the content ratio of the (meth)acrylate monomer including an aromatic group is 10 wt % to 95 wt %, the stability of self-emulsion or dispersion state is improved. In addition, the increase in ink viscosity can be inhibited.

In accordance with the present invention, from the standpoint of stability of the self-dispersion state, stabilization of particle shape in the aqueous medium by hydrophobic interaction of aromatic rings with each other, and decrease in the amount of water-soluble components caused by adequate hydrophobization of the particles, it is preferred that the content ratio of the (meth)acrylate monomer including an aromatic group be 15 wt % to 90 wt %, preferably 15 wt % to 80 wt %, more preferably 25 wt % to 70 wt %.

The self-dispersible polymer microparticles in accordance with the present invention can be configured, for example, by a structural unit including a monomer having an aromatic group and a structural unit including a monomer having a dissociative group. If necessary, the microparticles may also include other structural units.

The monomers forming other structural units are not particularly limited, provided that they are monomers copolymerizable with the monomer having an aromatic group and the monomer having a dissociative group. Among them, from the standpoint of flexibility of the polymer skeleton and easiness of controlling the glass transition temperature (Tg), a monomer including an alkyl group is preferred.

Examples of the monomer including an alkyl group include alkyl (meth)acrylates such as methyl (meth)acrylate, ethyl (meth)acrylate, isopropyl (meth)acrylate, n-propyl (meth)acrylate, n-butyl (meth)acrylate, isobutyl (meth)acrylate, t-butyl (meth)acrylate, hexyl (meth)acrylate, and ethylhexyl (meth)acrylate; ethylenic unsaturated monomers having a hydroxyl group, such as hydroxymethyl (meth)acrylate, 2-hydroxyethyl (meth)acrylate, 2-hydroxypropyl (meth) acrylate, 4-hydroxybutyl (meth)acrylate, hydroxypentyl (meth)acrylate, and hydroxyhexyl (meth)acrylate; dialkylaminoalkyl (meth)acrylates such as dimethylaminoethyl (meth)acrylate; N-hydroxyalkyl (meth)acrylamides such as N-hydroxymethyl (meth)acrylamide, N-hydroxyethyl (meth)acrylamide, and N-hydroxybutyl (meth)acrylamide; and (meth)acrylamides such as N-alkoxyalkyl (meth)acrylamides, for example, N-methoxymethyl (meth)acrylamide, N-ethoxymethyl (meth)acrylamide, N-(n-, iso)butoxymethyl (meth)acrylamide, N-methoxyethyl (meth)acrylamide, N-ethoxyethyl (meth)acrylamide, and N-(n-, iso)butoxyethyl (meth)acrylamide.

The molecular weight range of the water-insoluble polymer constituting the self-dispersible polymer microparticles in accordance with the present invention is preferably 3000 to 200,000, more preferably 50000 to 150,000, even more preferably 10,000 to 100,000, as a weight-average molecular weight. Where the weight-average molecular weight is not less than 3000, the amount of water-soluble components can be effectively inhibited. Where the weight-average molecular weight is not more than 200,000, self-dispersion stability can be increased. The weight-average molecular weight can be measured by gel permeation chromatography (GPC).

From the standpoint of controlling the hydrophilicity and hydrophobicity of the polymer, it is preferred that the water-insoluble polymer constituting the self-dispersible polymer microparticles in accordance with the present invention include a (meth)acrylate monomer including an aromatic group at a copolymerization ratio of 15 wt % to 90 wt %, a monomer including a carboxyl group, and a monomer including an alkyl group, have an acid value of 25 to 100, and have a weight-average molecular weight of 3000 to 200,000. It is even more preferred that the water-insoluble polymer constituting the self-dispersible polymer microparticles include a (meth)acrylate monomer including an aromatic group at a copolymerization ratio of 15 wt % to 80 wt %, a monomer including a carboxyl group, and a monomer including an alkyl group, have an acid value of 25 to 95, and have a weight-average molecular weight of 5000 to 150,000.

Exemplary Compounds B-01 to B-19 are presented below as specific examples of the water-insoluble polymer constituting the self-dispersible polymer microparticles, but the present invention is not limited thereto. The weight ratio of the copolymer components is shown in the parentheses.

B-01: phenoxyethyl acrylate-methyl methacrylate-acrylic acid copolymer (50/45/5).

B-02: phenoxyethyl acrylate-benzyl methacrylate-isobutyl methacrylate-methacrylic acid copolymer (30/35/29/6).

B-03: phenoxyethyl methacrylate-isobutyl methacrylate-methacrylic acid copolymer (50/44/6).

B-04: phenoxyethyl acrylate-methyl methacrylate-ethyl acrylate-acrylic acid copolymer (30/55/10/5).

B-05: benzyl methacrylate-isobutyl methacrylate-methacrylic acid copolymer (35/59/6).

B-06: styrene-phenoxyethyl acrylate-methyl methacrylate-acrylic acid copolymer (10/50/35/5).

B-07: benzyl acrylate-methyl methacrylate-acrylic acid copolymer (55/40/5).

B-08: phenoxyethyl methacrylate-benzyl acrylate-methacrylic acid copolymer (45/47/8).

B-09: styrene-phenoxyethyl acrylate-butyl methacrylate-acrylic acid copolymer (May 48, 1940/7).

B-10: benzyl methacrylate-isobutyl methacrylate-cyclohexyl methacrylate-methacrylic acid copolymer (35/30/30/5).

B-11: phenoxyethyl acrylate-methyl methacrylate-butyl acrylate-methacrylic acid copolymer (12/50/30/8).

B-12: benzyl acrylate-isobutyl methacrylate-acrylic acid copolymer (93/2/5).

B-13: styrene-phenoxyethyl methacrylate-butyl acrylate-acrylic acid copolymer (50/5/20/25).

B-14: styrene-butyl acrylate-acrylic acid copolymer (62/35/3).

B-15: methyl methacrylate-phenoxyethyl acrylate-acrylic acid copolymer (45/51/4).

B-16: methyl methacrylate-phenoxyethyl acrylate-acrylic acid copolymer (45/49/6).

B-17: methyl methacrylate-phenoxyethyl acrylate-acrylic acid copolymer (45/48/7).

B-18: methyl methacrylate-phenoxyethyl acrylate-acrylic acid copolymer (45/47/8).

B-19: methyl methacrylate-phenoxyethyl acrylate-acrylic acid copolymer (45/45/10).

A method for manufacturing the water-insoluble polymer constituting the self-dispersible polymer microparticles in accordance with the present invention is not particularly limited. Examples of suitable methods include a method for performing emulsion polymerization in the presence of a polymerizable surfactant and inducing covalent coupling of the surfactant and a water-insoluble polymer and a method for copolymerizing a monomer mixture including the above-described monomer including a hydrophilic group and the monomer including an aromatic group by a well-known polymerization method such as a solution polymerization method and a lump polymerization method. Among the aforementioned polymerization methods, from the standpoint of aggregation speed and stability of deposition in the case of an aqueous ink, the solution polymerization method is preferred, and a solution polymerization method using an organic solvent is more preferred.

From the standpoint of aggregation speed, it is preferred that the self-dispersible polymer microparticles in accordance with the present invention include a first polymer synthesized in an organic solvent and that this first polymer be prepared as a resin dispersion having carboxyl groups and an acid number of 20 to 100, wherein at least some of carboxyl groups of the first polymer are neutralized and water is contained as a continuous phase.

Thus, the method for manufacturing the self-dispersible polymer microparticles in accordance with the present invention preferably includes a step of synthesizing the first polymer in an organic solvent and a dispersion step of obtaining an aqueous dispersion in which at least some of carboxyl groups of the first polymer are neutralized.

The dispersion step preferably includes the following step (1) and step (2).

Step (1): a step of stirring a mixture including a first polymer (water-insoluble polymer), an organic solvent, a neutralizing agent, and an aqueous medium.

Step (2): a step of removing the organic solvent from the mixture.

The step (1) is preferably a treatment in which the first polymer (water-insoluble polymer) is dissolved in an organic solvent, then the neutralizing agent and aqueous medium are gradually added, the components are mixed and stirred, and a dispersion is obtained. By adding the neutralizing agent and aqueous medium to a solution of the water-insoluble polymer obtained by dissolving in an organic solvent, it is possible to obtain self-dispersible polymer particles of a particle size that ensures higher stability in storage. The method for stirring the mixture is not particularly limited and a mixing and stirring apparatus of general use and, if necessary, a dispersing apparatus such as an ultrasound dispersing apparatus or a high-pressure homogenizer can be used.

An alcohol-based solvent, a ketone-based solvent, or an ether-based solvent is preferred as the organic solvent. Examples of the alcohol-based solvent include isopropyl alcohol, n-butanol, t-butanol, and ethanol. Examples of ketone solvents include acetone, methyl ethyl ketone, diethyl ketone, and methyl isobutyl ketone. Examples of ether solvents include dibutyl ether and dioxane. Among these solvents, ketone-based solvents such as methyl ethyl ketone and alcohol-based solvents such as isopropyl alcohol are preferred. Further, with the object of moderating the variations of polarity in a phase transition from an oil system to an aqueous system, it is preferred that isopropyl alcohol and methyl ethyl ketone be used together. Where the two solvents are used together, aggregation and precipitation and also fusion of particles with each other are prevented and self-dispersible polymer microparticles of a fine particle size and high dispersion stability can be obtained.

The neutralizing agent is used so that the dissociative groups be partially or completely neutralized and the self-dispersible polymer form a stable emulsion or dispersion state in water. When the self-dispersible polymer in accordance with the present invention has anionic dissociative groups (for example, carboxyl groups) as the dissociative groups, basic compounds such as organic amine compounds, ammonia, and alkali metal hydroxides can be used as the neutralizing agent. Examples of the organic amine compounds include monomethylamine, dimethylamine, trimethylamine, monoethylamine, diethylamine, triethylamine, monopropylamine, dipropylamine, monoethanolamine, diethanolamine, triethanolamine, N,N-dimethylethanolamine, N,N-diethylethanolamine, 2-dimethylamino-2-methyl-1-propanol, 2-amino-2-methyl-1-propanol, N-methyldiethanolamine, N-ethyldiethanolamine, monoisopropanolamine, diisopropanolamine, and triisopropanolamine. Examples of alkali metal hydroxides include lithium hydroxide, sodium hydroxide, and potassium hydroxide. Among them, from the standpoint of stabilizing the dispersion of the self-dispersible polymer microparticles in accordance with the present invention in water, sodium hydroxide, potassium hydroxide, triethylamine, and triethanolamine are preferred.

These basic compounds are used preferably at 5 mol % to 120 mol %, more preferably 10 mol % to 110 mol %, and even more preferably 15 mol % to 100 mol % per 100 mol of dissociative groups. Where the ratio of the basic compound is not less than 15 mol %, the stabilization effect of particle dispersion in water is demonstrated, and where the ratio is not more than 100 mol %, the amount of water-soluble components is decreased.

In the step (2), the organic solvent is distilled out by the usual method such as vacuum distillation from the dispersion obtained in the step (1), thereby inducing phase transition to an aqueous system and making it possible to obtain an aqueous dispersion of self-dispersible polymer particles. The organic solvent contained in the obtained aqueous dispersion is substantially removed, and the amount of organic solvent is preferably not more than 0.2 wt %, more preferably not more than 0.1 wt %.

The mean particle size of the self-dispersible polymer microparticles in accordance with the present invention is preferably within a range of 10 nm to 400 nm, more preferably 10 nm to 200 nm, and even more preferably 10 nm to 100 nm. Particles with a mean size of 10 nm or more are more suitable for manufacture. Where the mean particle size is not more than 400 nm, stability in storage is improved.

The particle size distribution of the self-dispersible polymer microparticles in accordance with the present invention is not particularly limited, and particles with a wide particle size distribution or a monodisperse particle size distribution may be used. Furthermore, water-insoluble particles of two or more kinds may be used as a mixture.

The mean particle size and particle size distribution of the self-dispersible polymer microparticles can be measured, for example, by using a light scattering method.

The self-dispersible polymer microparticles in accordance with the present invention can be advantageously contained in an aqueous ink composition, and the particles of one kind may be used individually, or particles of two or more kinds may be used together.

<Aqueous Liquid Medium (D)>

In the aqueous ink of the inkjet recording system, the aqueous liquid medium (D) represents a mixture of water and a water-soluble organic solvent. The water-soluble organic solvent (also can be referred to hereinbelow as "solvent medium") is used as a drying preventing agent, wetting agent, and penetrating agent.

A drying preventing agent is used with the object of preventing the ink ejection port of a nozzle from clogging by the dried inkjet ink. A water-soluble organic solvent with a vapor pressure lower than that of water is preferred as the drying preventing agent and wetting agent. Further, a water-soluble organic solvent can be advantageously used as a penetrating agent with the object of ensuring better penetration of the ink for inkjet printing into the recording medium (paper and the like).

Examples of water-soluble organic solvents include alkane diols (polyhydric alcohols) such as glycerin, 1,2,6-hexanetriol, trimethylolpropane, ethylene glycol, propylene glycol, diethylene glycol, triethylene glycol, tetraethylene glycol, pentaethylene glycol, dipropylene glycol, 2-butene-1,4-diol, 2-ethyl-1,3-hexanediol, 2-methyl-2,4-pentanediol, 1,2-octanediol, 1,2-hexanediol, 1,2-pentanediol, and 4-methyl-1,2-pentanediol; sugars such as glucose, mannose, fructose, ribose, xylose, arabinose, galactose, aldonic acid, glucitol (sorbit), maltose, cellobiose, lactose, sucrose, trehalose, and maltotriose; sugar alcohols; hyaluronic acids; the so-called solid wetting agents such as urea; alkyl alcohols having 1 to 4 carbon atoms such as ethanol, methanol, butanol, propanol, and isopropanol, glycol ethers such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-n-butyl ether, propylene glycol mono-n-propyl ether, propylene glycol mono-iso-propyl ether, dipropylene glycol monomethyl ether, dipropylene glycol monoethyl ether, dipropylene glycol mono-n-propyl ether, and dipropylene glycol mono-iso-propyl ether; 2-pyrrolidone, N-methyl-2-pyrrolidone, 1,3-dimethyl-2-imidazolidinone, formamide, acetamide, dimethylsulfoxide, sorbit, sorbitan, acetin, diacetin, triacetin, and sulfolan. These compounds can be used individually or in combinations of two or more thereof.

A polyhydric alcohol is useful as a drying preventing agent or a wetting agent. Examples of suitable polyhydric alcohols include glycerin, ethylene glycol, diethylene glycol triethylene glycol, propylene glycol, dipropylene glycol, tripropylene glycol, 1,3-butanediol, 2,3-butanediol, 1,4-butanediol, 3-methyl-1,3-butanediol, 1,5-pentanediol, tetraethylene glycol, 1,6-hexanediol, 2-methyl-2,4-pentanediol, polyethylene glycol, 1,2,4-butanetriol, and 1,2,6-hexanetriol. These alcohols can be used individually or in combinations of two or more thereof.

A polyol compound is preferred as a penetrating agent. Examples of aliphatic diols include 2-ethyl-2-methyl-1,3-propanediol, 3,3,-dimethyl-1,2,-butanediol, 2,2-diethyl-1,3-propanediol, 2-methyl-2-propyl-1,3-propanediol, 2,4-dimethyl-2,4-pentanediol, 2,5-dimethyl-2,5-hexanediol, 5-hexene-1,2-diol, and 2-ethyl-1,3-hexanediol. Among them, 2-ethyl-1,3-hexanediol and 2,2,4-trimethyl-1,3-pentanediol are preferred.

The water-soluble organic solvents may be used individually or in mixtures of two or more thereof. The content ratio of the water-soluble organic solvent in the ink is preferably not less than 1 wt % and not more than 60 wt %, more preferably not less than 5 wt % and not more than 40 wt %.

The amount of water added to the ink is not particularly limited, but it is preferably not less than 10 wt % and not more than 99 wt %, more preferably not less than 30 wt % and not more than 80 wt %. It is especially preferred that the amount of water be not less than 50 wt % and not more than 70 wt %, From the standpoint of dispersion stability and ejection stability, it is preferred that the content ratio of the aqueous liquid medium (D) in accordance with the present invention be not less than 60 wt % and not more than 95 wt %, more preferably not less than 70 wt % and not more than 95 wt %.

<Surfactant>

It is preferred that a surfactant (can be also referred to hereinbelow as "surface tension adjusting agent") be added to the aqueous ink in accordance with the present invention. Examples of surfactants include nonionic, cationic, anionic, and betaine surfactants. The amount of the surface tension adjusting agent added to the ink is preferably such as to adjust the surface tension of the aqueous ink in accordance with the present invention to 20 mN/m to 60 mN/m, more preferably to 20 mN/m to 45 mN/m, and even more preferably to 25 mN/m to 40 mN/m, in order to eject the ink with an ink jet.

A compound having a structure having a combination of a hydrophilic portion and a hydrophobic portion in a molecule can be effectively used as the surfactant, and anionic surfactants, cationic surfactants, amphoteric surfactants, and nonionic surfactants can be used. Furthermore, the above-described polymer substance (polymer dispersant) can be also used as the surfactant.

Specific examples of anionic surfactants include sodium dodecylbenzenesulfonate, sodium lauryl sulfate, sodium alkyldiphenyl ether disulfonates, sodium alkyl naphthalenesulfonate, sodium dialkylsulfosuccinates, sodium stearate, potassium oleate, sodium dioctylsulfosuccinate, polyoxyethylene alkyl ether sulfuric acid sodium, polyoxyethylene alkyl ether sulfuric acid sodium, polyoxyethylene alkyl phenyl ether sulfuric acid sodium, sodium dialkylsulfosuccinates, sodium stearate, sodium oleate, and t-octylphenoxyethoxypolyethoxyethyl sulfuric acid sodium salt. These surfactants can be used individually or in combinations of two or more thereof.

Specific examples of nonionic surfactants include polyoxyethylene laurylether, polyoxyethylene octyl phenyl ether, polyoxyethylene oleyl phenyl ether, polyoxyethylene nonyl phenyl ether, oxyethylene oxypropylene block copolymer, t-octyl phenoxyethyl polyethoxy ethanol, nonyl phenoxyethyl polyethoxy ethanol. These surfactants can be used individually or in combinations of two or more thereof.

Examples of cationic surfactants include tetraalkylammonium salts, alkylamine salts, benzalkonium salts, alkylpyridium salts, and imidazolium salts. Specific examples include dihydroxyethylstearylamine, 2-heptadecenyl-hydroxyethyl imidazoline, lauryldimethylbenzyl ammonium chloride, cetyl pyridinium chloride, and stearamidomethylpyridium chloride.

The amount of the surfactant added to the aqueous ink for inkjet recording in accordance with the present invention is not particularly limited, but preferably this amount is not less than 1 wt %, more preferably 1 wt % to 10 wt %, and even more preferably 1 wt % to 3 wt %.

<Other Components>

The aqueous ink used in accordance with the present invention may also include other additives. Examples of other additives include such well-known additives as an ultraviolet absorbent, a fading preventing agent, an antimold agent, a pH adjusting agent, an antirust agent, an antioxidant, an emulsion stabilizer, a preservative, an antifoaming agent, a viscosity adjusting agent, a dispersion stabilizer, and a chelating agent.

Examples of the ultraviolet absorbent include a benzophenone-type ultraviolet absorbent a benzotriazole-type ultraviolet absorbent, a salicylate-type ultraviolet absorbent, a cyanoacrylate ultraviolet absorbent, and a nickel complex-type ultraviolet absorbent.

Examples of the fading preventing agent include agents of a variety of organic and metal complex systems. Examples of organic fading preventing agents include hydroquinones, alkoxyphenols, dialkoxyphenols, phenols, anilines, amines, indanes, coumarones, alkoxyanilines, and hetero rings. Examples of metal complexes include nickel complexes and zinc complexes.

Examples of the antimold agent include sodium dehydroacetate, sodium benzoate, sodium pyridinethione-1-oxide, p-hydroxybenzoic acid ethyl ester, 1,2-benzisothiazoline-3-one, sodium sorbitate, and pentachlorophenol sodium. The antimold agent is preferably used at 0.02 wt % to 1.00 wt % in the ink.

The pH adjusting agent is not particularly limited, provided that it can adjust the pH to a desired value, without adversely affecting the prepared recording ink, and the agent can be selected appropriately according to the object. Examples of suitable agents include alcohol amines (for example, diethanolamine, triethanolamine, and 2-amino-2-ethyl-1,3-propanediol), alkali metal hydroxides (for example, lithium hydroxide, sodium hydroxide, and potassium hydroxide), ammonium hydroxides (for example, ammonium hydroxide and quaternary ammonium hydroxide), phosphonium hydroxide, and alkali metal carbonates.

Examples of antirust agents include acidic sulfites, sodium thiosulfate, ammonium thiodiglycolate, diisoproplylammonium nitrate, pentaerythritol tetranitrate, dicyclohexyl ammonium nitrite.

Examples of the antioxidant include phenolic antioxidants (including hindered phenol antioxidants), amine antioxidants, sulfur-containing antioxidants, and phosphorus-containing antioxidants.

Examples of the chelating agent include ethylenediaminetetracetatic acid sodium salt, nitrilotriacetic acid sodium salt, hydroxyethylethylenediaminetriacetic acid sodium salt, diethylenetriaminepentaacetic acid sodium salt, and uramyldiacetic acid sodium salt.

EXAMPLES

Experiment A

There follows a description of experiments carried out to compare the image quality (present invention) obtained when each of the inkjet recording apparatus and the aqueous ink used in image formation satisfy the conditions of the present invention and the image quality (comparative examples) obtained when at least one of the inkjet recording apparatus and the aqueous ink used in image formation does not satisfy the conditions of the present invention.

<The Inkjet Recording Apparatus Used in the Experiments>

On the treatment liquid drum 54 (diameter 450 mm), treatment liquid was applied in a thin film (having a thickness of 2 μm) by the treatment liquid application unit 56 onto the whole surface of a recording medium 22 taken up onto the image formation drum 70 from the paper feed unit 10 of the inkjet recording apparatus shown in FIG. 1. In this, a gravure roller was used as the treatment liquid application unit 56. Thereupon, the recording medium 22 onto which the treatment liquid had been applied was dried by means of the warm-air blow-out nozzle 58 (temperature 70° C., 9 $m^3$/min. blow rate) and the IR heater 60 (180° C.), thereby drying a portion of the solvent in the treatment liquid. This recording medium 22 was then conveyed through the first intermediate conveyance unit 24 to the image formation unit 14, and droplets of respective aqueous inks of C M and Y (cyan, magenta and yellow) were ejected from the head 72C, 72M and 72Y in accordance with an image signal. The ink ejection volume was 1.4 pl in the highlight portions and 3 pl (2 drops) in the high-density portions, and the recording density was 1200 dpi in both the main scanning direction and the sub-scanning direction. In this case, if a nozzle suffering an ejection failure occurred, then processing was implemented whereby 5 pl (3 drops) was used in the nozzles adjacent to the ejection failure nozzle, so as to reduce the visibility of banding caused by the ejection failure. By providing the treatment liquid drum 54 and the drying drum 76 separately from the image formation drum 70, stable ejection was achieved without the heat or air flow causing any adverse effects on the image formation unit, even if drying of the treatment liquid was carried out at high-speed. Thereupon, the recording medium was dried on the drying drum 76 by means of the first IR heater 78 (surface temperature 180° C.), the air blowing nozzle 80 (warm air flow at 70° C. and flow rate of 12 $m^3$/min.) and the second IR heater 82 (surface temperature 180° C.). The drying time was about 2 seconds.

Thereupon, the recording medium 22 on which the image had been formed was fixed by heating at a nip pressure of 0.30 MPa by means of the fixing drum 84 at 50° C., the first fixing roller 86 and the second fixing roller 88 at 80° C. In this, the rollers used as the first fixing roller 86 and the second fixing roller 88 were rollers formed by providing 6 mm thick silicone rubber having a hardness of 30° on a metal core, and forming a soft PFA coating (having a thickness of 50 μm) thereon, to yield a roller having excellent contact and separating characteristics with respect to the ink image.

The recording medium 22 was conveyed at a conveyance speed of 535 mm/s by drum conveyance by means of the drums 54, 70, 76 and 84.

<Preparation of Aqueous Inks Used in the Experiments>

<<Synthesis of Resin Dispersant P-1>>

A resin dispersant P-1 representing one mode of the resin dispersant (A) was synthesized according to the following scheme.

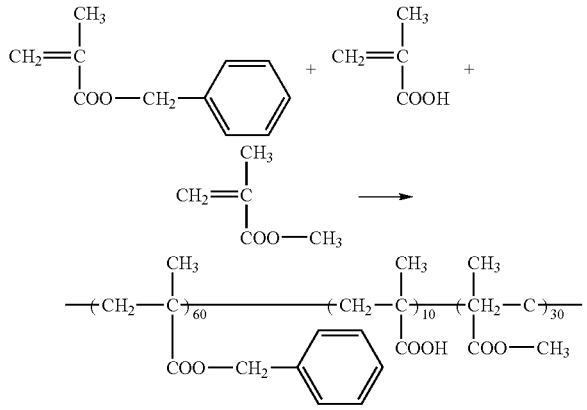

(P-1)

A total of 88 g of methyl ethyl ketone was placed in a three-neck flask with a capacity of 1000 milliliters (ml) equipped with a stirrer and a cooling tube, heating to 72° C. was performed under a nitrogen atmosphere, and then a solution obtained by dissolving 0.85 g of dimethyl 2,2'-azobisisobutyrate, 60 g of benzyl methacrylate, 10 g of methacrylic acid, and 30 g of methyl methacrylate in 50 g of methyl ethyl ketone was dropwise added within 3 hours. Upon completion of dropping, the reaction was conducted for 1 hour, then a solution obtained by dissolving 0.42 g of dimethyl 2,2'-azobisisobutyrate in 2 g of methyl ethyl ketone was added, the temperature was raised to 78° C. and heating was performed for 4 hours. The reaction solution obtained was twice reprecipitated in a large excess amount of hexane, and the precipitated resin was dried to obtain 96 g of the resin dispersant P-1.

The composition of the obtained resin dispersant P-1 was verified by H-NMR, and the weight-average molecular weight (Mw) found by GPC was 44,600. Further, the acid value of the polymer was found by a method described in a JIS standard (JIS K0070, 1992). The result was 65.2 mg KOH/g.

<<Synthesis of Self-Dispersible Polymer Microparticles B-01>>

Self-dispersible polymer microparticles B-01 representing an embodiment of self-dispersible polymer microparticles (C) were synthesized by the following scheme.

A total of 360.0 g of methyl ethyl ketone was loaded into a reaction container formed from a three-neck flask of two liters and equipped with a stirrer, a thermometer, a reflux cooler, and a nitrogen gas introducing tube, and the temperature was raised to 75° C.

A mixed solution including 180.0 g of phenoxyethyl acrylate, 162.0 g of methyl methacrylate, 18.0 g of acrylic acid, 72 g of methyl ethyl ketone, and 1.44 g of "V-601" (manufactured by Wako Junyaku) was dropwise added at a constant rate so that the dropwise addition was completed within 2 hours, while maintaining the temperature inside the reaction container at 75° C.

Upon completion of dropping, a solution including 0.72 g of "V-601" and 36.0 g of methyl ethyl ketone was added and stirring was performed for 2 hours at a temperature of 75° C. Then, a solution including 0.72 g of "V-601" and 36.0 g of isopropanol was added and stirring was performed for 2 hours at 75° C., followed by heating to 85° C. and further stirring for 2 hours.

The weight-average molecular weight (Mw) of the copolymer obtained was 64,000, and the acid value was 38.9 (mg KOH/g). The weight-average molecular weight (Mw) was calculated by polystyrene recalculation by gel permeation chromatography (GPC). The columns TSKgel SuperHZM-H, TSKgel SuperHZ4000, and TSKgel SuperHZ200 (manufactured by Tosoh Corp.) were used in this process.

A total of 668.3 g of the polymerization solution of the copolymer was then weighed, 388.3 g of isopropanol and 145.7 ml of 1 mol/L aqueous NaOH solution were added, and the temperature inside the reaction container was raised to 80° C. Then, 720.1 g of distilled water was dropwise added at a rate of 20 ml/min and an aqueous dispersion was obtained. The temperature inside the reaction container was then maintained for 2 hours at 80° C., for 2 hours at 85° C., and for 2 hours at 90° C. under atmospheric pressure, and the pressure inside the reaction container was then lowered to distill out a total of 913.7 g of isopropanol, methyl ethyl ketone, and distilled water. As a result, an aqueous dispersion (emulsion) of self-dispersible polymer microparticles (B-01) with a concentration of solids of 28.0% was obtained.

A chemical structure formula of the self-dispersible polymer microparticles (B-01) is presented below. The numerical values relating to each structural unit represent a weight ratio.

(B-01)

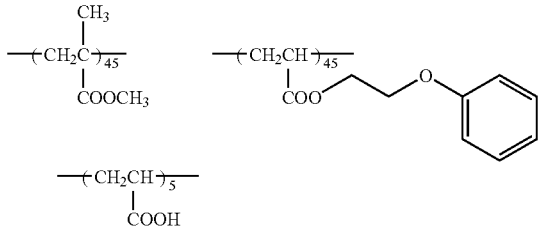

<<Preparation of Dispersion of Resin Particles Including a Cyan Pigment>

A total of 10 parts by weight by a Pigment Blue 15:3 (Phthalocyanine Blue A220, manufactured by Dainichi Seika Color & Chemicals), 5 parts by weight of the resin dispersant (P-1) described in Table 1, 42 parts by weight of methyl ethyl ketone, 5.8 parts by weight of 1N aqueous NaOH solution, and 86.9 parts by weight of deionized water were mixed and dispersed for 2 hours to 6 hours in a bead mill using zirconia beads with a diameter of 0.1 mm.

The methyl ethyl ketone was removed from the obtained dispersion at 55° C. under reduced pressure and part of water was then removed to obtain a dispersion of resin particles including a cyan pigment with a pigment concentration of 10.2 wt %.

<<Preparation of Cyan Ink Composition C-1>>

The obtained dispersion of resin particles including a cyan pigment and self-dispersible polymer microparticles (B-01) were used to prepare a water-soluble cyan ink composition C-1 of the following composition:

Dispersion of resin particles including a cyan pigment: 39.2 parts by weight.

Self-dispersible polymer microparticles (B-01): 28.6 parts by weight.

Glycerin: 20.0 parts by weight.

Diethylene glycol: 10.0 parts by weight.

Olfine E1010: (manufactured by Nisshin Kagaku Kogyo): 1.0 part by weight.

Deionized water: 1.2 part by weight.

<<Preparation of Magenta Ink Composition M-1>>

A magenta ink composition M-1 was prepared in the same manner as the cyan ink composition, except that Cromophthal Jet Magenta DWQ (PR-122) manufactured by Chiba Specialty Chemicals was used instead of the Pigment Blue 15:3 (Phthalocyanine Blue A220, manufactured by Dainichi Seika Color & Chemicals) used in the preparation of the cyan pigment dispersion.

<<Preparation of Yellow Ink Composition Y-1>>

A yellow ink composition Y-1 was prepared in the same manner as the cyan ink composition, except that Irgalite Yellow GS (PY74) manufactured by Chiba Specialty Chemicals was used instead of the Pigment Blue 15:3 (Phthalocyanine Blue A220, manufactured by Dainichi Seika Color & Chemicals) used in the preparation of the cyan pigment dispersion.

<<Preparation of Black Ink Composition Bk-1>>

A black ink composition Bk-1 was prepared in the same manner as the cyan ink composition, except that Carbon Black MA100 manufactured by Mitsubishi Chemicals was used instead of the Pigment Blue 15:3 (Phthalocyanine Blue A220, manufactured by Dainichi Seika Color & Chemicals) used in the preparation of the cyan pigment dispersion.

<<Preparation of Cyan Ink Composition C-2, Magenta Ink Composition M-2, Yellow Ink Composition Y-2, and Black Ink Composition Bk-2>>

Further, aqueous inks satisfying the conditions set forth by the present invention were also prepared by replacing glycerin used as a high boiling-point solvent in the above-described preparation of cyan ink composition C-1, magenta ink composition M-1, yellow ink composition Y-1, and black ink composition Bk-1 with half amount of GP-250 (trioxypropylene glyceryl ether, Sunnix GP250, manufactured by Sanyo Chemical Industries), replacing diethylene glycol with half amount DEGrnEE (diethylene glycol monoethyl ether), and making up a difference with water. As a result, cyan ink composition C-2, magenta ink composition M-2, yellow ink composition Y-2, and black ink composition Bk-2 were prepared.

<<Preparation of Cyan Ink Composition C-3, Magenta Ink Composition M-3, Yellow Ink Composition Y-3 and Black Ink Composition Bk-3>>

As other examples, cyan ink composition C-3, magenta ink composition M-3, yellow ink composition Y-3 and black ink composition Bk-3 were prepared by reducing the self-dispersible polymer micro-particles (B-01) to 14.3 parts by weight and making up a difference with water in the above-described preparation of cyan ink composition C-2, magenta ink composition M-2, yellow ink composition Y-2 and black ink composition Bk-2.

<<Preparation of Cyan Ink Composition C-4, Magenta Ink Composition M-4, Yellow Ink Composition Y-4 and Black Ink Composition Bk-4 for Comparative Examples>>

As other aqueous inks for use in the comparative examples, cyan ink composition C-4, magenta ink composition M-4, yellow ink composition Y-4 and black ink composition Bk-4 were prepared by reducing the self-dispersible polymer micro-particles (B-01) to 7.2 parts by weight and making up a difference with water in the above-described preparation of cyan ink composition C-2, magenta ink composition M-2, yellow ink composition Y-2 and black ink composition Bk-2.

<<Preparation of Cyan Ink Composition C-5, Magenta Ink Composition M-5, Yellow Ink Composition Y-5 and Black Ink Composition Bk-5 for Comparative Examples>>

As other aqueous inks for use in the comparative examples, cyan ink composition C-5, magenta ink composition M-5, yellow ink composition Y-5 and black ink composition Bk-5 were prepared by excluding the self-dispersible polymer micro-particles (B-01) and making up a difference with water in the above-described preparation of cyan ink composition C-2, magenta ink composition M-2, yellow ink composition Y-2 and black ink composition Bk-2.

<Preparation of Treatment Liquid>

A treatment liquid was prepared by mixing together respective components to achieve the following composition:

Citric acid (manufactured by Wako Pure Chemical Industries): 16.7%

Diethylene glycol monomethyl ether (manufactured by Wako Pure Chemical Industries): 20.0%

Zonyl FON-100 (manufactured by Dupont): 1.0%

Deionized water: 62.3%

The physical properties of the treatment liquid thus prepared were measured as follows: the viscosity was 4.9 mPa·s, the surface tension was 24.3 mN/n and the pH was 1.5.

Test Results

Image formation was carried out by means of the inkjet recording apparatus and the image forming method described above, onto a recording medium (Tokubishi Art double-side N 104.7 g/m$^2$) using the cyan ink compositions C-1 to C-5, the magenta ink compositions M-1 to M-5, the yellow ink compositions Y-1 to Y-5, and the black ink compositions Bk-1 to Bk-5 described above, while varying the drying speed of the ink solvent. In the images thus obtained, the landing interference, curl, image contraction, text reproducibility and image strength were evaluated. The evaluation items were assessed on the basis of the levels: "excellent", "good", "fair" and "poor" as indicated below.

<Evaluation Criteria for Landing Interference>

Good: variation in line thickness was not more than 5 μm when line was drawn using four adjacent nozzles Fair: variation in line thickness was more than 5 μm and not more than 10 μm when line was drawn using four adjacent nozzles Poor: variation in line thickness was more than 10 μm when line was drawn using four adjacent nozzles <Evaluation Criteria for Image Contraction>

A 50 dot by 50 dot square shape was printed at a 100% rate of the dot percentage by superimposing magenta and cyan, and the ratio of the actual surface area with respect to the theoretical surface area was found.

Good: image contraction was not higher than 1%

Fair: image contraction was higher than 1% and not higher than 5%

Poor: image contraction was higher than 5%

<Evaluation Criteria for Text Reproducibility>

Good: a 3-point Japanese character "Hawk" with high density of strokes was reproduced Fair: a 3-point Japanese character "Hawk" with high density of strokes was not reproduced, but a 4-point Japanese character "Hawk" with high density of strokes was reproduced Poor: a 4-point Japanese character "Hawk" with high density of strokes was not reproduced <Evaluation Criteria for Curl>

A sample or a recording medium printed at a print rate of 250% was cut to 5 mm×50 mm in such a manner that the longer edges traced an arc, and the curvature C of the sample was measured as described below. Curl was evaluated on the basis of the following evaluation criteria.

<<Method of Measuring Curvature>>

The curvature C of a sample onto which aqueous ink had been applied was measured after storing for a prescribed time in an environment of 25° C. temperature and relative humidity 50%. The culvature C can be expressed in terms of an arc of a circle having a radius of R (meter) as: C=1/R.

<<Evaluation Criteria>>

Excellent: curvature C of sample did not exceed 10 after storing for one day after application of aqueous ink Good: curvature C of sample did not exceed 20 after storing for one day after application of aqueous ink Fair: curvature C of sample did not exceed 20 after storing for seven days after application of aqueous ink Poor: curvature C of sample exceeded 20 after storing for seven days after application of aqueous ink <Measurement and Evaluation of Image Strength>

Good: no visible change in the surface condition of the printed area of a sample when an unprinted recording medium was placed over the printed area of the sample and rubbed back and forth five times (at a velocity of 20 mm/s) applying a load of 200 g/cm$^2$.

Fair: some change observed in the glossiness of the printed area of a sample, but no change in image density observed, when an unprinted recording medium was placed over the printed area of the sample and rubbed back and forth five times (at a velocity of 20 mm/s) applying a load of 200 g/cm$^2$.

Poor: visible change in image density observed in the printed area of a sample when an unprinted recording medium was placed over the printed area of the sample and rubbed back and forth five times (at a velocity of 20 mm/s) applying a load of 200 g/cm$^2$.

<Results of Experiment A>

The corresponding results are shown in the table in FIG. 15, in which the "strong", "medium" and "weak" drying speeds were specified as follows. "Strong" means that after completing drying (approximately 2 seconds) on the drying drum 76, the residual amount of the water (9.4 g/m$^2$) introduced by the ink was not smaller than 2 g/m$^2$ and smaller than 3 g/m$^2$, "medium" means that the residual amount was not smaller than 3 g/m$^2$ and smaller than 5 g/m$^2$, and "weak" means that the residual amount was not smaller than 5 g/m$^2$.

As can be seen from the table in FIG. 15, in the comparative example 1-14 which used the inks not containing the self-dispersible polymer micro-particles, landing interference, curl, text reproducibility and image strength all became worse. Furthermore, in the comparative examples 1-4, 1-7, 1-11 and 1-13 which did not use the treatment liquid, the landing interference, curl and text reproducibility became worse.

On the other hand, in the examples 1-1, 1-2, 1-3, 1-5, 1-6, 1-8, 1-9, 1-10 and 1-12 which satisfied the conditions of the present invention in terms of both the inkjet recording apparatus and the ink, the evaluations of "fair" or above were obtained in respect of all of the items: landing interference, curl, image contraction, text reproducibility and image strength. In particular, the examples 1-1, 1-2, 1-3, 1-5, 1-6, 1-8, 1-9 and 1-10 showed improvement in terms of landing interference and text reproducibility, due to the fact that the ink used had a ratio of "self-dispersible polymer micro-particles (B-01)/pigment" at 1.0 or above. Furthermore, the examples 1-1, 1-2, 1-5, 1-8 and 1-9 had a drying speed of "strong" or "medium", and therefore improvement was observed in terms of curl properties and image strength.

Experiment B

In Experiment B, experiments were carried out in the similar conditions with Experiment A while imparting the treatment liquid in all experiments and altering the types of recording media. More specifically, the experiments were carried out using Urite (84.9 g/m$^2$) and New Age (104.7 g/m$^2$) in Experiment B, whereas Tokubishi Art double-side N 104.7 g/m$^2$ was used as the recording medium in Experiment A. The corresponding results are shown in the table in FIG. 16.

As can be seen from the table in FIG. 16, similar beneficial effects as Experiment A were obtained even when the type of recording medium was varied. In other words, in all of the examples 2-1 to 2-12 which satisfied the conditions of the present invention in terms of both the inkjet recording apparatus and the ink, the evaluations of "fair" or above were obtained in respect of all of the items: landing interference, curl, image contraction, text reproducibility and image strength. In particular the examples 2-1 to 2-10 showed improvement in terms of landing interference and text reproducibility, since the ink used had a ratio of "self-dispersible polymer micro-particles (B-01)/pigment" at 1.0 or above. Furthermore, the examples 2-1, 2-3, 2-4, 2-5, 2-7, 2-8 and 2-9 had a drying speed of "strong" or "medium", and therefore improvement was observed in terms of curl properties and image strength.

Experiment C

In Experiment C, experiments were carried out in the similar conditions with Experiment A while altering the types of treatment liquids. The recording medium used was Tokubishi Art double-side N 104.7 g/m$^2$, and the inks used were C-2, M-2, Y-2 and Bk-2. Furthermore, the treatment liquids used were the treatment liquids 1 to 4 described below.

<Composition of Treatment Liquid 1>

Citric acid (manufactured by Wako Pure Chemical Industries): 16.7%

Diethylene glycol monomethyl ether (manufactured by Wako Pure Chemical Industries): 20.0%

Zonyl FSN-100 (manufactured by Dupont): 1.0%

Deionized water: 62.3%<

<Composition of Treatment Liquid 2>

The organic solvent (diethylene glycol monomethyl ether) in the treatment liquid 1 was replaced with 20.0% of diethylene glycol monobutyl ether (manufactured by Wako Pure Chemical Industries).

<Composition of Treatment Liquid 3>

The acid (citric acid) in the treatment liquid 1 was replaced with 16.7% maronic acid.

<Composition of Treatment Liquid 4>

The organic solvent (diethylene glycol monomethyl ether) in the treatment liquid 1 was replaced with 20.0% of glycerin (manufactured by Wako Pure Chemical Industries).

<Results of Experiment C>

The corresponding results are shown in the table in FIG. 17. As can be seen from the table in FIG. 17, in comparison with the comparative examples 3-4 and 3-5 in which the treatment liquid not containing the non-curling solvent was applied, the examples 3-1, 3-2 and 3-3 in which the treatment liquid containing the non-curling solvent was applied obtained beneficial effects in terms of suppressing curl and achieving good text reproducibility. In particular, the examples 3-1 and 3-3 yielded the evaluations of "good" for all of the items: landing interference, curl, image contraction, text reproducibility, and image strength, even at the drying strength of "medium".

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording method, comprising:

a treatment liquid depositing step of applying treatment liquid onto a recording medium while holding the recording medium on a circumferential surface of a treatment liquid drum and conveying the recording medium by rotating the treatment liquid drum, and drying at least a portion of a solvent in the treatment liquid;

an image forming step of ejecting ink from a line inkjet head to deposit the ink onto the recording medium on which the treatment liquid has been deposited, while holding the recording medium on a circumferential surface of an image formation drum and conveying the recording medium by rotating the image formation drum, the ink containing at least a resin dispersant (A), a pigment (B) that is dispersed by the resin dispersant (A), self-dispersible polymer micro-particles (C) and an aqueous liquid medium (D), the ink having one of a solid component that is aggregated upon making contact with the treatment liquid and a solid component that is precipitated upon making contact with the treatment liquid; and a drying step of drying a solvent in the ink having been deposited on the recording medium while holding the recording medium on a circumferential surface of a drying drum and conveying the recording medium by rotating the drying drum.

2. The method as defined in claim 1, wherein in the drying step, a residual amount of water introduced by the ink on the recording medium is made less than 5 g/m$^2$.

3. The method as defined in claim 1, wherein a ratio of the self-dispersible polymer micro-particles (C) to the pigment (B) is at least 1.0.

4. The method as defined in claim 1, further comprising a fixing step of fixing the ink having been dried in the drying step onto the recording medium by applying heat and pressure to the recording medium, while holding the recording medium on a circumferential surface of a fixing drum and conveying the recording medium by rotating the fixing drum.

5. The method as defined in claim 1, further comprising, at least one of between the treatment liquid deposition step and the image forming step and between the image forming step and the drying step, an intermediate conveyance step of receiving and transferring the recording medium, while holding a leading end of the recording medium on a circumferential surface of an intermediate conveyance drum and conveying the recording medium by rotating the intermediate conveyance drum in such a manner that a recording surface of the recording medium does not make contact with the circumferential surface of the intermediate conveyance drum while guiding a non-recording surface of the recording medium by means of a conveyance guide disposed following the circumferential surface of the intermediate conveyance drum.

6. The method as defined in claim 1, wherein in the image forming step, the line inkjet head has a head width of not shorter than 50 cm, and nozzles arranged at a nozzle density of not lower than 1000 dpi in a sub-scanning direction.

7. The method as defined in claim 1, wherein:

the resin dispersant (A) in the ink has a hydrophobic structural unit (a) and a hydrophilic structural unit (b);

the hydrophobic structural unit (a) includes at least 40 wt % of a hydrophobic structural unit (a1) having an aromatic ring which is not directly bonded to atoms forming a main chain of the resin (A), and at least 15 wt % of a hydrophobic structural unit (a2) derived from an alkyl ester of one of acrylic acid and methacrylic acid having 1 to 4 carbon atoms; and the hydrophilic structural unit (b) includes a structural unit (b1) derived from at least one of acrylic acid and methacrylic acid, and a ratio of the hydrophilic structural unit (b) is not higher than 15 wt %.

8. The method as defined in claim 1, wherein an aromatic ring which is not directly bonded to atoms forming a main chain of the resin dispersant (A) in the ink is present in a ratio of not lower than 15 wt % and not higher than 27 wt % in the resin dispersant (A).

9. The method as defined in claim 1, wherein the self-dispersible polymer micro-particles (C) in the ink contain a structural unit derived from an aromatic group-containing (meth)acrylate monomer, a content ratio thereof being 10 wt % to 95 wt %.

10. The method as defined in claim 1, wherein the self-dispersible polymer micro-particles (C) in the ink contain a first polymer having a carboxyl group and an acid number of 25 to 100.

11. The method as defined in claim 10, wherein the first polymer is prepared in an organic solvent and as a polymer dispersion with water as a continuous phase, by neutralizing at least a portion of the carboxyl group in the first polymer.

* * * * *